US010315880B2

(12) United States Patent
Nakano

(10) Patent No.: US 10,315,880 B2
(45) Date of Patent: Jun. 11, 2019

(54) SHEET PROCESSING APPARATUS AND IMAGE FORMING APPARATUS INCLUDING THE SAME

(71) Applicant: Takahiro Nakano, Misato (JP)

(72) Inventor: Takahiro Nakano, Misato (JP)

(73) Assignee: CANON FINETECH NISCA INC., Misato-Shi, Saitama (JP)

( * ) Notice: Subject to any disclaimer, the term of this patent is extended or adjusted under 35 U.S.C. 154(b) by 0 days.

(21) Appl. No.: 15/702,263

(22) Filed: Sep. 12, 2017

(65) Prior Publication Data

US 2018/0079616 A1 Mar. 22, 2018

(30) Foreign Application Priority Data

Sep. 20, 2016 (JP) ..... 2016-182626
Sep. 20, 2016 (JP) ..... 2016-182627
Sep. 20, 2016 (JP) ..... 2016-182628

(51) Int. Cl.
*B65H 33/08* (2006.01)
*B65H 31/24* (2006.01)
(Continued)

(52) U.S. Cl.
CPC ..... *B65H 33/08* (2013.01); *B65H 29/145* (2013.01); *B65H 31/02* (2013.01); *B65H 31/24* (2013.01);
(Continued)

(58) Field of Classification Search
CPC ..... B65H 29/145; B65H 31/02; B65H 31/24; B65H 31/36; B65H 31/38; B65H 31/3027; B65H 33/08; B65H 37/04; B65H 37/06; B65H 43/00; B65H 2301/1635; B65H 2301/4212; B65H 2301/4213; B65H 2301/42192; B65H 2301/42194; B65H 2403/942; B65H 2408/1222;
(Continued)

(56) References Cited

U.S. PATENT DOCUMENTS 5,112,034 A * 5/1992 Uto ..... B65H 29/60 270/58.12
7,165,764 B2 1/2007 Nakamura et al.
(Continued)

FOREIGN PATENT DOCUMENTS

EP 1 455 241 B1 5/2007
JP 4058374 B2 3/2008

*Primary Examiner* — Leslie A Nicholson, III
(74) *Attorney, Agent, or Firm* — Manabu Kanesaka

(57) ABSTRACT

A sheet processing apparatus includes a sheet processing unit that processes a sheet placed on a placing tray, a discharge roller that discharges the sheet processed on the placing tray to a stacking tray, a conveyance roller that discharges a sheet to the placing tray or conveys a subsequent sheet from upstream to downstream of the discharge roller and switchback-conveys the subsequent sheet upstream again, and a standby path (branch path) that keeps the sheet switched back by the conveyance roller on standby. The subsequent sheet is conveyed to a downstream side of the discharge roller by the conveyance roller and then returned to an upstream side again by switchback conveyance. During the switchback conveyance, the discharge roller nips and discharges the sheets on the placing tray to the stacking tray.

13 Claims, 30 Drawing Sheets

(51) Int. Cl.

| | |
|---|---|
| ***B65H 37/06*** | (2006.01) |
| ***B65H 37/04*** | (2006.01) |
| ***B65H 29/14*** | (2006.01) |
| ***B65H 31/02*** | (2006.01) |
| ***B65H 31/30*** | (2006.01) |
| ***B65H 31/36*** | (2006.01) |
| ***B65H 31/38*** | (2006.01) |
| ***B65H 43/00*** | (2006.01) |

(52) U.S. Cl.
CPC ..... *B65H 31/3027* (2013.01); *B65H 31/36* (2013.01); *B65H 31/38* (2013.01); *B65H 37/04* (2013.01); *B65H 37/06* (2013.01); *B65H 43/00* (2013.01); *B65H 2301/1635* (2013.01); *B65H 2301/4212* (2013.01); *B65H 2301/4213* (2013.01); *B65H 2301/42192* (2013.01); *B65H 2301/42194* (2013.01); *B65H 2403/942* (2013.01); *B65H 2408/1222* (2013.01); *B65H 2511/224* (2013.01); *B65H 2511/30* (2013.01); *B65H 2801/06* (2013.01); *B65H 2801/27* (2013.01)

(58) Field of Classification Search
CPC ..... B65H 2511/224; B65H 2511/30; B65H 2801/06; B65H 2801/27
USPC ..... 270/37, 58.01, 58.08, 58.12, 58.17
See application file for complete search history.

(56) References Cited

U.S. PATENT DOCUMENTS

| | | | | |
|---|---|---|---|---|
| 7,281,707 | B2 * | 10/2007 | Moriyama | B42C 1/12 270/58.04 |
| 7,354,034 | B2 | 4/2008 | Nakamura et al. | |
| 7,540,482 | B2 * | 6/2009 | Fujii | B65H 29/51 270/58.08 |
| 7,543,806 | B2 | 6/2009 | Nakamura et al. | |
| 7,946,563 | B2 * | 5/2011 | Fukasawa | G03G 15/6582 270/32 |
| 7,975,999 | B2 * | 7/2011 | Fukasawa | B65H 37/04 270/32 |
| 8,123,209 | B2 * | 2/2012 | Kubota | B42C 1/12 270/58.07 |
| 8,439,342 | B2 * | 5/2013 | Okamoto | B65H 31/3027 270/58.08 |
| 9,045,308 | B2 * | 6/2015 | Tamura | G03G 15/6547 |
| 9,329,555 | B2 * | 5/2016 | Motoi | B65H 29/60 |

* cited by examiner

SHEET PROCESSING APPARATUS AND IMAGE FORMING APPARATUS INCLUDING THE SAME

BACKGROUND OF THE INVENTION

1. Field of the Invention

The present invention relates to a sheet processing apparatus for applying processing to sheets and an image forming apparatus, and more particularly to improvement of sheet alignment when discharging a sheet bundle from a placing tray which processes sheets.

2. Description of the Related Art

Some image forming apparatuses, like a copying machine, a laser beam printer, a facsimile, and combined machines thereof, may conventionally include a sheet processing apparatus for performing sheet processing such as binding processing and sort processing on image-formed sheets.

Such an image forming apparatus performs so-called buffer processing in which a subsequent sheet or sheets are once kept on standby to reduce delay of carry-in of subsequent sheets while the binding or sort processing is performed on a preceding sheet bundle on a placing tray. Keeping one or a plurality of subsequent sheets on standby reduces the chances to stop the carry-in of subsequent sheets if the sheet processing on the sheet bundle on the placing tray takes some time.

A sheet processing apparatus capable of higher speed and greater capacity has been desired in recent years. To meet such a demand, an apparatus described in Japanese Patent No. 4058374 (corresponding U.S. Pat. No. 7,165,764 B2) has been proposed. In this apparatus, a plurality of subsequent sheets mentioned above and a sheet bundle on a placing tray are nipped by discharge rollers in an overlapping manner, and simultaneously transported to a stacking tray side (see FIG. 26 of the foregoing patent literature).

The sheet bundle on the placing tray is then discharged to the stacking tray. At this point, the discharge rollers are rotated backward to store the subsequent sheets into the placing tray (see FIGS. 27 and 28 of the foregoing patent literature). Since the discharge of the sheet bundle from the placing tray and the transportation of the subsequent sheets are simultaneously performed for so-called simultaneous bundle discharge, the discharge time of the sheets can be reduced, compared to when the buffer processing is performed.

The sheet processing apparatus according to the foregoing patent literature seldom causes a problem if the sheet bundle placed on the placing tray is bounded by a binding unit such as a stapling unit. However, it has found that the following problem occurs if the simultaneous bundle discharge described above is performed on unbound sheet bundles, like when unbound sheet bundles are discharged to the stacking tray by changing the placing position on the placing tray sheet bundle by sheet bundle.

The problem will be described with reference to FIGS. 29A to 29D accompanying the present specification. FIGS. 29A to 29D show a sheet processing apparatus which performs simultaneous bundle discharge similar to that of FIG. 26 to FIG. 28 of the foregoing patent literature. In the accompanying FIG. 29A, an unbound sheet bundle TB2 is placed on a placing tray Tr. A preceding sheet bundle TB1 is already stacked on a stacking tray TE on the downstream side of the placing tray Tr. The sheet bundle TB1 is not bound, either, and is shifted from the sheet bundle TB2 in a sheet width direction for the sake of sorting. In such a state, as shown in FIG. 29A, two subsequent sheets np1 and np2 are conveyed by conveyance rollers HR.

Next, as shown in FIG. 29B, the sheet bundle TB2 is pushed by a pushing member Ph, which reciprocates on the placing tray Tr, in advance to precede the subsequent sheets np1 and np2. The subsequent sheets np1 and np2 conveyed afterward and the sheet bundle on the placing tray Tr are nipped together by discharge rollers ER in an overlapping state (state in which the sheet bundle TB2 precedes), and transported toward the stacking tray TE.

By the transportation by the discharge rollers ER, the sheet bundle TB2 is discharged to the stacking tray. For example, if the sheets here curl upward, as shown in FIG. 29C, the topmost sheet of the sheet bundle TB2 is pushed by the subsequent sheets np1 and np2 to deteriorate alignment on the stacking tray TE.

If the sheet bundle TB2 on the placing tray Tr is stacked on the stacking tray TE, the discharge rollers ER then rotate in reverse directions to store the subsequent sheets np1 and np2 into the placing tray. Since the simultaneously-discharged sheet bundle is not bound, as shown in FIG. 29D, the sheets electrostatically adhere to the switched-back subsequent sheets np1 and np2 and are conveyed backward with the subsequent sheets np1 and np2. This also deteriorates alignment.

The subsequent sheets np1 and np2 can be discharged after the sheet bundle TB2 on the placing tray is discharged to the stacking tray TE. However, simply delaying the discharge of the subsequent sheets np1 and np2 increases discharge time.

It is thus an object of the present invention to provide an apparatus which discharges subsequent sheets and a bundle on the placing tray without hindrance to each other to stack sheet bundles without deteriorating alignment or impairing rapidity even if the sheet bundle on the placing tray is not bound.

SUMMARY OF THE INVENTION

To solve the foregoing problem, the present invention includes the following configuration:

A sheet processing apparatus including a sheet processing unit that processes a sheet placed on a placing tray, a discharge roller that discharges the sheet processed on the placing tray to a stacking tray, a conveyance roller that discharges a sheet to the placing tray or conveys a subsequent sheet from upstream to downstream of the discharge roller and switchback-conveys the subsequent sheet upstream again, and a standby path that keeps a sheet switched back by the conveyance roller on standby, wherein when the subsequent sheet is conveyed to a downstream side of the discharge roller by the conveyance roller and then returned to an upstream side by switchback conveyance, the discharge roller nips and discharges the sheet on the placing tray to the stacking tray during the switchback conveyance.

Consequently, there can be provided an apparatus that discharges a bundle on the placing tray during the switchback conveyance of subsequent sheets to stack sheet bundles without much deteriorating alignment or impairing rapidity even if the sheet bundle on the placing tray is not bound.

BRIEF DESCRIPTION OF THE DRAWINGS

FIG. 7A is a perspective view of the sheet stiffening mechanism near the center in the sheet width direction. FIG. 7B is a sectional explanatory diagram of the sheet stiffening mechanism.

FIG. 8A is an explanatory diagram in which four two-sheet bundles are formed. FIG. 8B is an explanatory diagram in which four ten-sheet bundles are formed by shifting and discharging sheets in twos. FIG. 8C is an explanatory diagram in which four ten-sheet bundles are formed by discharging sheets in tens.

FIG. 9A is an explanatory diagram in which a first sheet is conveyed to the placing tray side. FIG. 9B is an explanatory diagram in which the first sheet is carried in to the placing tray and a second sheet is conveyed.

FIG. 10A is an explanatory diagram in which a third sheet (first subsequent sheet) starts being carried in during processing of a two-sheet bundle on the placing tray. FIG. 10B is an explanatory diagram in which the third sheet (first subsequent sheet) is continuously conveyed beyond the discharge rollers.

FIG. 11A is an explanatory diagram in which sheet processing (binding processing) is performed on the sheet bundle on the placing tray, and the subsequent sheet is switched back and carried in to a branch path. FIG. 11B is an explanatory diagram in which the sheet processing (binding processing) continues to be performed on the sheet bundle on the placing tray, and a second subsequent sheet is conveyed by the conveyance rollers.

FIG. 12A is an explanatory diagram in which the sheet processing on the sheet bundle on the placing tray is completed, the sheet bundle starts being pushed out, and the subsequent sheets are conveyed to the position of the discharge rollers. FIG. 12B is an explanatory diagram in which the sheet bundle on the placing tray and the two subsequent sheets are nipped together and conveyed to the stacking tray side by the discharge rollers.

FIG. 13A is an explanatory diagram in which the discharge rollers discharge the sheet bundle on the placing tray to the stacking tray, stop once, and then start to switchback-convey the subsequent sheets. FIG. 13B is an explanatory diagram in which the two subsequent sheets finish being carried in to the placing tray and proceed to the sheet processing.

FIG. 14A is an explanatory diagram in which a first sheet is conveyed to the placing tray side. FIG. 14B is an explanatory diagram in which the first sheet is carried in to the placing tray and aligned and shifted while a second sheet is conveyed.

FIG. 15A is an explanatory diagram in which the second sheet is carried in to the placing tray and aligned and shifted. FIG. 15B is an explanatory diagram in which the subsequent sheet is switchback-conveyed, and the sheet bundle on the placing tray starts being pushed out.

FIG. 16A is an explanatory diagram in which when the subsequent sheet is switched back and positioned on an upstream side of the discharge rollers, the sheet bundle on the placing tray is nipped by the discharge rollers and starts being discharged in advance. FIG. 16B is an explanatory diagram in which two subsequent sheets are conveyed to the conveyance rollers, and the sheet bundle finishes being discharged from the placing tray.

FIG. 17A is an explanatory diagram in which one of the discharge rollers (discharge upper roller) is lifted up in preparation for passage of the subsequent sheets through the position of the discharge rollers. FIG. 17B is an explanatory diagram in which the discharge upper roller is lowered, and when the trailing edges of the nipped subsequent sheets pass the conveyance rollers, the subsequent sheets are switched back.

FIG. 18A is an explanatory diagram in which the two subsequent sheets are carried in to the placing tray. FIG. 18B is an explanatory diagram in which a subsequent sheet passes the discharge rollers and starts being switchback-conveyed, and the sheet bundle starts being pushed out.

FIG. 19A is an explanatory diagram subsequent to FIGS. 14A and 14B, in which a ten-sheet bundle is placed on the placing tray and is aligned and shifted to one side. FIG. 19B is an explanatory diagram in which an eleventh sheet starts being switched back as a subsequent sheet, and the sheet bundle starts being pushed out.

FIG. 20A is an explanatory diagram in which when the subsequent sheet is switched back and positioned on the upstream side of the discharge rollers, the sheet bundle on the placing tray is nipped by the discharge rollers and starts being discharged in advance. FIG. 20B is an explanatory diagram in which the nipping and discharge of the sheet bundle is suspended and the discharge rollers are separated due to carry-in of two subsequent sheets.

FIG. 21A is a state explanatory diagram in which the nipping and discharge of the sheet bundle is suspended, and an explanatory diagram in which the subsequent sheets move through the position of the discharge rollers to the downstream side. FIG. 21B is a state explanatory diagram in which the nipping and discharge of the sheet bundle is suspended, and an explanatory diagram in which the subsequent sheets move through the position of the discharge rollers to the downstream side and start being switched back.

FIG. 22A is an explanatory diagram in which when the subsequent sheets are switched back to the upstream side of the discharge rollers, the discharge rollers nip the sheet bundles again and start the next stage of discharge. FIG. 22B is an explanatory diagram in which the sheet bundle is discharged to the stacking tray by the discharge rollers, and three subsequent sheets are carried in.

FIG. 23A is an explanatory diagram in which the three subsequent sheets are conveyed to the placing tray side. FIG. 23B is an explanatory diagram in which the discharge upper roller starts to descend for nip conveyance after the subsequent sheets pass the discharge rollers.

FIG. 24A is an explanatory diagram in which the discharge rollers nip the subsequent sheets and rotate backward to switchback-convey the sheets to the placing tray. FIG. 24B is an explanatory diagram in which the subsequent sheets are stored into the placing tray and aligned and shifted to a position different from that of the previous sheet bundle with the discharge rollers separated.

FIG. 25A is an explanatory diagram in which when two subsequent sheets pass the position of the discharge rollers, the subsequent sheets are conveyed in a nipped state without the discharge rollers being separated. FIG. 25B is an explanatory diagram in which switchback is started when the trailing edges of the two nipped subsequent sheets pass the conveyance rollers.

FIG. 26A is an explanatory diagram in which one of the discharge rollers (discharge upper roller) is lifted up in preparation for the passage of the three subsequent sheets through the position of the discharge rollers. FIG. 26B is an explanatory diagram in which the discharge upper roller is lowered, and when the trailing edges of the nipped subsequent sheets pass the conveyance rollers, the subsequent sheets start being switched back.

FIG. 29A is an explanatory diagram in which two subsequent sheets are conveyed to the placing tray side. FIG. 29B is an explanatory diagram in which the simultaneous bundle discharge of the sheet bundle on the placing tray and the subsequent sheets is performed. FIG. 29C is an explanatory diagram showing a stacked state of sheets on the stacking tray by the simultaneous bundle discharge. FIG. 29D is an explanatory diagram showing the stacked state of the sheets on the stacking tray when the subsequent sheets discharged by the simultaneous bundle discharge are switchback-conveyed.

FIG. 30A is an explanatory diagram of a state in which two subsequent sheets are conveyed. FIG. 30B is an explanatory diagram of a state in which three subsequent sheets are conveyed.

DESCRIPTION OF THE EMBODIMENTS

Figure 1:
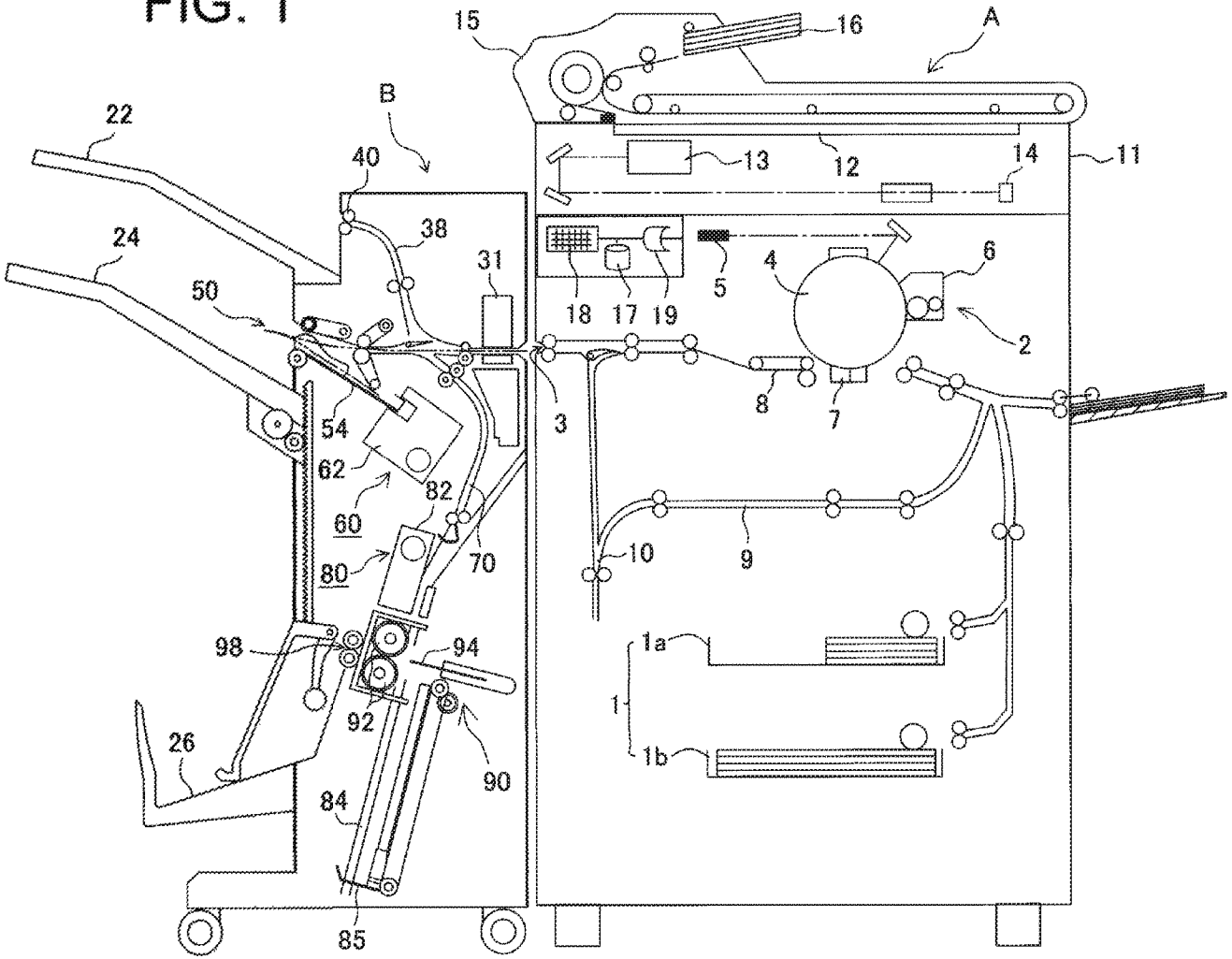
FIG. 1 is an explanatory diagram showing an overall configuration of a combination of an image forming apparatus and a sheet processing apparatus according to the present invention in combination.
Figure 2:
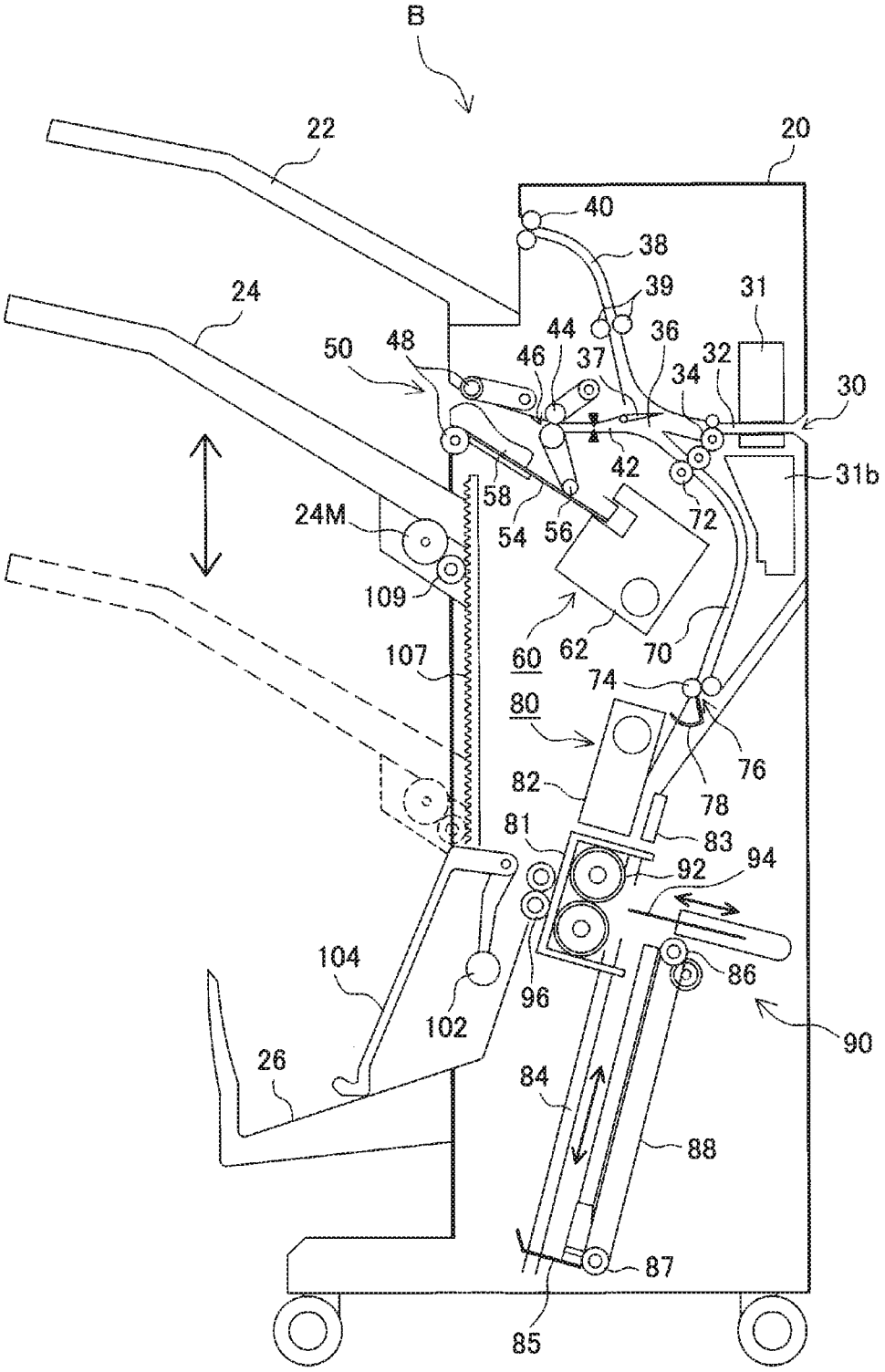
FIG. 2 is an overall explanatory diagram showing the sheet processing apparatus according to the present invention.

A mode for carrying out the invention will be described below with reference to the drawings. FIG. 1 is an overall configuration diagram showing an image forming system including an image forming apparatus A and a sheet processing apparatus B according to the present invention. FIG. 2 is an explanatory diagram showing a detailed configuration of the sheet processing apparatus B.

In the accompanying drawings, similar components are designated by the same reference numerals throughout the entire specification.

[Image Forming System]

The image forming system shown in FIG. 1 includes the image forming apparatus A and the sheet processing apparatus B. A carry-in port 30 of the sheet processing apparatus B is connected to a main body discharge port 3 of the image forming apparatus A. The image forming system is configured so that sheets on which images are formed by the image forming apparatus A are stapled by the sheet processing apparatus B and stored on a first stacking tray 24 or a second stacking tray 26. An escape tray 22 for directly storing sheets without stapling processing is arranged above the first stacking tray 24.

[Image Forming Apparatus A]

The image forming apparatus A will be described with reference to FIG. 1. The image forming apparatus A is configured so that a sheet is fed from a sheet feeding unit 1 to an image forming unit 2, and the sheet is printed by the image forming unit 2 and then discharged from the main body discharge port 3. The sheet feeding unit 1 includes sheet feed cassettes 1*a* and 1*b* in which a plurality of sizes of sheets is stored. Designated sheets are separated one by one and fed to the image forming unit 2.

The image forming unit 2 includes, for example, an electrostatic drum 4, around which a print head (laser emitter) 5, a developing device 6, a transfer charger 7, and a fixing device 8 are arranged. In the image forming unit 2, the laser emitter 5 forms an electrostatic latent image on the electrostatic drum 4. The developing device 6 applies toner to the electrostatic latent image. The transfer charger 7 transfers the resulting image to a sheet. The fixing device 8 heats and fixes the image for image formation. Sheets on which images are formed in such a manner are sequentially conveyed out from the main body discharge port 3. A circulation path 9 is a two-sided printing path through which a sheet printed on the front side is conveyed from the fixing device 8, turned over via a switchback path 10, and fed to the image forming unit 2 so that the back side of the sheet is printed. Such a two-sided printed sheet is turned over via the switchback path 10 and then conveyed out from the main body discharge port 3.

An image reading apparatus 11 scans a document sheet set on a platen 12 by a scan unit 13 and electrically reads the document sheet by a photoelectric conversion element (for example, CCD) 13. The image data is digitally processed by an image processing unit, for example, and transferred to a data storage unit 14, and an image signal is transmitted to the laser emitter 5. A document feeding apparatus 15 feeds document sheets accommodated in a document stacker 16 to the platen 12.

Figure 28:
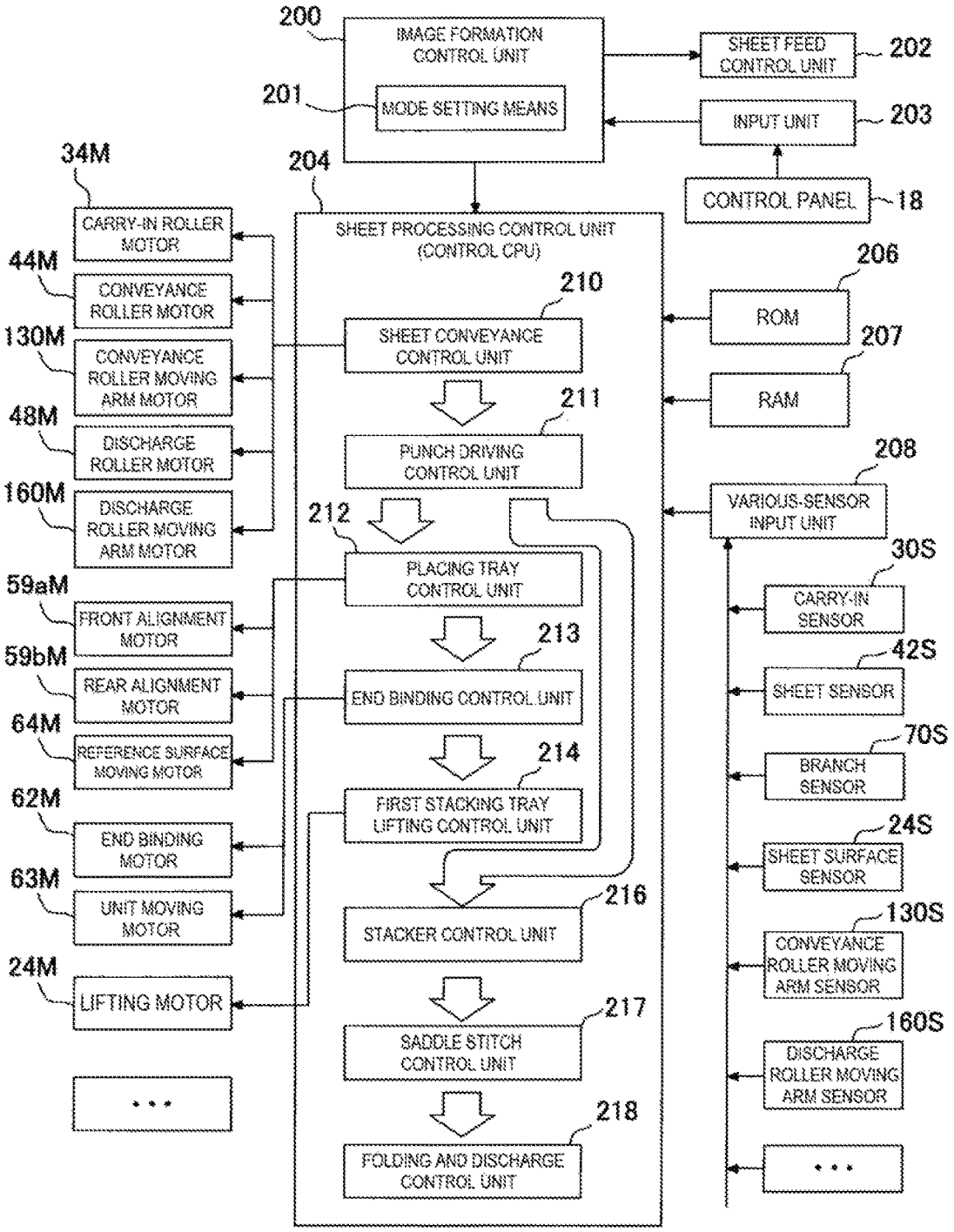
FIG. 28 is a block diagram of a control configuration in the entire configuration of FIG. 1.
Figure 29A:
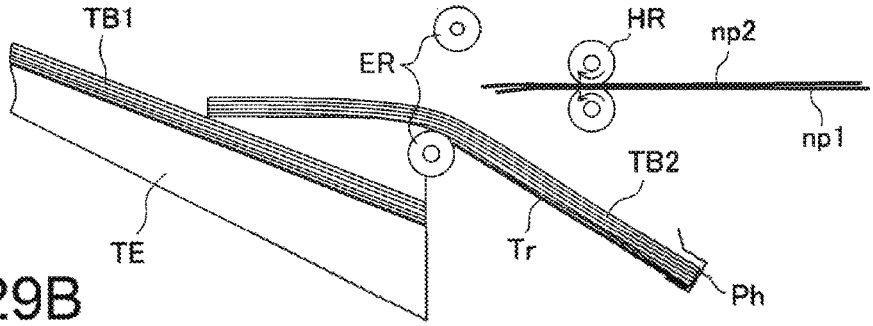
FIGS. 29A to 29D are explanatory diagrams showing a case in which subsequent sheets and an unbound sheet bundle on a placing tray are simultaneously nipped and discharged by discharge rollers (simultaneous bundle discharge).
Figure 29B:
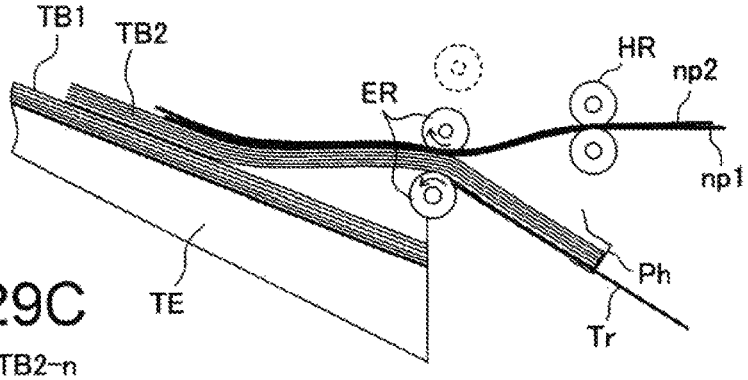
Figure 29C:
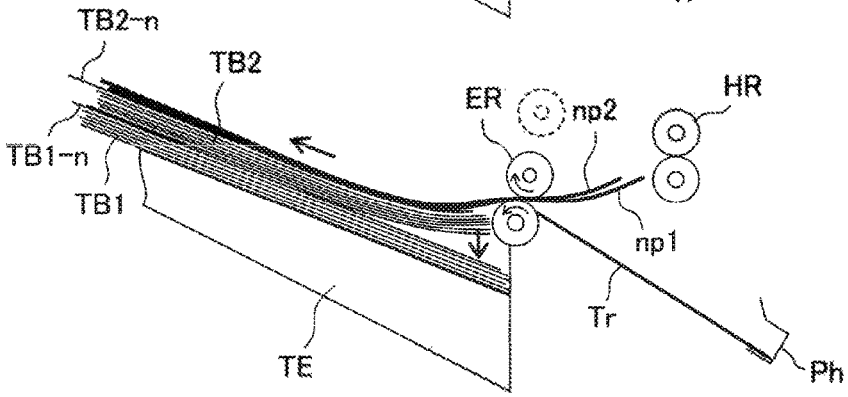
Figure 29D:
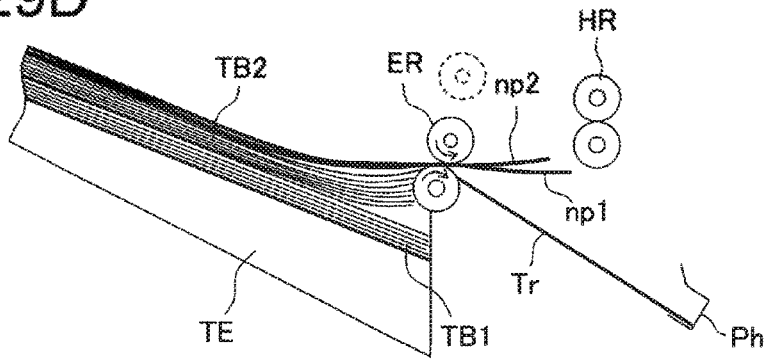

The image forming apparatus A having the foregoing configuration includes an image formation control unit 200 shown in FIG. 28. Image forming conditions are set from a control panel 18 via an input unit 203. Examples of the image forming conditions include print conditions such as sheet size, color/monochrome print, the number of copies to print, one-sided/two-sided print, and enlargement/reduction print. The image forming apparatus A stores image data read by the scan unit 13 or image data transferred from an external network into a data storage unit 17. The image data is transferred from the data storage unit 17 to a buffer memory 19, and a data signal is sequentially transferred from the buffer memory 19 to the laser emitter 5.

Sheet processing conditions are also input and specified from the control panel 18, along with the image forming conditions including the one-sided/two-sided print, enlargement/reduction print, and monochrome/color print specifications mentioned above. Examples of the sheet processing conditions include settings such as "printout mode", "end binding mode (first processing)", "sort (jog) mode (second processing)", and "saddle stitch mode". Such processing conditions will be described later.

[Sheet Processing Apparatus B]

As shown in FIGS. 1 and 2, the sheet carry-in port 30 is arranged on one side of an apparatus frame 20 of the sheet processing apparatus B. The escape tray 22 for stacking single sheets and relatively thick sheets is arranged on the other outer side. The first stacking tray 24 for stacking end-bound sheets and a relatively large amount of sheets is located below the escape tray 22. The first stacking tray 24 can be lifted up and down. The second stacking tray 26 for stacking saddle-stitched or folded sheets is arranged below the first stacking tray 24. In this invention, an end refers to surfaces near an end portion of a sheet, i.e., the front and back surfaces of an edge portion of the sheet.

[Sheet Conveyance Path]

A conveyance path 42 extending substantially straight from a carry-in path 32 to a placing tray outlet 50 is arranged from the carry-in port 30 of the sheet processing apparatus B. A punch unit 31 is arranged on the carry-in path 32. The punch unit 31 performs punching processing on a sheet end or, if needed, on a midsection in the conveyance direction. A punch waste box 31*b* for accumulating punch wastes occurring during punching processing is detachably attached to the apparatus frame 20 on the lower side of the punch unit 31 across the carry-in path 32.

Carry-in rollers 34 for conveying a sheet are arranged on a downstream side of the punch unit 31. The carry-in rollers 34 convey the sheet at high speed. Conveyance rollers 44 capable of forward and reverse rotations are arranged on the conveyance path 42 downstream of the carry-in rollers 34. The conveyance rollers 44 guide the sheet to a placing tray 54, which is a first processing tray, and the first stacking tray 24 on the downstream side. There is a sheet conveyance path outlet 46 behind the conveyance rollers 44.

Discharge rollers 48 capable of forward and reverse rotations are arranged on the downstream side of the conveyance path output port 46. The discharge rollers 48 switch back and carry in a sheet to the placing tray 54, directly discharge a sheet to the first stacking tray 24, or discharge a bundle of sheets end-bound on the placing tray 54 from the placing tray 54 to the first stacking tray 24.

[Escape Path and Branch Path]

The conveyance path 42 is branched into an escape path 38 and a branch path 70 at a branch position 36. The escape path 38 guides a sheet to the escape tray 22. The branch path 70 guides a relatively long sheet to a stacker 84 serving as a second processing tray for saddle stitch processing or folding processing. A path switch gate 37 is arranged at the branch position 36. The switch gate 37 is used to select whether to simply convey a sheet to the conveyance path 42, convey the sheet to the escape bath 38, or switch back the sheet on the conveyance path 42 and guide the sheet to the branch path 70.

Figure 3:
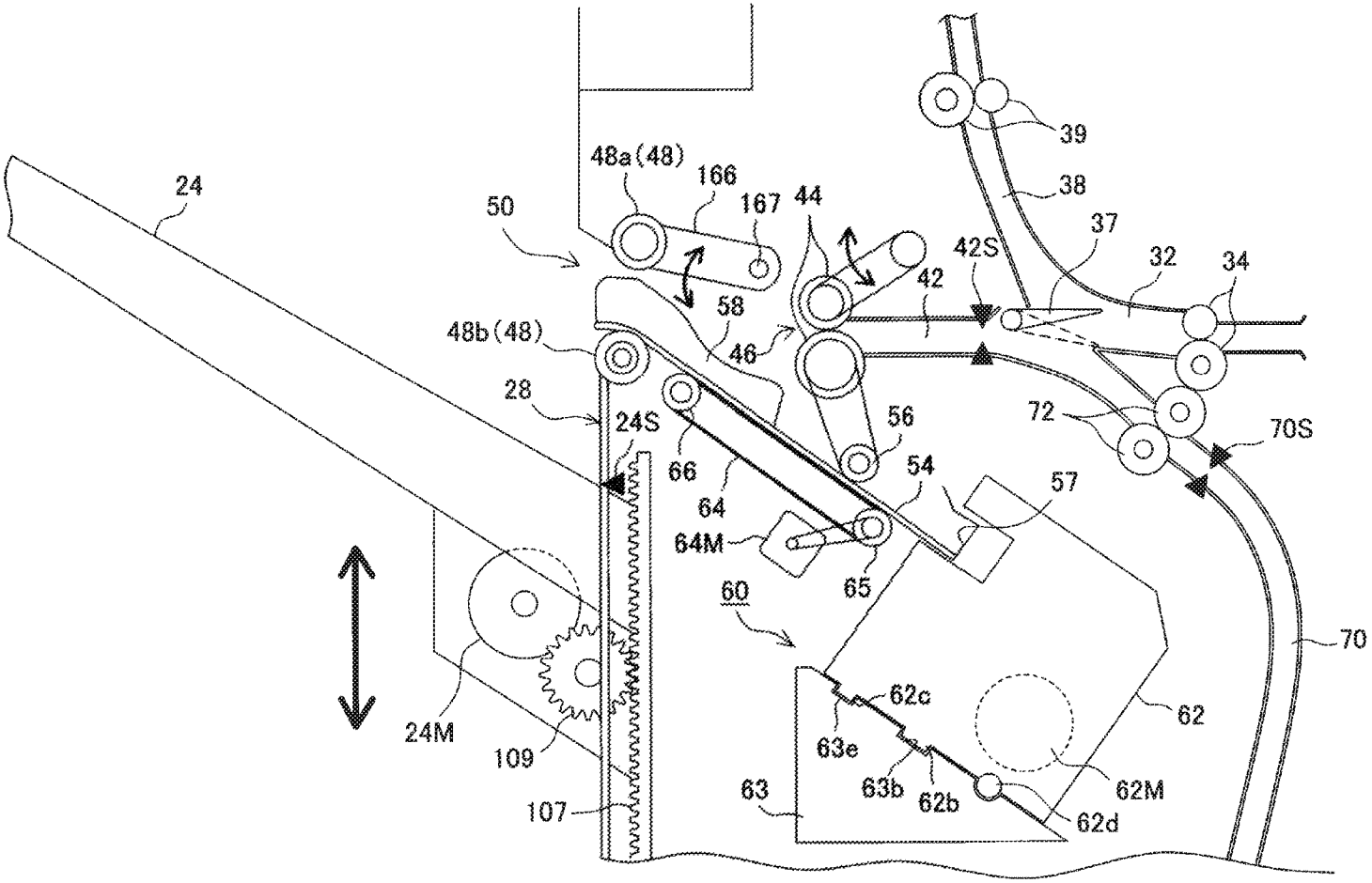
FIG. 3 is an enlarged side explanatory diagram near a processing tray (placing tray) of the sheet processing apparatus.

As shown in FIGS. 2 and 3, the branch path 70 is a path curved downward to surround the placing tray 54 beside the placing tray 54. As will be described later, the branch path 70 also serves as a standby path in which a subsequent sheet or sheets is/are kept on standby as a standby sheet or sheets. Escape rollers 39 for conveying a sheet and escape discharge rollers 40 for discharging the sheet to the escape tray 22 are arranged on the escape path 38.

[End Binding Part]

The placing tray 54 is arranged below the conveyance path outlet 46 of the conveyance path 42. An end binding part 60 for binding the ends of sheets temporarily stacked on the placing tray 54 is located on the lower end of the placing tray 54. The end binding part 60 will be described later with reference to FIGS. 3 and 5.

[Saddle Stitching Part]

A relatively long sheet is once conveyed through the conveyance path 42 toward the placing tray 54 and to the downstream side of the switch gate 37. The relatively long sheet is then switchback-conveyed to the branch path 70, and stacked in the stacker 84 (second processing tray) via a branch outlet 76. There is arranged a saddle stitching part 80 which binds the midsection of sheets stacked in the stacker 84. As shown in FIG. 2, a change flapper 78 is arranged at the branch outlet 76. The change flapper 78 biases the sheets to the left in the diagram each time a sheet is carried in to the stacker 84 from branch discharge rollers 74. The change flapper 78 thereby prevents collision between the trailing edges of the preceding sheets and the leading edge of the next sheet.

[Stacker (Second Processing Tray)]

A stopper 85 for defining the carry-in position of the sheets is located on the stacker 84. A moving belt 88 stretched across an upper pulley 86 and a lower pulley 87 beside the stacker 84 is driven by a stopper moving motor 85M, whereby the stopper 85 is moved in the direction of the arrow in the diagram. The stopper 85 is stopped at each of the following positions: a position in which the trailing edges of the sheets can be changed by the change flapper 78 when a sheet is carried in to the stacker 84; a position in which a saddle stitching unit 82 performs saddle stitching on substantially the center of the sheets in the conveyance direction; and a position in which a reciprocating folding blade 94 presses the saddle-stitched position into between a pair of folding rollers 92 to fold the bundle of sheets in two. Saddle stitch alignment plates 81 are arranged above and below the folding rollers 92. The saddle stitch alignment plates 81 perform an alignment operation by pressing both side edges of the sheets in a sheet width direction each time a sheet is carried in to the stacker 84.

[Saddle Stitching Unit]

The saddle stitching part 80 includes an anvil 83. For example, when a staple is driven into a bundle of sheets by a driver in the saddle stitching unit 82, the anvil 83 arranged in the opposite position bends the legs of the staple. Since the saddle stitching unit 82 is already widely known, a description thereof will be omitted. The binding means is not limited to only the mechanism of driving a staple through a sheet bundle. A mechanism of applying an adhesive to the midsections of the sheets in the conveyance direction and bonding the sheets into a bundle may be used.

[Second Stacking Tray]

The sheet bundle bound by the saddle stitching unit 82 is folded in two by the folding rollers 92 and the folding blade 94 which presses the sheet bundle into between the folding rollers 92. The sheet bundle, as being folded in two, is discharged to the second stacking tray 26 by the folding rollers 92 and bundle discharge rollers 96 located downstream. A pressing roller 102 and a pressing lever 104 are attached to the second stacking tray 26. The pressing roller 102 is a freely-rotatable roller swingably attached to where the folded sheet bundle is dropped in to the second stacking tray 26 with the folded back side first. The pressing lever 104 presses stacked folded sheet bundles from above to keep them from spreading out. The pressing roller 102 and the pressing lever 104 prevent the folded sheet bundles to spread out with a drop in stackability.

[Branch Position and End Binding Part]

Referring to FIG. 3, the branch position 36 and the end binding part 60 will be described further. FIG. 3 shows the carry-in path 32, the conveyance path 42, the escape path 38, and the branch path 70. As has been described, the carry-in path 32 extends from the carry-in port 30, and the carry-in rollers 34 are arranged thereon. The conveyance path 42 extends straight from the carry-in path 32 toward the placing tray 54. The escape path 38 extends upward in the diagram from the conveyance path 42. The branch path 70 curves downward and guides a sheet to the stacker 84. The switch gate 37 is arranged in the branch position 36. The switch gate 37 is selectively positioned to guide the sheet from the carry-in path 32 to the escape path 38 or the conveyance path 42, or the sheet switchback-conveyed from the conveyance path 42 to the branch path 70.

Figure 4:
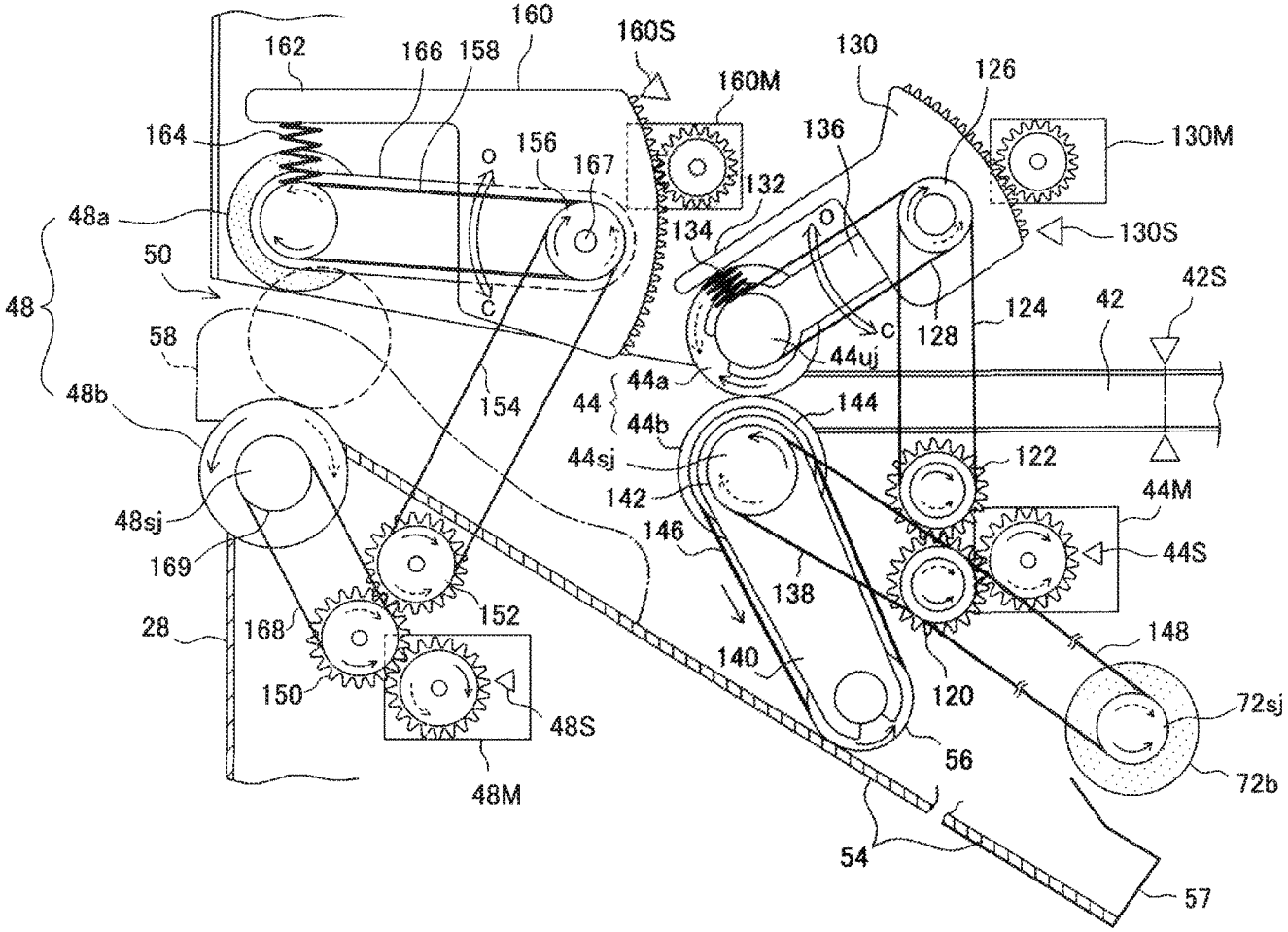
FIG. 4 is a driving explanatory diagram showing conveyance rollers, a branch roller, and discharge rollers.

In the present embodiment, for example, as shown in FIG. 3, the switch gate 37 in the solid-lined position blocks the escape path 38 to guide the sheet from the carry-in path 32 to the conveyance path 42 (in FIG. 4, a path defined by a conveyance upper guide 42*ug* and a conveyance lower guide 42*sg*). The switch gate 37 in the broken-lined position guides the sheet from the carry-in path 32 to the escape path 38, and the sheet switchback-conveyed from the conveyance path 42 to the branch path 70.

The conveyance rollers 44 are arranged on the foregoing conveyance path 42, immediately before the conveyance path outlet 46 which is the final end. The conveyance rollers 44 rotate forward and backward, and come into contact with and separate from each other. Specifically, the conveyance rollers 44 in a pressure contact state can rotate in one direction to convey a sheet toward the placing tray 54, and rotate in the other direction to switchback-convey the sheet.

[On Switchback Conveyance]

The switchback conveyance is performed by rotating the conveyance rollers 44 in the other direction after a sheet sensor 42S arranged on the conveyance path 42 immediately after the switch gate 37 detects passage of the trailing edge of the sheet. During the rotation in the other direction, the switch gate 37 is moved to the position where the carry-in path 32 is blocked (broken-lined position in FIG. 3), whereby the sheet is conveyed to the branch path 70 and successively conveyed by the branch rollers 72. If the trailing edge of the sheet reaches a predetermined position, the branch rollers 72 are stopped, and the sheet is kept on standby in the branch path 70.

The discharge rollers 48 are arranged at the placing tray outlet 50 (outlet of the placing tray 54) on the downstream side of the conveyance rollers 44. The discharge rollers 48 rotate forward and backward, and come into contact with and separate from each other. The discharge rollers 48 include a discharge upper roller 48*a* and a discharge lower roller 48*b*. The discharge upper and lower rollers 48*a* and 48*b* in a pressure contact state rotate in one direction to convey a sheet to the first stacking tray 24 in cooperation with the foregoing conveyance rollers 44. The discharge rollers 48 are also used when discharging a bundle of sheets stacked on the placing tray 54 in cooperation with a reference surface 57 which is a moving member for pressing the bundle of sheets to the first stacking tray 24.

[Carry-in to Placing Tray 54]

Carrying-in of a sheet to the placing tray 54 will be described. To carry in a sheet to the placing tray 54, the sheet released from the conveyance rollers 44 is conveyed to the right in FIG. 3 over the slope of the placing tray 54 by rotating the discharge rollers 48 located downstream in the other direction. A raking roller 56 is rotated counterclockwise in the diagram to transport the conveyed sheet. By the transportation, the leading edge of the sheet in the conveyance direction is abutted against and stopped at the reference surface 57 serving as a reference for end binding. Here, the raking roller 56 slides over the sheet to prevent the leading edge of the sheet from buckling after abutted against the reference surface. In such a manner, the discharge rollers 48 have the function of switchback conveying and sending the sheet discharged from the conveyance rollers 44 to the reference surface 57 of the placing tray 54.

[Movement and Binding Processing of End Binding Unit]

Each time a sheet is released from the conveyance rollers 44, the discharge rollers 48 and the raking roller rotate to send the sheet to the reference surface 57 to stack sheets on the placing tray 54. Synchronously with the stacking operation, the alignment plates 58 are brought into contact with the sheets from both sides in the sheet width direction, whereby the sheets are aligned to the center of the placing tray 54 in the width direction. Such stacking and alignment are repeated until a specified number of sheets are bundled. If the specified number of sheets are stacked, an end binding unit 62 is moved to a desired binding position. Here, the end binding unit 62 moves over a moving platform 63 in the sheet width direction along the ends of the sheets. Such a movement is made by engaging and guiding a moving pin 62*b* of the end binding unit 62 with the shown groove rail arranged in the moving platform 63 in the sheet width direction.

Since the binding processing of the end binding unit 62 performing the first processing of the present invention is already known, a description thereof will be omitted. If the end binding unit 62 stops at a specified binding position, an end binding motor 62M is driven to rotate. The end binding motor 62M moves a not-shown driver to drive a staple into the bundle of sheet, and the driven staple is bent by an anvil for stapling processing. Such binding processing is performed in a plurality of positions over the ends of the corners of the sheets and the end in the width direction.

[Discharge of End-Bound Sheets]

A reference surface moving belt 64 stretched across a right pulley 65 and a left pulley 66 under the placing tray 54 moves counterclockwise in the diagram, whereby the reference surface 57 connected to the reference surface moving belt 64 moves to the left in the diagram. The reference surface 57, functioning as a moving member, pushes the bound end side of the sheet bundle bound by the end binding unit 62 toward the first stacking tray 24. Along with the pushing, the discharge rollers 48 arranged at the outlet of the placing tray 54 press the bound sheet bundle from the front and back, and rotate clockwise and counterclockwise, respectively, to discharge the bound sheet bundle to the first stacking tray 24.

[Lifting of First Stacking Tray]

The first stacking tray 24 on which sheet bundles are stacked will be described. As shown in FIG. 3, the first stacking tray 24 is arranged at substantially the same sloping angle as that of the placing tray 54. Bound sheet bundles discharged from the placing tray 54 as well as single sheets discharged from the conveyance path 42 by the conveyance rollers 44 and the discharge rollers 48 are stacked on the first stacking tray 24.

A lifting motor 24M for lifting the first stacking tray 24 up and down is arranged on the bottom side of the first stacking tray 24. The driving of the lifting motor 24M is transmitted to a lifting pinion 109. The lifting pinion 109 is engaged with lifting racks 107 which are vertically fixed to and arranged on both sides of an erected surface 28 of the apparatus frame 20. Although not shown in particular, a lifting rail arranged on the erected surface 28 vertically guides the first stacking tray 24.

A sheet surface sensor 24S arranged on the erected surface 28 detects the position of the first stacking tray 24 or the position of the sheets stacked on the first stacking tray 24. If the sheet surface sensor 24S detects the position, the lifting motor 24M is driven to rotate the lifting pinion 109 to descend. FIG. 3 shows a state in which the sheet surface sensor 24S detects the top surface of the first stacking tray 24. The first stacking tray 24 is somewhat lowered to accept a sheet bundle. The top surface of the outlet position from the placing tray 54 and the top surface of the first stacking tray 24 are thus positioned with a difference in height.

Next, the rotational driving and the contact and separation of the conveyance rollers 44 and the discharge rollers 48 will be described with reference to FIG. 4.

[Rotational Driving of Conveyance Upper Rollers]

The conveyance rollers 44 including conveyance upper rollers 44*a* and conveyance lower rollers 44*b* are driven by a conveyance roller motor 44M. The conveyance roller motor 44M includes a hybrid stepping motor, on which a speed detection sensor 44S for detecting the rotation speed of the motor shaft is arranged. The driving of the conveyance roller motor 44M is transmitted to an arm gear 126 via transmission gears 120 and 122 and a transmission belt 124. The driving from the arm gear 126 is transmitted by a transmission belt 128 to an upper roller shaft 44*uj* of the conveyance upper rollers 44*a* which are supported by a conveyance roller support arm 136.

[Contact and Separation of Conveyance Upper Rollers]

The conveyance upper rollers 44*a* are attached to move around the shaft of the arm gear 126 to come into contact with and separate from the conveyance lower rollers 44*b* which are fixed in position. The contact and separation is effected by a conveyance roller moving arm 130 which includes a rear sector gear attached to the shaft of the arm gear 126. A spring 134 for biasing the conveyance upper rollers 44*a* is attached to the moving arm tip at the end. More specifically, a conveyance roller moving arm motor 130M engaged with the foregoing rear sector gear is driven to rotate forward and backward. Rotations in one direction move the conveyance upper rollers 44*a* in a releasing direction of the arrow O. Rotations in the other direction move the conveyance upper rollers 44*a* in a pressure contact direction of the arrow C in which the conveyance upper rollers 44*a* come into pressure contact with the conveyance lower rollers 44*b*. The conveyance roller moving arm motor 130M also includes a stepping motor. The position of the conveyance roller moving arm 130 is detected by a conveyance roller moving arm sensor 130S.

[Rotational Driving of Conveyance Lower Roller Etc.]

The conveyance lower rollers 44*b* are driven to rotate by transmitting the driving of the conveyance roller motor 44M to a reception gear 142, which is fixed to a conveyance lower roller shaft 44*sj*, via the transmission gear 120 and a transmission belt 138.

The driving of the reception gar 142 rotates the raking roller 56 via a one-way clutch gear 144 and a belt with projections 146 which also serves as a transmission belt. Since the raking roller 56 is driven via the one-way clutch gear 144, the raking roller 56 rotates only in the direction of the full-lined arrow in FIG. 4 even if the reception gear 142 rotates forward and backward as has been described. The raking roller 56 rotates to move a sheet only toward the reference surface 57 of the placing tray 54. While the foregoing belt with projections 146 is described to rotate the raking roller 56 at the end, the raking roller 56 may be omitted and only a circular raking belt may be rotated.

The driving of the conveyance roller motor 44M is also transmitted via the transmission gear 120 and a transmission belt 148 to a branch lower roller shaft 72*sj* of a branch lower roller 72*b* of the branch rollers 72 which convey a sheet in the branch path 70.

With the foregoing configuration, as the conveyance roller motor 44M rotates forward and backward, the conveyance rollers 44 and the branch rollers 72 rotate in one direction, or the directions of the solid-lined arrows, and in the other direction (switchback direction), or the directions of the broken-lined arrows. The raking roller 56 rotates in the direction toward the reference surface 57, or the direction of the solid-lined arrow. The conveyance roller motor 44M can be set to convey a sheet at a predetermined speed when the sheet is conveyed toward the placing tray 54 or switchback-conveyed toward the branch path 70.

[Rotational Driving of Discharge Upper Roller]

The discharge rollers 48 including the discharge upper roller 48*a* and the discharge lower roller 48*b* are driven by a discharge roller motor 48M. The discharge roller motor 48M also includes a hybrid stepping motor. A speed detection sensor 48S for detecting the rotation speed of the motor shaft is similarly arranged. The driving of the discharge roller motor 48M is transmitted to an arm gear 156 via transmission gears 150 and 152 and a transmission belt 154. A transmission belt 158 transmits the driving of the arm gear 156 to a discharge upper roller shaft 48*uj* of the discharge upper roller 48*a* supported by a discharge roller support arm 166.

[Contact, Separation, Etc. Of Discharge Upper Roller]

The discharge upper roller 48*a* is attached to move around the shaft of the arm gear 156 to come into contact with and separate from the discharge lower roller 48*b* which is fixed in position. The contact and separation is effected by a discharge roller moving arm 160 which includes a rear sector gear attached to the shaft of the arm gear 156. A spring 164 for biasing the discharge arm roller 48*a* is attached to the moving arm tip at the end. A discharge roller moving arm motor 160M engaged with the foregoing rear sector gear is driven to rotate forward and backward. Rotations in one direction move the discharge upper roller 48*a* in a releasing direction of the arrow O. Rotations in the other direction move the discharge upper roller 48*a* in a pressure contact direction of the arrow C in which the discharge upper roller 48*a* comes into pressure contact with the discharge lower roller 48*b*. The discharge roller moving arm motor 160M also includes a stepping motor. The position of the discharge roller moving arm 160 is detected by a discharge roller moving arm sensor 160S.

The discharge lower roller 48*b* is driven to rotate by transmitting the driving of the discharge roller motor 48M to a reception gear 169, which is fixed to a discharge lower roller shaft 48*sj*, via the transmission gear 150 and a transfer belt 168.

[Speed Setting of Discharge Roller Motor]

With the foregoing configuration, as the discharge roller motor 48M rotates forward and backward, the discharge rollers 48 rotate in one direction, or the directions of the solid-lined arrows in the diagram, and in the other direction, or the directions of the broken-lined arrows in the diagram (the switchback direction on the placing tray 54 toward the reference surface 57 after a sheet is released from the conveyance rollers 44). The speed setting of the discharge roller motor 48M can be changed so that the discharge rollers 48 are driven at a predetermined speed.

In the present embodiment, when the conveyance rollers 44 are conveying a sheet like during switchback conveyance for standby conveyance, the discharge upper roller 48*a* is located in a separated position off the discharge lower roller 48*b* since the separate driving motors are difficult to operate in a linked manner.

[Standby Conveyance and Second Tray Conveyance]

Returning to FIG. 3, standby conveyance in which a sheet is switchback-conveyed to the branch path 70 for standby for the purpose of the foregoing end binding will be described. If the end binding unit 62 of the placing tray 54 performs the binding processing, the next sheet needs to be prevented from being carried in before the completion of the end binding processing on the preceding sheet bundle. The reason is that the carry-in speed of a sheet image-formed by the image forming apparatus A is high and the sheet intervals are short. The first sheet or up to the second sheet conveyed to the conveyance path 42 through the carry-in path 32 is/are then once switchback-conveyed on the conveyance path 42, and the switchback-conveyed sheet(s) is/are kept on standby in the branch path 70. The sheet(s) kept on standby in the branch path 70 is/are then sent out to overlap with the subsequent second or third sheet, whereby an interval time between sheet bundles is ensured (such an operation is disclosed, for example, in FIG. 10 of Japanese Patent No. 5248785).

As employed herein, switchback conveying one or more sheets from the conveyance path 42 to the branch path 70, keeping the sheet(s) on standby in the branch path 70, and sending out the sheet(s) on standby with the next sheet will be referred to as "standby conveyance". Sheets having a relatively small length in the conveyance direction, such as A4, B5, and letter-size sheets, are often end-bound by standby conveyance. Such sheets are switchback-conveyed for standby conveyance without much protruding downstream from the placing tray 54. The sheets are less likely to skew during the conveyance. Since the distance to the placing tray 54 is relatively small, the sheets, if somewhat skewed, can be corrected by the alignment operation of the alignment plates 58.

The completion of the end binding processing includes not only the completion of the discharge operation of the sheet bundle from the placing tray 54 to the first stacking tray 24, but also an initial setting operation of the alignment plates 58 on the placing tray 54, recovery of the reference surface moving belt 64 to its initial position, and/or setting of initial positions of various mechanisms for accepting the next sheet.

Next, a case of performing saddle stitching by the saddle stitching unit 82 and conveying the sheets to the stacker 84, or second processing tray, to fold the sheets into a folded sheet bundle by the folding rollers 92 and the folding blade 94 will be described. For conveyance to the stacker 84, a sheet conveyed through the carry-in path 32 to the conveyance path 42 is once switchback-conveyed on the conveyance path 42. The switchback-conveyed sheet is then conveyed from the branch path 70 to the stacker 84. As employed herein, conveying the switchback-conveyed sheet to the stacker 84 via the branch path 70 will be referred to as "second tray conveyance".

[Switchback Conveyance]

Suppose that a sheet is "standby-conveyed" by the conveyance rollers 44. In the present embodiment, if the trailing edge of the sheet is detected by the sheet sensor 42S arranged at the branch position between the conveyance path 42 and the branch path 70, the sheet is switchback-conveyed to the branch path 70 and nipped by the branch rollers 72 located in the branch path 70. The rotation of the branch rollers 72 is then stopped. In the case of performing "second tray conveyance" in which sheets are stacked in the stacker 84 located on the downstream side of the branch path 70 for saddle stitch processing, the sheet switchback-conveyed by the conveyance rollers 44 is similarly sent to the branch rollers 72 of the branch path 70 and to the stacker 84 without being stopped.

The discharge rollers 48 can rotate forward and backward. If the trailing edge of a subsequent sheet (s) conveyed by the conveyance rollers 44 (a sheet kept on standby in the branch path 70, a sheet from the carry-in path, or a stack of such sheets) is released from the conveyance rollers 44, the discharge rollers 48 nip the sheet(s). The discharge rollers 48 then rotate backward to switchback-convey and store the subsequent sheet(s) into the placing tray 54.

[Discharge of Sheet Bundle]

As described above, the discharge rollers 48 are configured so that the discharge upper roller 48*a* is swingable. The discharge upper roller 48*a* descends to the pressure contact position in which to come into pressure contact with the discharge lower roller 48*b* (the broken-line position in FIG. 4), and ascends to the separated position above the discharge lower roller 48*b* (the solid-lined position in FIG. 4). After the sheet processing of a sheet bundle on the placing tray 54, to discharge the sheet bundle to the first stacking tray 24, the reference surface 57 is initially moved toward the placing tray outlet 50 and pushed up by the reference surface moving belt 64. The discharge upper roller 48*a* subsequently descends to the pressure contact position, nips the sheet bundle with the discharge lower roller 48*b*, transports the sheet bundle toward the placing tray outlet 50, and discharges the bundle to the first stacking tray 24.

[Sheet Processing Unit]

The discharge rollers 48 discharge a sheet bundle processed by the sheet processing unit of the placing tray. The sheet processing according to the present embodiment includes binding processing and so-called jog processing. In the binding processing, the sheet bundle is bound by the end binding unit 62. The jog processing refers to sorting unbound sheet bundles on the first stacking tray 24 by changing the positions of the sheet bundles on the placing tray 54 by the alignment plates 58 and discharging the sheet bundles. The sheet processing may include other processing, such as lamination by gluing and punching processing for making holes in the sheets.

[Movement of End Binding Unit]

Figure 5:
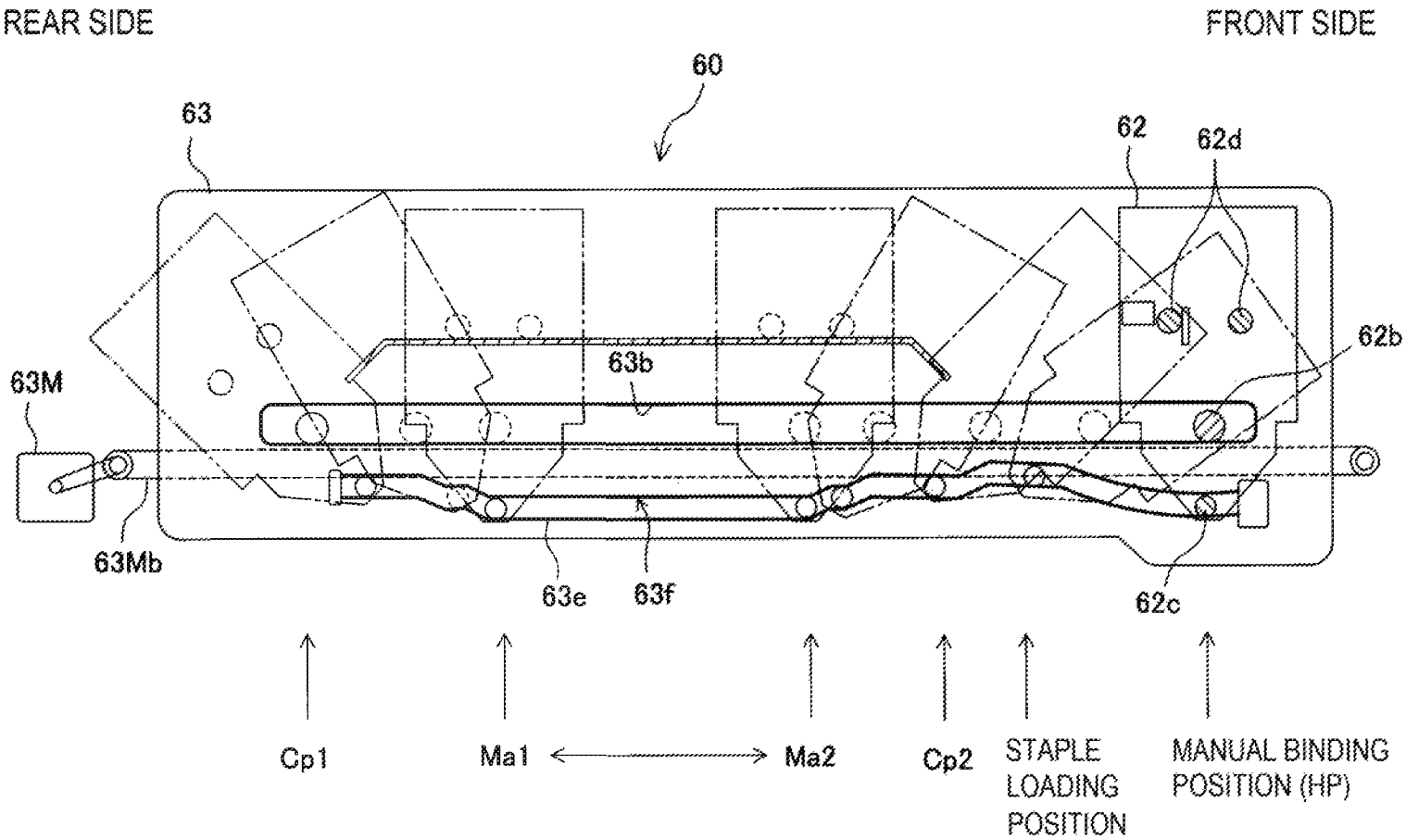
FIG. 5 is an explanatory diagram showing a configuration for moving a binding unit arranged on a reference surface side of the placing tray of FIG. 3 in a sheet width direction.

The end binding unit 62 for stapling a sheet bundle has been described as the sheet processing unit of the invention. A movement of the end binding unit 62 in the width direction of the sheet bundle will be described with reference to FIG. 5. FIG. 5 shows that the end binding unit 62 for stapling a sheet bundle moves over the moving platform 63. The moving platform 63 is arranged on the apparatus frame 20 of the sheet processing apparatus B with a front side up and a rear side down in FIG. 5. Referring also to FIG. 3, a substantially-straight moving groove 63*b* for guiding the moving pin 62*b* protruding from the end binding unit 62 side is formed in the moving platform 63. A guide pin 62*c* arranged on the tip side of the end binding unit 62 is engaged with an orientation guide 63*e* arranged on the moving platform 63.

The end binding unit 62 is coupled with a moving platform belt 63Mb which is moved by a unit moving motor 63M. Moving positions of the end binding unit 62 include a corner binding position Cp1 on the rear side, a multiple binding range Ma1 to Ma2 on the center side, and a corner binding position Cp2 on the front side. The end binding unit 62 is also controlled to be positioned in a staple loading position and a home position HP. In the staple loading position, the rear part of the end binding unit 62 is directed to outside the apparatus at the front side. The home position HP is the position of the end binding unit 62 before a start of binding. The home position HP also serves as a manual binding position on the front side. The apparatus of the present embodiment thus includes, as a sheet processing unit, the end binding unit 62 which performs binding processing on arbitrary positions of the sheet bundle placed on the placing tray 54. The sheet processing unit includes the alignment plates 58 which are paired in a sheet width direction. The alignment plates 58 align sheets each time a sheet is carried in to the placing tray 54.

[Alignment Plates]

Figure 6:
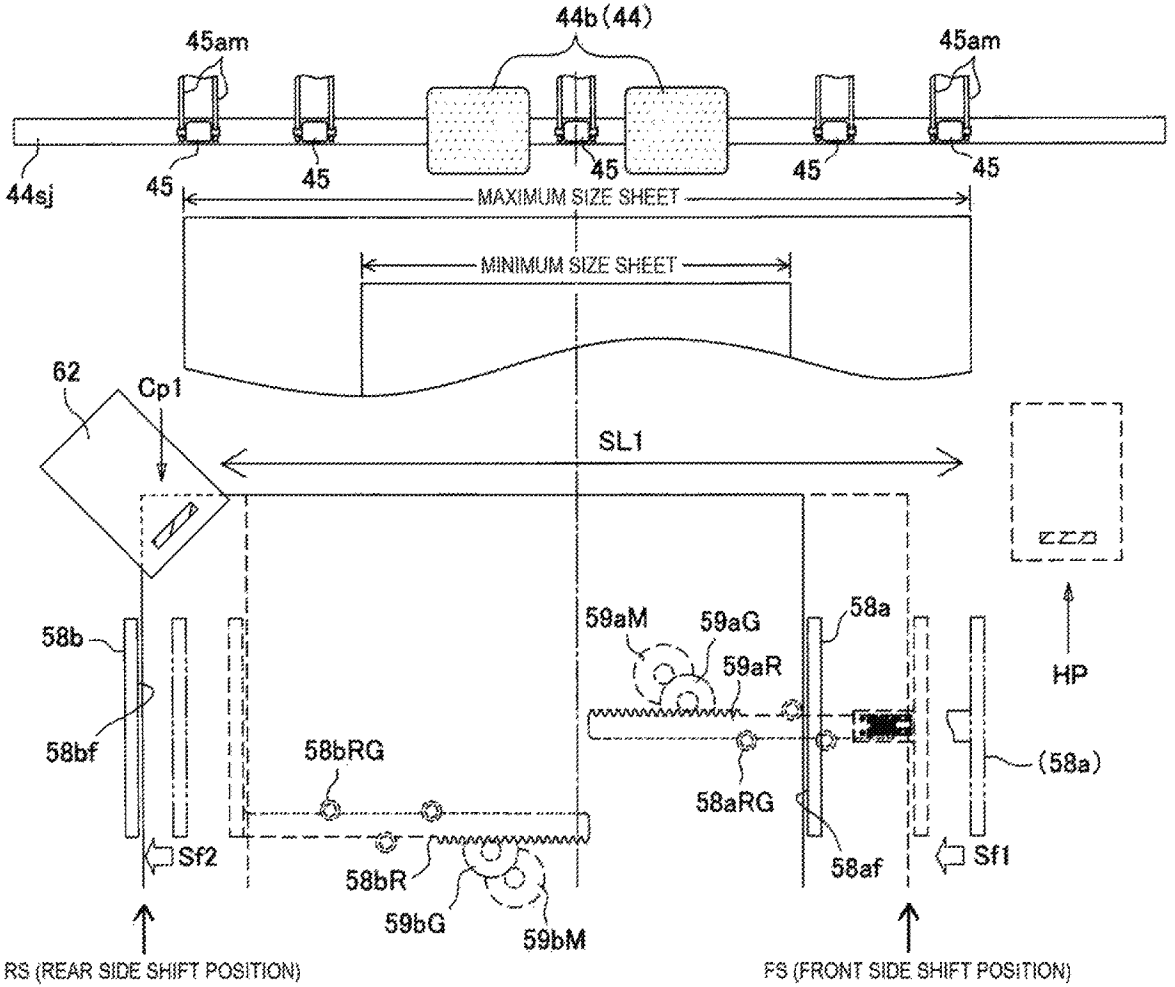
FIG. 6 is an explanatory diagram showing a configuration for moving alignment members (alignment plates) that are arranged on the placing tray of FIG. 3 and move in the sheet width direction.

Next, the alignment plates 58 which come into contact with the side edges of sheets to align the sheets or change the placing position of the sheets each time a sheet is carried in to the placing tray 54 will be described with reference to FIG. 6. FIG. 6 is a top view of the placing tray 54. The alignment plates 58 include a front alignment plate 58*a* on the front side and a rear alignment plate 58*b* on the rear side. The front alignment plate 58*a* and the rear alignment plate 58*b* include a front alignment surface 58*af* and a rear alignment surface 58*bf*, respectively, which come into contact with and separate from the side edges of sheets. The contact and separation with/from the side edges of the sheets are effected by moving a front alignment plate rack 59*a*R by a front alignment motor 59*a*M via a gear 59*a*G. The front alignment plate rack 59*a*R is arranged on the bottom of the front alignment plate 58*a* and guided by front rack guides 58*a*RG. The contact and separation are also effected by moving a rear alignment plate rack 58*b*R by a rear alignment motor 59*b*M via a gear 59*b*G. The rear alignment plate rack 58*b*R is arranged on the bottom of the rear alignment plate 58*b* and guided by rear rack guides 58*b*RG.

For multiple binding, the front alignment plate 58*a* and the rear alignment plate 58*b* can align the sheets with reference to the sheet center. For corner binding, like FIG. 6, the front alignment plate 58*a* and the rear alignment plate 58*b* can align the sheets with reference to one side. In such a manner, the reference of alignment of the front and rear alignment plates 58*a* and 58*b* can be changed. Serving as a sheet processing unit, the front and rear alignment plates 58*a* and 58*b* can perform so-called jog processing for sorting sheet bundles by aligning each sheet bundle placed on the placing tray 54 to either one side and discharging the same to the first stacking tray.

[ Sort Processing (Second Processing)]

To perform the sort processing which is the second processing according to the present invention, for example, maximum sheets shown in FIG. 6 are carried in to the placing tray 54. The front alignment plate 58*a* which is located outside in the sheet width direction is moved by Sf1 in the diagram. The sheets are thereby moved by Sf2 on the rear side. The side edges of the sheets come into contact with the rear alignment plate 58*b* which is retracted in advance, whereby the sheets are positioned on the placing tray 54 as aligned to the rear side. On the other hand, if the rear alignment plate 58*b* is moved to the front side, the sheets are positions as aligned to the front side. Sheets can be sorted in such a manner.

Figure 8A:
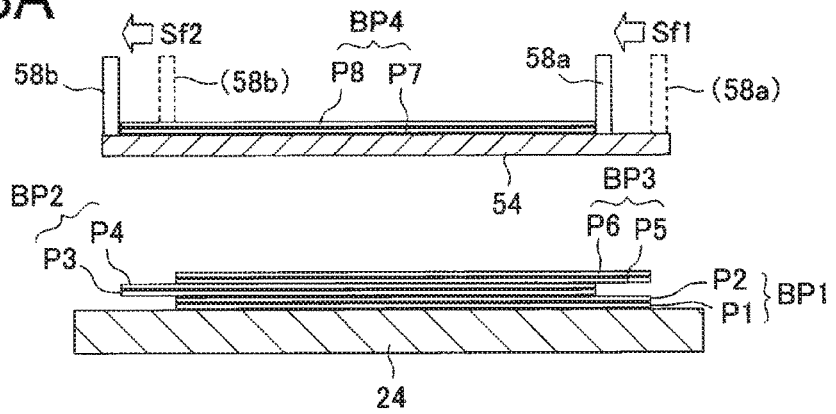
FIGS. 8A to 8C are explanatory diagrams showing sheets placed and shifted on the placing tray by a shift of the alignment plates of the placing tray shown in FIG. 6, and sheets discharged from the placing tray and stacked on a stacking tray.
Figure 8B:
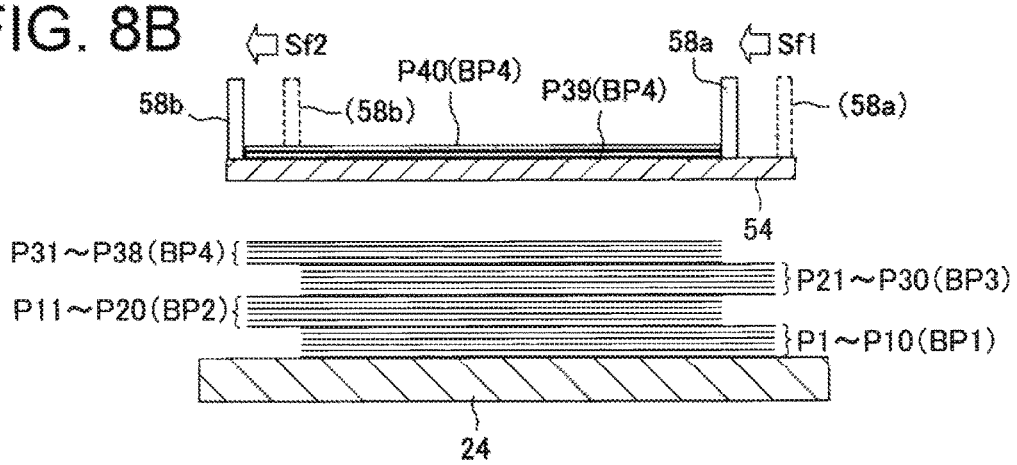
Figure 8C:
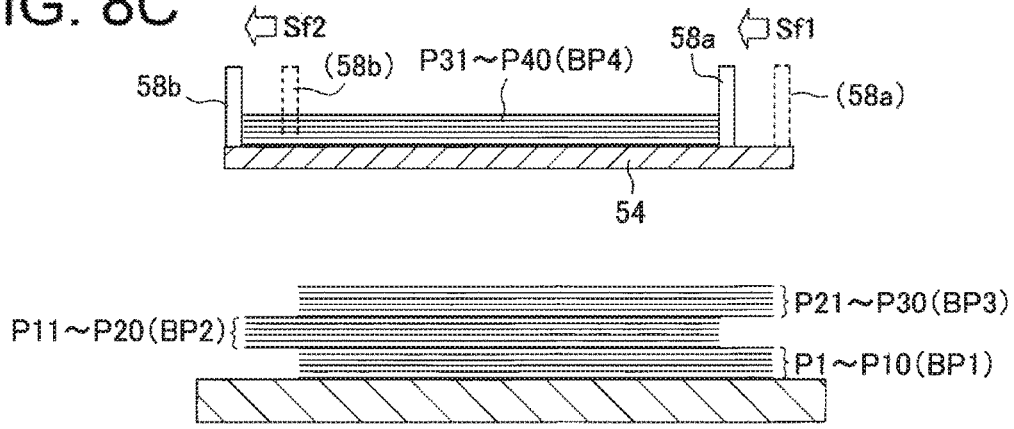

The sort processing will be further described with reference to FIGS. 8A to 8C. FIGS. 8A to 8C are diagrams for describing sheets that are placed on the placing tray 54 and shifted by a shift movement of the alignment plates 58 of FIG. 6 and the sheets that are then discharged from the placing tray 54 and stacked on the first stacking tray 24. In the following diagrams, a reference symbol BP followed by a numeral represents a sheet bundle. For example, BP2 represents the second sheet bundle. A reference symbol P followed by a numeral in a bundle indicates page number from the beginning. For example, P4 represents the fourth page (fourth sheet) from the beginning.

FIG. 8A is a diagram in which four two-sheet bundles are formed. Here, three bundles of sheets shifted by the placing tray 54 and discharged to the first stacking trays 24 in twos are already stacked. If the fourth sheet bundle is placed on the placing tray 54, the front alignment plate 58*a* is shifted by Sf1 to the rear side, and the sheet bundle is shifted by Sf2 into contact with the rear alignment plate 58*b* which is shifted in advance. The resulting sheet bundle is discharged to the first stacking tray 24 by the discharging rollers 48, whereby four sorted sheet bundles can be sorted (jogged) and stacked on the first stacking tray 24.

In FIG. 8B, four ten-sheet bundles are formed by shifting and discharging sheets in twos. Like FIG. 8A, sheets are sorted and shifted in twos on the placing tray 54 by the alignment plates 58, and then discharged as a bundle from the placing tray 54 to the first stacking tray 24 by the discharge rollers 48. In such a manner, four ten-sheet bundles can be sorted (jogged) on the first stacking tray 24.

Unlike FIG. 8B in which sheets in a bundle are discharged in twos, FIG. 8C is an explanatory diagram in which four ten-sheet bundles are formed by discharging sheets in tens. In this case, as will be described later, standby sheets can be increased to perform slow discharge operations, as compared to the case of discharging standby sheets in twos.

[Sheet Stiffening Mechanism]

Return to FIG. 6. A sheet stiffening mechanism used in conveying a sheet or sheets to the placing tray 54 will be described with reference to FIGS. 7A and 7B. The sheet stiffening mechanism is intended to prevent a sheet bundle from curling up near the outlet of the placing tray 54 because of low stiffness of sheets when the sheets are carried in to the placing tray 54 from the conveyance path 42 by the conveying rollers 44 or when the leading edges of the sheets are passed between the discharge rollers 48 and the sheets are switchback-conveyed to the upstream side again.

FIG. 6 shows the conveyance lower rollers 44*b* of the conveyance rollers 44 and stiffening rollers 45 intended for stiffening. The stiffening rollers 45 are supported above the conveyance lower roller shaft 44*sj* by roller arms 45*am*. A sheet is conveyed from the conveyance path 42 to pass the stiffening rollers 45.

Figure 7A:
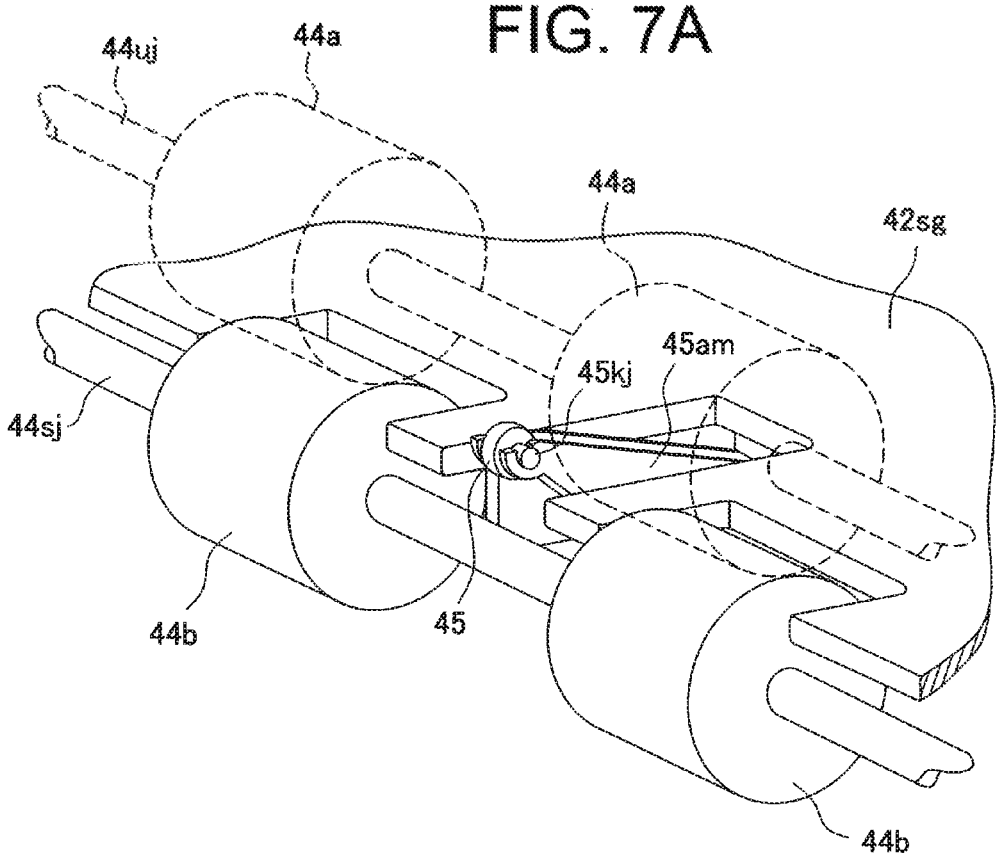
FIGS. 7A and 7B are explanatory diagrams showing a sheet stiffening mechanism in conveying a sheet or sheets to the placing tray.
Figure 7B:
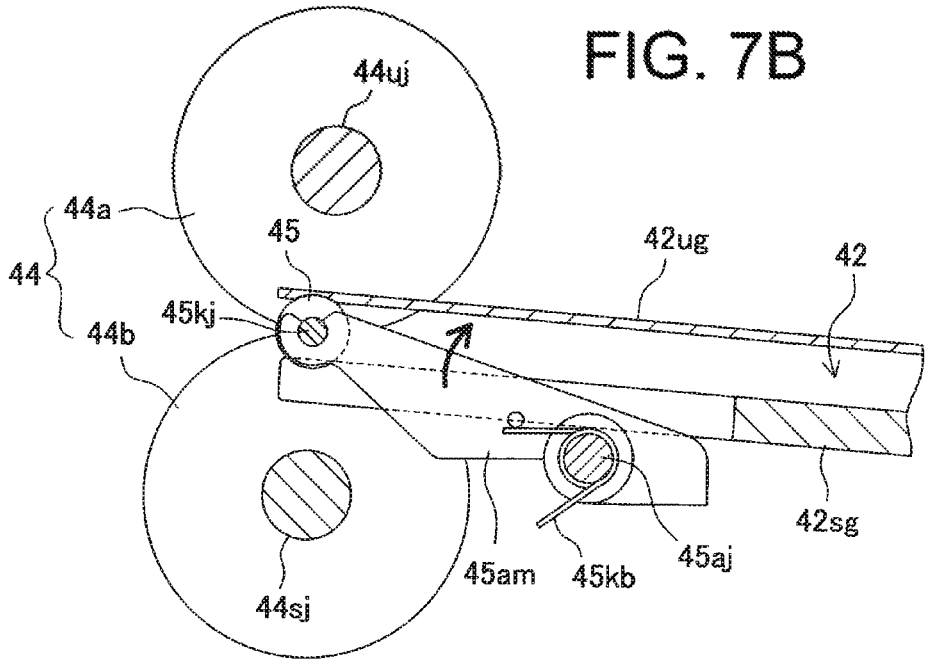

FIG. 7A is a perspective view of the sheet stiffening mechanism near the center in the sheet width direction. FIG. 7B is an explanatory sectional view of the sheet stiffening mechanism. As can be seen from FIGS. 7A and 7B, a bottom portion of a roller arm 45*am* is rotatably supported by an arm shaft 45*aj* axially between the respective pairs of conveyance upper and lower rollers 44*a* and 44*b* constituting the conveyance rollers 44. A rotatable stiffening roller 45 is attached to the end of the roller arm 45*am* by a roller shaft 45*kj*. The stiffening roller 45 rotates according to sheet conveyance, and is thus less likely to damage the surface of the conveyed sheet.

A coil spring 45*kb* is wound around the arm shaft 45*aj* at the bottom portion of the roller arm 45*a* supporting the stiffening roller 45. As shown in FIG. 7B, the stiffening roller 45 is thereby biased constantly (to an extent of stiffening the conveyed sheet) in the direction of the arrow. As shown in FIGS. 7A and 7B, the stiffening roller 45 is located somewhat on the side of the conveyance upper rollers 44*a* with respect to the pressure contact position between the conveyance upper rollers 44*a* and the conveyance lower rollers 44*b*. The conveyed sheet is thereby corrugated and stiffened in the sheet width direction crossing the conveyance direction. The winding of the coil spring 45*kb* can produce large corrugations for stiffening if a sheet bundle is thin and low in rigidity. If the sheets are thick and high in rigidity, small corrugations can be produced to stiffen the sheets but not too much as hinders conveyance.

[Confirmation by Number of Sheets Conveyed]

Figure 30A:
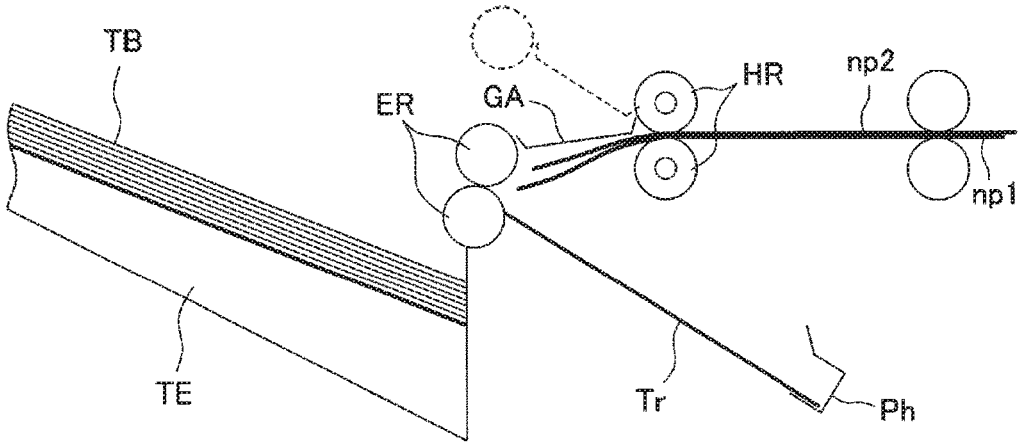
FIGS. 30A and 30B are explanatory diagrams showing the positions of conveyance rollers which switchback-convey subsequent sheets.
Figure 30B:
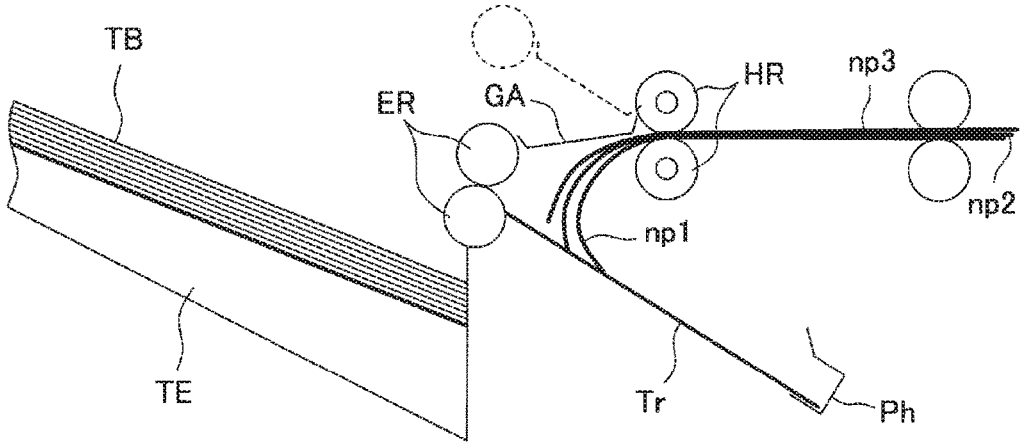

FIGS. 30A and 30B are diagrams showing an experiment on sheet conveyance by using the stiffening rollers 45. FIGS. 30A and 30B also show the positions of discharge rollers ER for switchback conveying sheets. The experiment was performed by changing the number of sheets of a sheet bundle conveyed by conveyance rollers HR. FIG. 30A is an explanatory diagram showing a conveyance state of two sheets. As shown in FIG. 30A, if two sheets (subsequent sheets np1 and np2) were conveyed by the conveyance rollers HR, the sheets were somewhat stiffened by the conveyance rollers HR. The sheets were guided downward by a guide GA between the conveyance rollers HR and the discharge rollers ER, and relatively smoothly conveyed to the conveyance rollers ER.

FIG. 30B is an explanatory diagram showing a state in which three sheets are conveyed by the conveyance rollers HR. When three sheets (subsequent sheets np1, np2, and np3) were conveyed by the conveyance rollers HR, the lowermost-layer sheet np1 of the sheets guided downward by the guide GA between the conveyance rollers HR and the discharge rollers ER, though somewhat stiffened by the conveyance rollers HR, is curled up to the side of a placing tray Tr. All the subsequent sheets curled up accordingly to cause a jam.

In such a manner, it has been confirmed that if the foregoing stiffening rollers 45 are used, one to two sheets can be conveyed without a problem, and three or more sheets often cause a jam. Such a confirmation result later explains what the present invention solves (in the foregoing description of sheet stiffening, the reference numerals of the conveyance rollers and the discharge rollers are different from those of the present embodiment, whereas the members are substantially the same).

Now, "simultaneous bundle discharge" and "advance bundle discharge" will be described. The "simultaneous bundle discharge" refers to an operation in which the discharge rollers 48 nip and transport a sheet kept on standby in the branch path 70 and a sheet from the conveyance path (hereinafter, such sheets will be referred to collectively as "subsequent sheets") together with a sheet bundle placed on the placing tray 54, discharge the sheet bundle to the foregoing first stacking tray 24, and switchback-convey the subsequent sheets to the placing tray 54. The "advance bundle discharge" refers to an operation in which the discharge rollers 48 nip and discharge the sheet bundle processed on the placing tray 54 to the first stacking tray 24 during switchback conveyance of the subsequent sheets, and then the subsequent sheets are carried in to the placing tray 54. The "simultaneous bundle discharge" of a two-sheet bundle with two subsequent sheets will be described with reference to the sheet conveyance diagrams of FIGS. 9A to 13A and the flowchart of FIG. 27. The "advance bundle discharge" of a two-sheet bundle with two subsequent sheets will be described with reference to the sheet conveyance diagrams of FIGS. 14A to 18B and the flowchart of FIG. 27.

Figure 27:
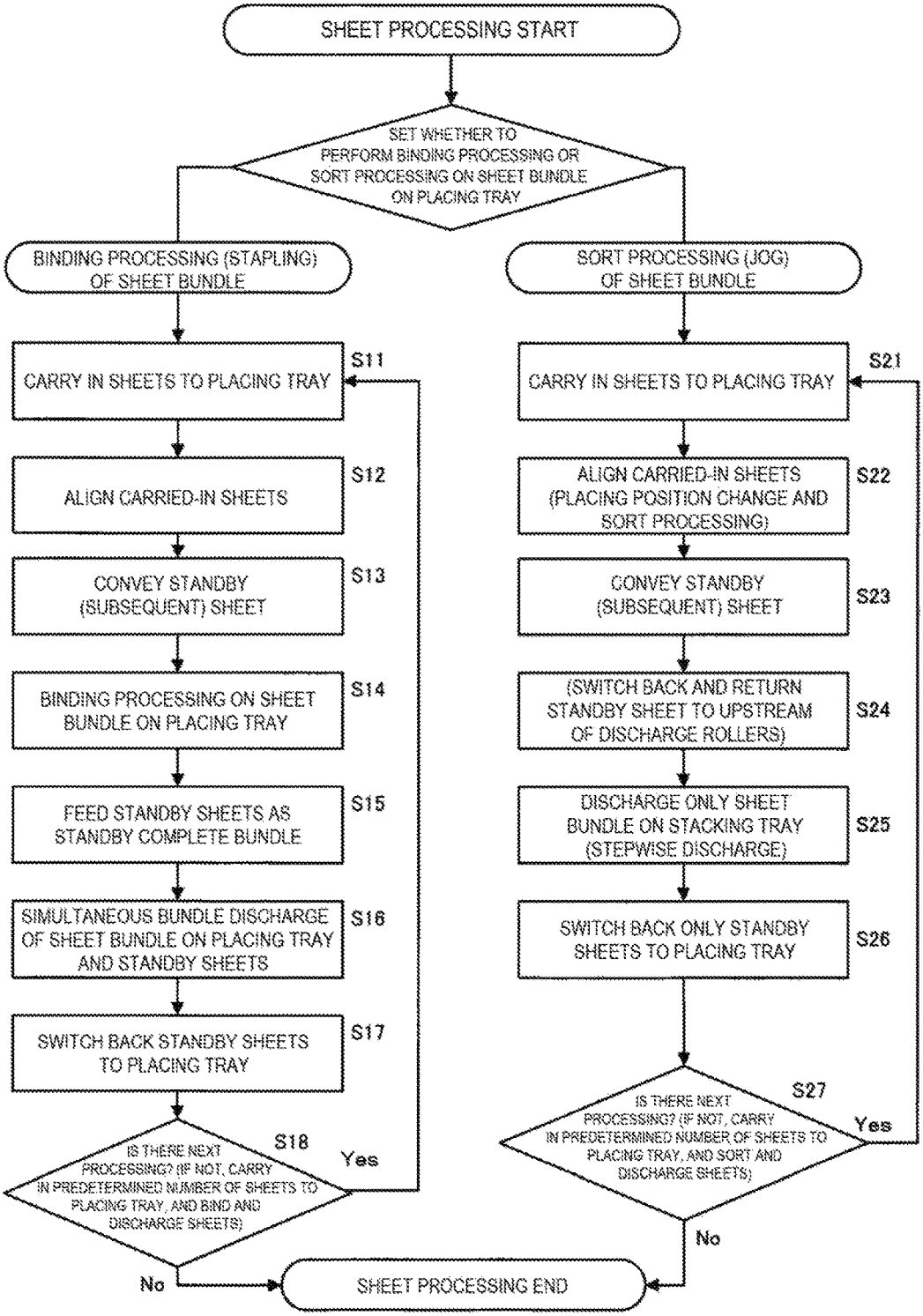
FIG. 27 is a flowchart showing both the simultaneous bundle discharge of FIGS. 9A to 13B and the advance bundle discharge of FIGS. 14A to 18B.

As shown in FIG. 27, in a determination step, whether the sheet processing on the placing tray 54 of the sheet processing apparatus is the binding processing which is the first processing using the end binding unit 62 or the sort (jog) processing which is the second processing using the alignment plates 58 is initially selected. The first processing and the second processing may be determined according to time needed for the processing. The first processing needs a longer processing time.

As has been described, the processing time of the binding processing which is the first processing is longer than that of the sort (jog) processing which is the second processing. Suppose that the stapling processing using the end binding unit 62 on the left part of the flowchart of FIG. 27 is selected. If the stapling processing is selected, carry-in S11 of sheets to the placing tray 54, sheet alignment S12 by the alignment plates 58, and conveyance S13 of subsequent sheets are performed. Such a flow of sheets will be described in order from FIGS. 9A and 9B.

Figure 9A:
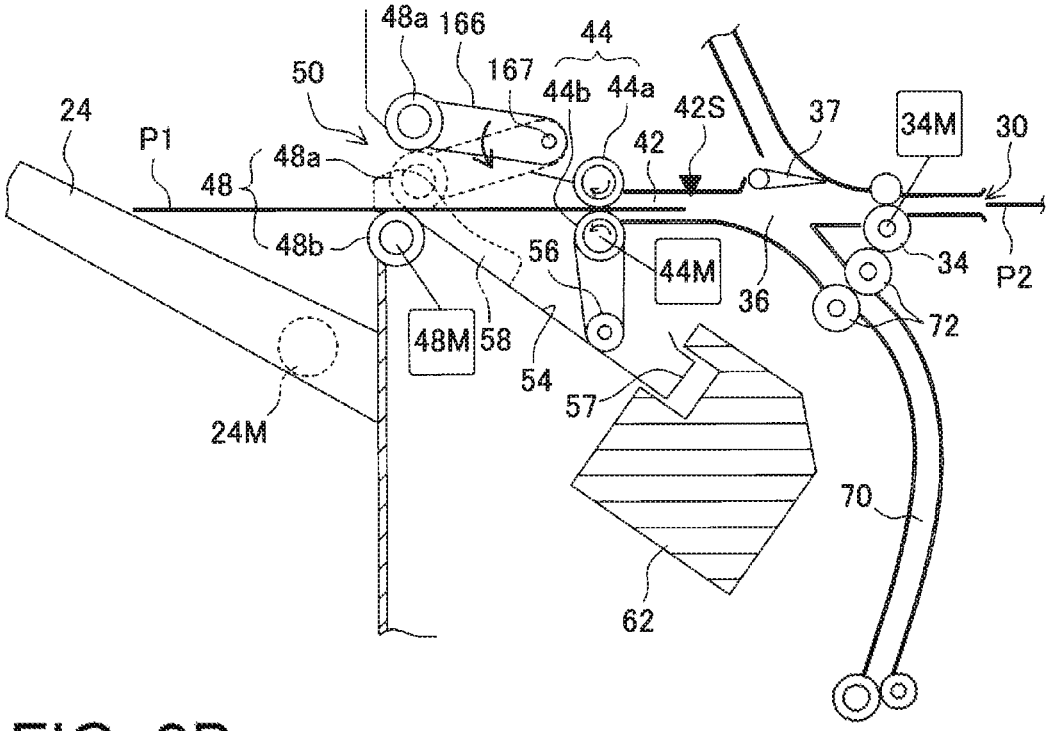
FIGS. 9A and 9B are explanatory diagrams of simultaneous bundle discharge in which subsequent sheets and a sheet bundle on the placing tray are simultaneously nipped and discharged by the discharge rollers.
Figure 9B:
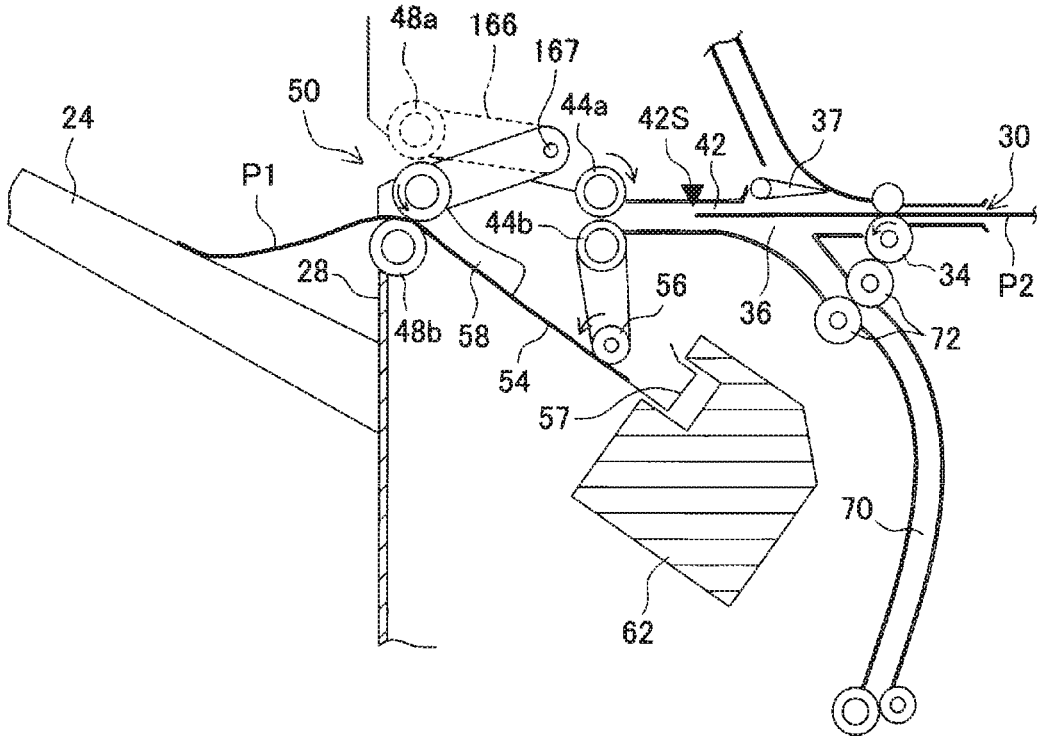

FIGS. 9A and 9B are explanatory diagrams in which the discharge rollers 48 simultaneously nip a subsequent sheet and a sheet bundle on the placing tray 54 to start "simultaneous bundle discharge". In FIG. 9A, the conveyance rollers 44 convey a first sheet P1 from the conveyance path 42 to the side of the placing tray 54. In such a state, if the trailing edge of the sheet is detected by the sheet sensor 42S and a not-shown counter counts up to a predetermined number, the first sheet P1 is discharged from the conveyance rollers 44 to the placing tray 54. At the same time, the discharge upper roller 48*a* of the discharge rollers 48 starts being moved from the separated position (solid lines in FIG. 9A) to the pressure contact position (broken lines in FIG. 9A) in which the discharge upper roller 48*a* comes into pressure contact with the discharge lower roller 48*b*.

As shown in FIG. 9B, the sheet released from the conveyance rollers 44 is then nipped by the discharge rollers 48, and switchback-conveyed by the counterclockwise rotation of the discharge upper roller 48*a* and the clockwise rotation of the discharge lower roller 48*b*. The sheet is further conveyed toward the reference surface 57 by the raking roller 56 and the belt with projections 146, and accommodated into and placed on the placing tray 54. In synchronization with the accommodation, the alignment plates 58 are moved for centering. The next second sheet is carried in. If the leading edge is detected by the sheet sensor 42S, the discharge upper roller 48*a* starts being moved from the pressure contact position (solid-lined position in FIG. 9B) to the separated position (broken-lined position in FIG. 9B) to carry in the sheet. The same operation as that of FIG. 9A is then repeated on the second sheet. After the formation of a two-sheet bundle BP1 (P1 and P2), the processing proceeds to FIGS. 10A and 10B.

Figure 10A:
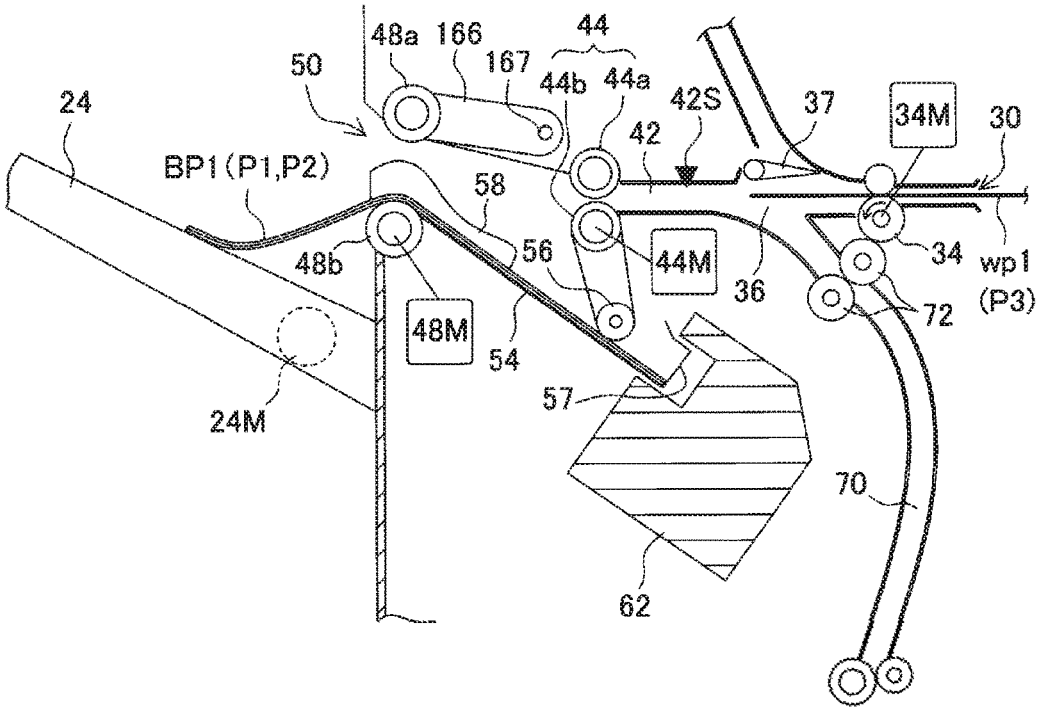
FIGS. 10A and 10B are explanatory diagrams of the simultaneous bundle discharge subsequent to FIGS. 9A and 9B.
Figure 10B:
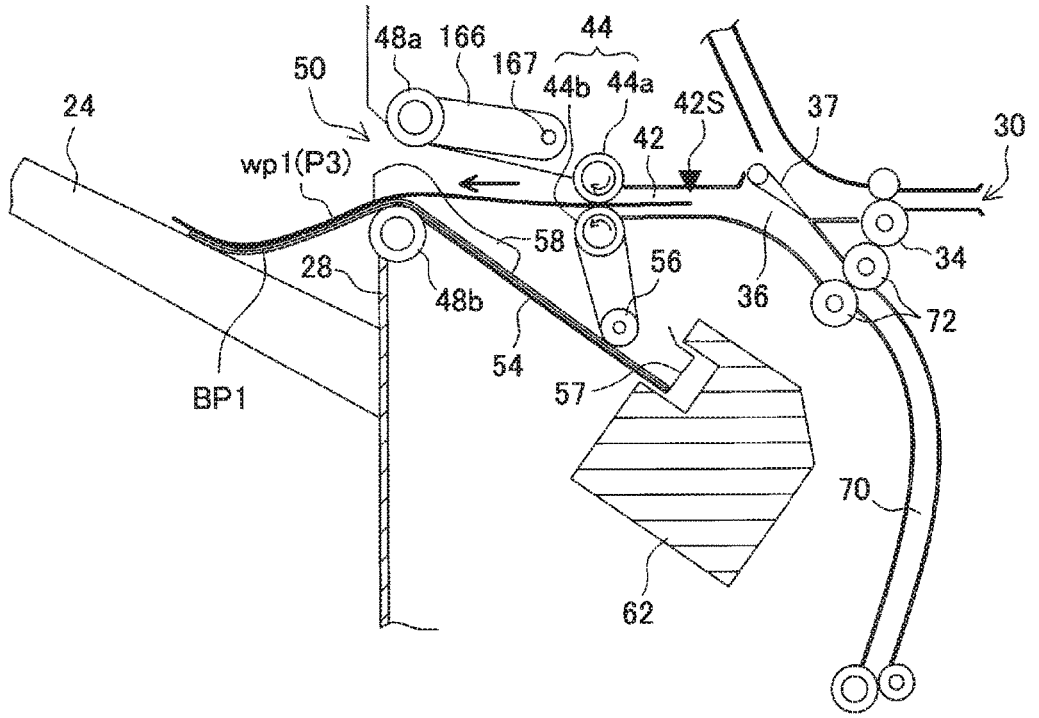

FIGS. 10A and 10B are explanatory diagrams of the simultaneous bundle discharge subsequent to FIGS. 9A and 9B. FIG. 10A shows a state in which a first subsequent sheet (wp1) which is a third sheet (P3) starts being carried in during the processing of the two-sheet bundle BP1 on the placing tray. The alignment of the sheet bundle BP1 on the placing tray 54 is complete, and the end binding unit 62 is moved to a binding position, i.e., in preparation for the binding processing.

As shown in FIG. 10B, the leading edge of the third sheet P (first subsequent sheet wp1) is continuously conveyed beyond the discharge rollers 48 by the conveyance rollers 44. Since the subsequent sheet P3 is to be switchback-conveyed, the switch gate 37 located in the branch position between the conveyance path 42 and the branch path 70 moves to the shown position for guiding the sheet to the branch path 70.

Figure 11A:
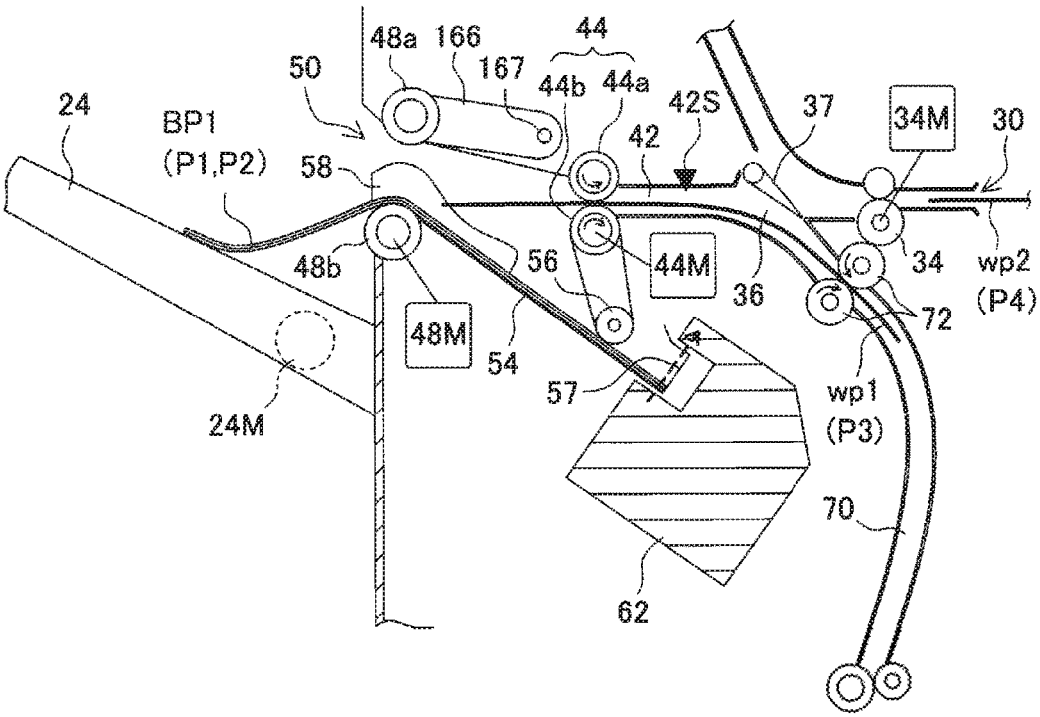
FIGS. 11A and 11B are explanatory diagrams of the simultaneous bundle discharge subsequent to FIGS. 10A and 10B.
Figure 11B:
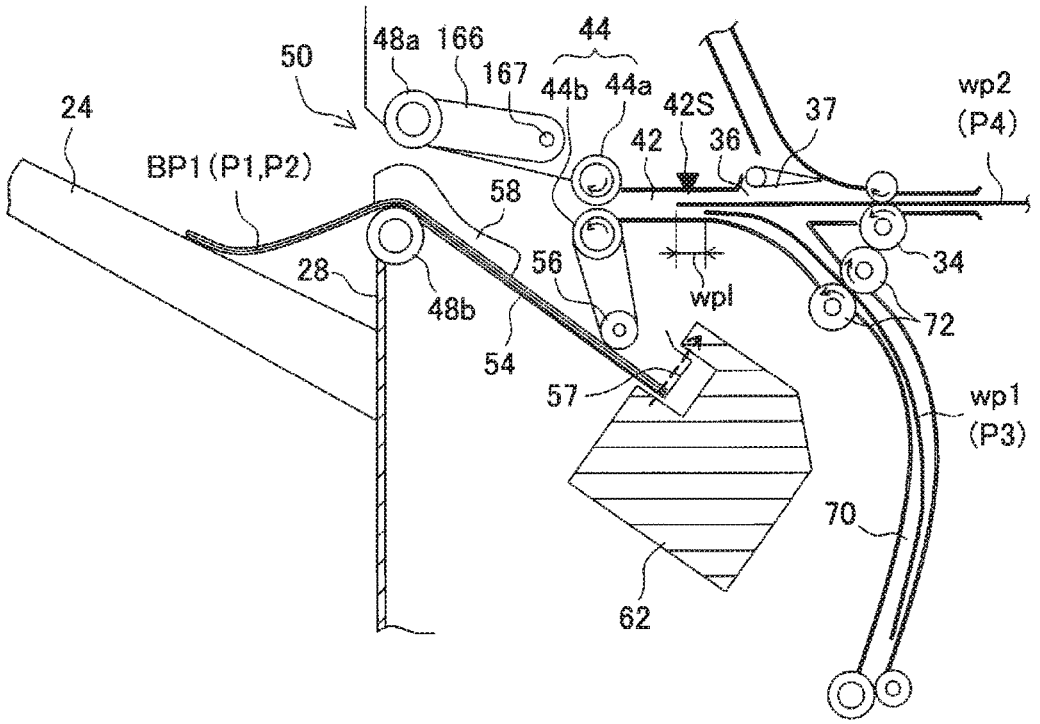

Next, FIGS. 11A and 11B are explanatory diagrams of the simultaneous bundle discharge subsequent to FIGS. 10A and 10B. In FIG. 11A, the end binding unit 62 starts to perform the end binding sheet processing on the sheet bundle BP1 on the placing tray 54. Since the subsequent sheet P3 is not able to be carried in to the placing tray 54 during the processing, the conveyance rollers 44 continue switchback conveyance. The sheet is moved to the downstream side of the branch path 70 by the branch rollers 72 which are located on the branch path 70 and rotate in synchronization with the rotation of the conveyance rollers 44. If the subsequent sheet P3 is nipped by the branch rollers 72, the switch gate 37 is lifted up to open the conveyance path 42. Meanwhile, the end binding unit 62 is performing the corner binding processing on the sheet bundle BP1.

In FIG. 11B, the corner binding sheet processing on the sheet bundle BP1 on the placing tray is continued. In the meantime, a second subsequent sheet P4 is sent to the conveyance rollers 44 by the carry-in rollers 34. If the subsequent sheet P4 is detected by the sheet sensor 42S, the standby sheet wp1 (first subsequent sheet P3) kept on standby in the branch path 70 in advance and the subsequent sheet P4 are both conveyed toward the conveyance rollers 44 with a difference of wp1 therebetween. Here, the conveyance speed of the standby sheet is 650 mm/sec. At this stage, the binding processing of the sheet bundle BP1 on the placing tray 54 is completed. In FIG. 27, such a state is shown as the binding processing S14 on the sheet bundle BP1 on the placing tray 54.

Figure 12A:
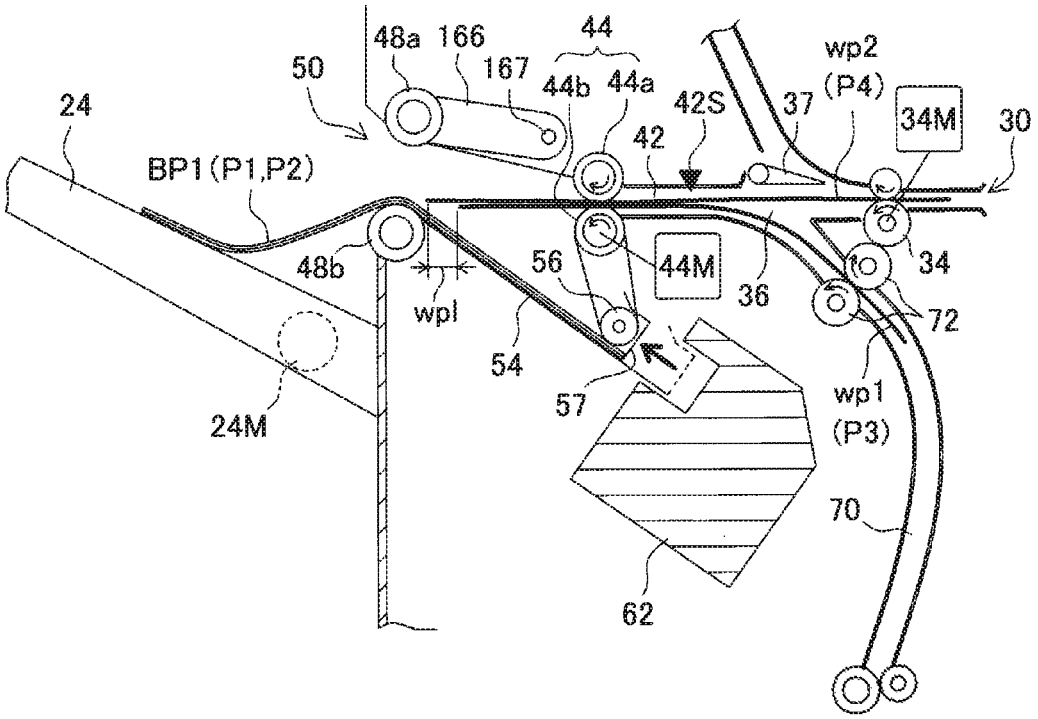
FIGS. 12A and 12B are explanatory diagrams of the simultaneous bundle discharge subsequent to FIGS. 11A and 11B.
Figure 12B:
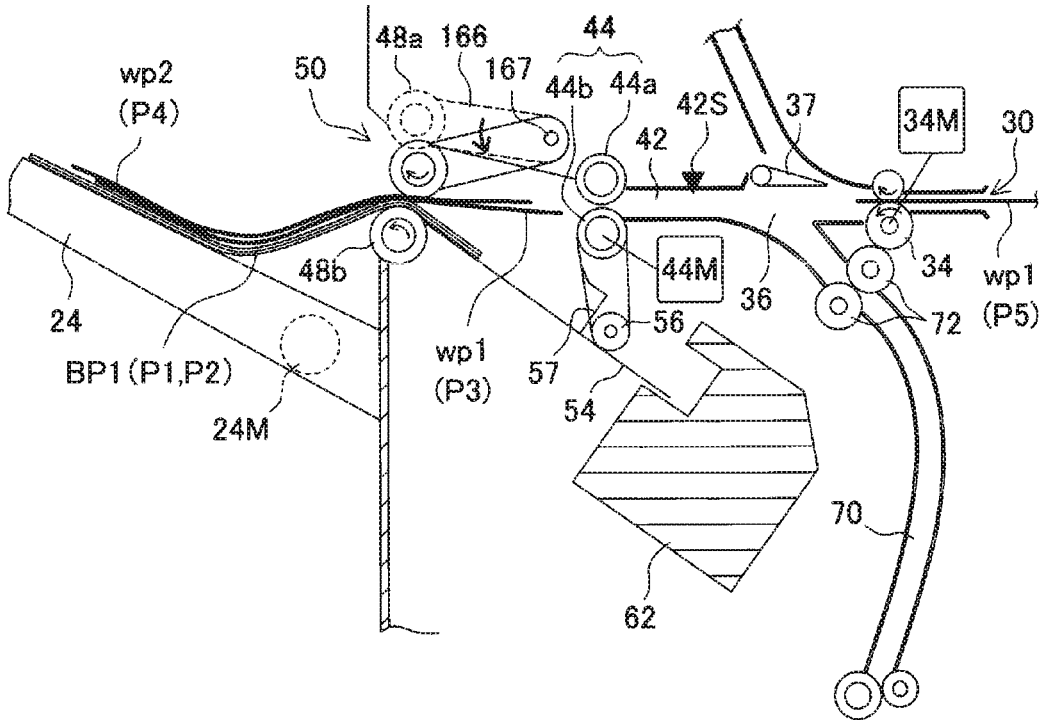

Next, FIGS. 12A and 12B will be described. FIGS. 12A and 12B are explanatory diagrams of the simultaneous bundle discharge subsequent to FIGS. 11A and 11B. FIG. 12A shows a state in which the binding sheet processing of the sheet bundle BP1 on the placing tray 54 is complete, and the sheet bundle BP1 starts being pushed by the reference surface 57. At the same time, the two subsequent sheets P3 and P4 are conveyed to the position of the conveyance rollers 48 to overlap with the sheet bundle BP1 on the conveyance tray 54. In FIG. 27, such a state is shown as feeding S15 of the standby sheets as a standby complete bundle.

[Execution of Simultaneous Bundle Discharge]

Next, FIG. 12B is a diagram relating to the simultaneous bundle discharge described so far, in which the sheet bundle BP1 on the placing tray 54 and the two subsequent sheets P3 and P4 are nipped together by the discharge rollers 48 and conveyed to the first stacking tray 24. As shown in FIG. 12B, the discharge upper roller 48*a* is lowered to the position in which the discharge upper roller 48*a* comes into pressure contact with the discharge lower roller 48*b*. The discharge rollers 48 simultaneously nip the sheet bundle BP1 on the placing tray 54 and the subsequent sheets P3 and P4, discharges the sheet bundle, and transports the subsequent sheets in the discharge direction. The conveyance speeds of the sheet bundle BP1 and the conveyance sheets P3 and P4 are both reduced to 600 mm/sec. The simultaneous bundle discharge is performed at a speed of 480 mm/sec. In FIG. 27, such a state is shown as a bundle discharge step S16 for simultaneous bundle discharge of the sheet bundle on placing tray 54 and the standby sheets.

Figure 13A:
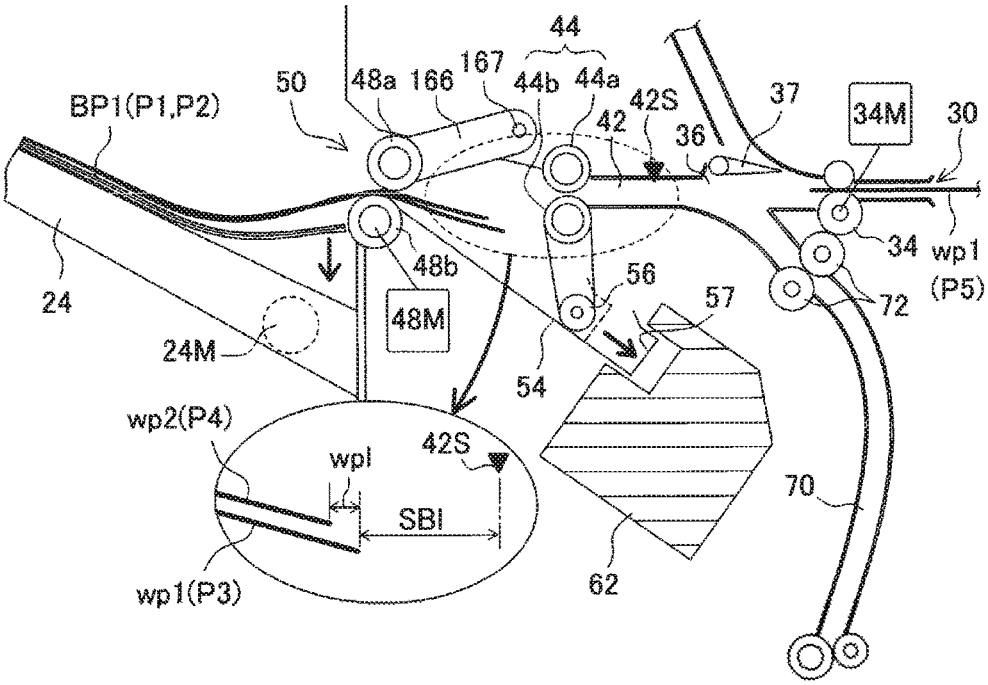
FIGS. 13A and 13B are explanatory diagrams of the simultaneous bundle discharge subsequent to FIGS. 12A and 12B.
Figure 13B:
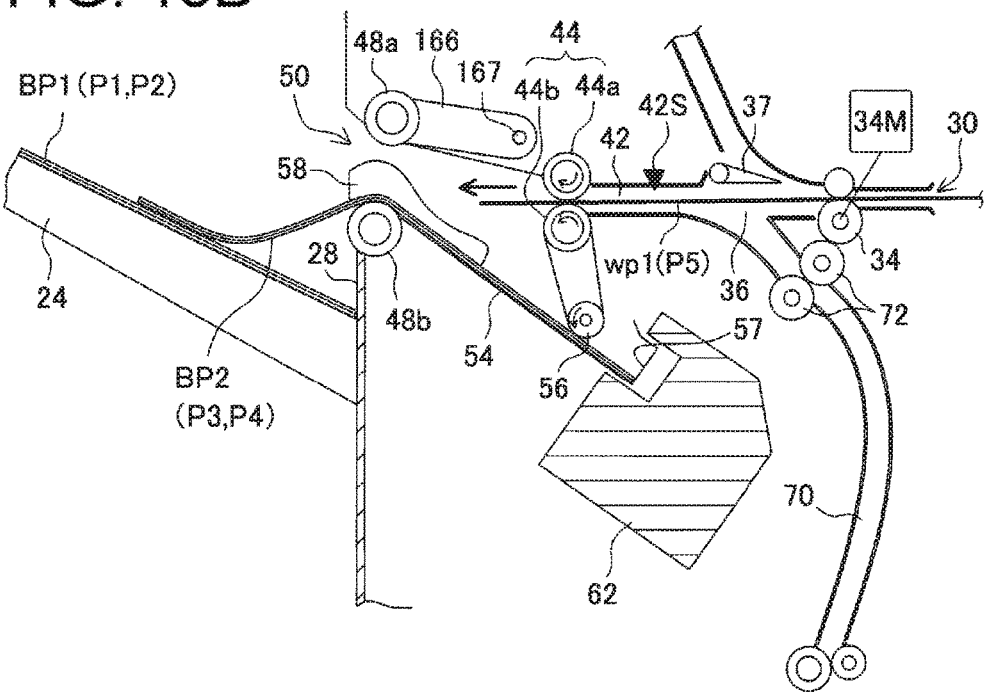

If the simultaneous bundle discharge is executed, the processing proceeds to the state shown in FIGS. 13A and 13B subsequent to FIGS. 12A and 12B. In FIG. 13A, the discharge rollers 48 initially discharge the sheet bundle BP1 placed on the placing tray 54 to the first stacking tray 24. In such a state, the discharge rollers 48 once stop rotating. In such a state, as shown in the eclipse in FIG. 13A, the subsequent sheets P3 and P4 have a difference as much as a distance of wp1. A distance between the subsequent sheet P3 and the sheet sensor 42*s* is set to be SB1. The discharge rollers 48 then start to rotate backward (in FIG. 13A, the discharge upper roller 48*a* to rotate counterclockwise, and the discharge lower roller 48*b* to rote clockwise). In FIG. 27, such a state is shown as a carry-in step S17 for switching back the standby sheets to the placing tray 54. The speed of the sheets switchback-conveyed to the placing tray 54 is 600 mm/sec.

The reverse rotations of the discharge rollers 48 place the subsequent sheets P3 and P4 as a second sheet bundle BP2 on the placing tray 54 in the state shown in FIG. 13B. In FIG. 13B, the simultaneous bundle discharge is completed.

In FIG. 27, whether to complete the simultaneous bundle discharge is shown as step S18. In step S18, if there is the next processing (subsequent sheets to be carried in), the processing returns to FIG. 10A to continue the simultaneous bundle discharge until a specified number of sheet bundles are processed. If there is no subsequent sheet and the sheet processing is to be ended, then in FIG. 13B, the binding processing is performed on the sheet bundle on the placing tray 54 without a subsequent sheet. The sheet bundle is discharged to the first stacking tray 24, and the sheet processing is completed.

The execution procedure of the simultaneous bundle discharge has been described above. Since the subsequent sheets and the sheet bundle on the placing tray 54 are overlapped for processing, the processing time can be reduced to improve the processing speed. Such a procedure does not cause a problem if the sheet bundle on the placing tray 54 is bound. On the other hand, in the case of the sort processing without binding, the alignment of sheets stacked on the first stacking tray 24 may deteriorate as has been described as a problem with reference to FIGS. 29A to 29D. For the sake of discharge of a sheet bundle and transportation of subsequent sheets to improve such a problem without much decreasing the processing speed, the "advance bundle discharge" in which the sheet bundle is discharged in advance during switchback conveyance of the subsequent sheets will be described in order with reference to the sheet conveyance diagrams of FIGS. 14A to 18B and the right part of the flowchart of FIG. 27.

More specifically, in the description of FIG. 27 so far, the binding processing which is the first processing using the end binding unit 62 is described to be selected as the sheet processing on the placing tray 54 of the sheet processing apparatus. In the following description, the sort (jog) processing which is the second processing using the alignment plates 58 is described to be selected. In such a case, the sort processing (jog) of sheet bundles in the right part of the flowchart of FIG. 27 is selected. If the sort processing is selected, carry-in S21 of sheets to the placing tray 54, sort processing S22 for changing and shifting a placing position on the placing tray 54 simultaneously with sheet alignment by the alignment plates 58, and conveyance S23 of subsequent sheets are performed. Such a flow of sheets will be described in order from FIGS. 14A to 14B.

Figure 14A:
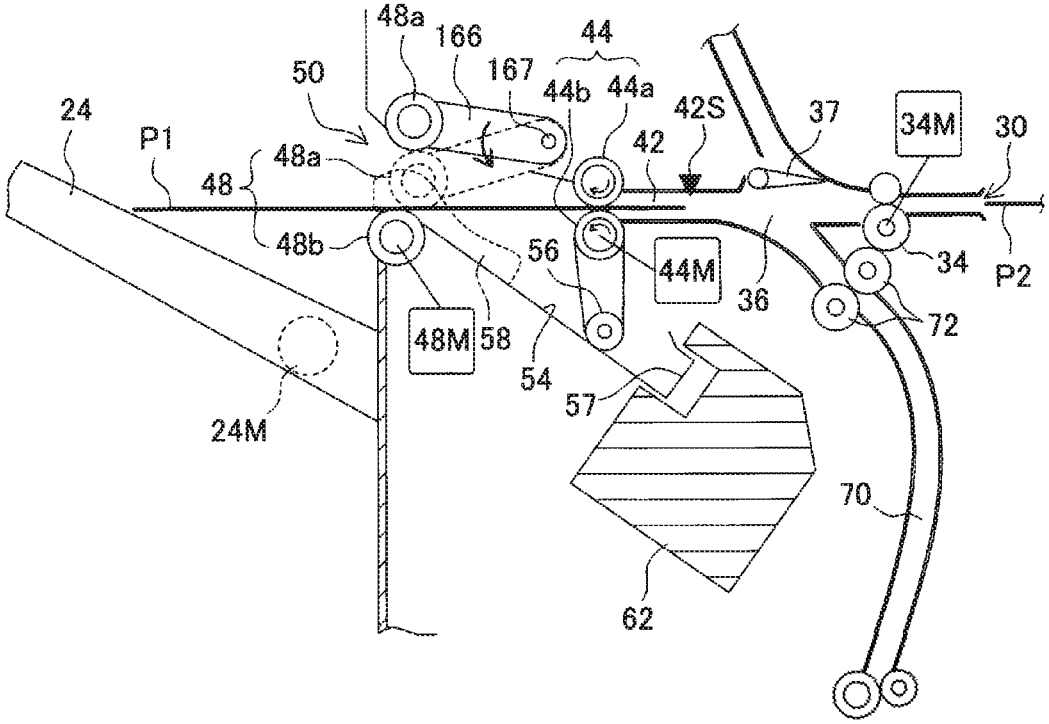
FIGS. 14A and 14B are explanatory diagrams of advance bundle discharge in which a sheet bundle on the placing tray is discharged to the stacking tray while subsequent sheets are switchback-conveyed.
Figure 14B:
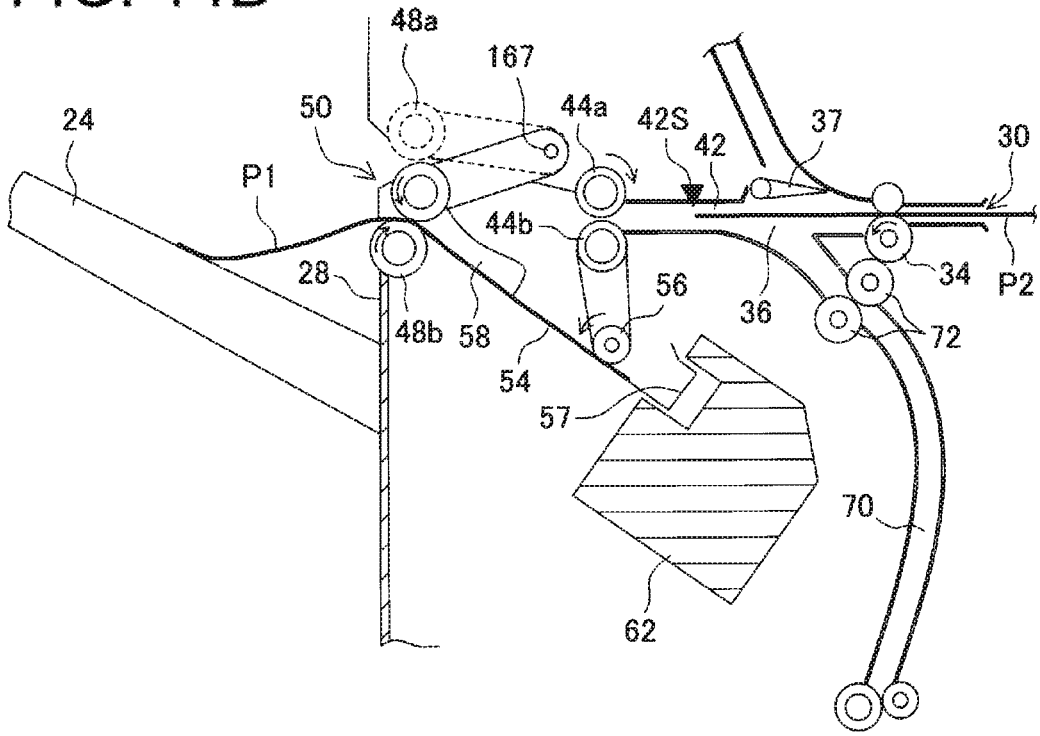

FIGS. 14A and 14B are explanatory diagrams showing a case in which a sheet bundle on the placing tray 54 is discharged to the first stacking tray 24 while subsequent sheets are switchback-conveyed by the conveyance rollers 44 (advance bundle discharge). FIGS. 14A and 14B are substantially the same as FIGS. 9A and 9B describing the foregoing simultaneous bundle discharge, except the operation of the alignment plates 58. In FIG. 14A, the conveyance rollers 44 convey a first sheet P1 from the conveyance path 42 to the side of the placement tray 54. In such a state, if the trailing edge of the sheet is detected by the sheet sensor 42S and the not-shown counter counts up to a predetermined number, the first sheet P1 is discharged from the conveyance rollers 44 to the placing tray 54. At the same time, the discharge upper roller 48*a* of the discharge rollers 48 starts being moved from the separated position (solid lines in FIG. 14A) to the pressure contact position (broken lines in FIG. 14A) in which the discharge upper roller 48*a* comes into pressure contact with the discharge lower roller 48*b*.

Subsequently, as shown in FIG. 14B, the sheet released from the conveyance rollers 44 is nipped by the discharge rollers 48, and switchback-conveyed by the counterclockwise rotation of the discharge upper roller 48*a* and the clockwise rotation of the discharge lower roller 48*b*. The sheet is further conveyed toward the reference plane 57 by the raking roller 56 and the belt with projections 146, and accommodated into and placed on the placing tray 54. Here, the conveyance speed of the sheet toward the reference plane 57 is 650 mm/sec. In synchronization with the center accommodation of the sheet, the alignment plates 58 are moved to align the sheet to one side on the placing tray 54. If the next second sheet P2 is carried in and the leading edge is detected by the sheet sensor 42S, the discharge upper roller 48*a* starts being moved from the pressure contact position (solid-lined position in FIG. 14B) to the separated position (broken-lined position in FIG. 14B) to carry in the sheet. The same operation as that of FIG. 14A is then repeated on the second sheet to form a two-sheet bundle BP1 (P1 and P2) aligned to one side. The processing proceeds to FIGS. 15A and 15B.

Figure 15A:
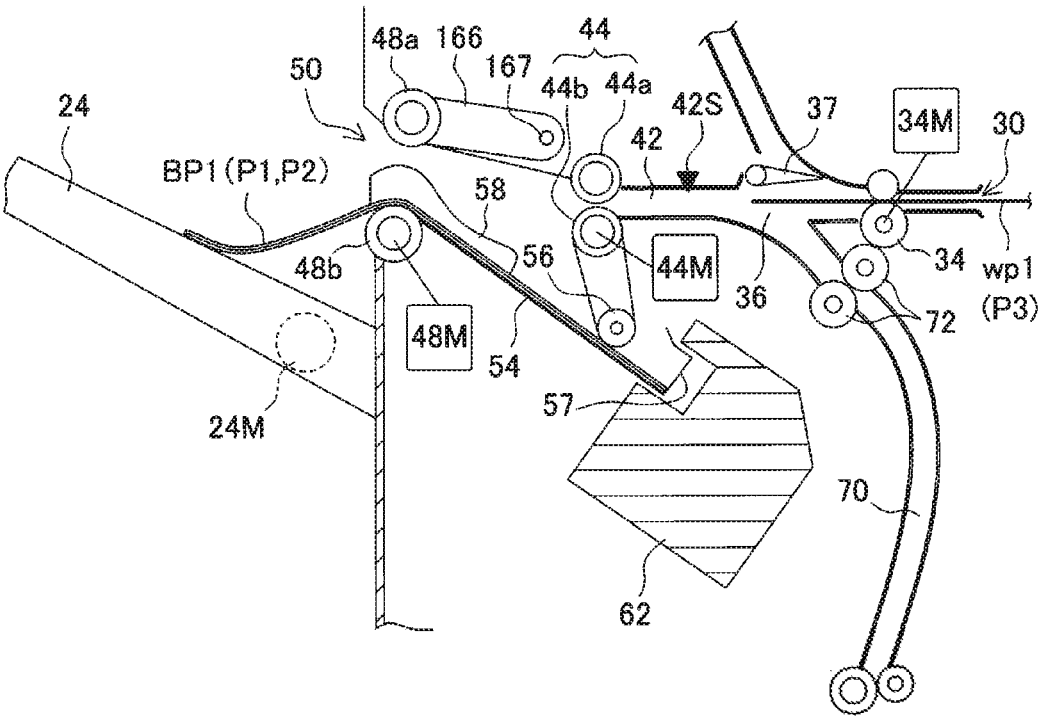
FIGS. 15A and 15B are explanatory diagrams of the advance bundle discharge subsequent to FIGS. 14A and 14B.
Figure 15B:
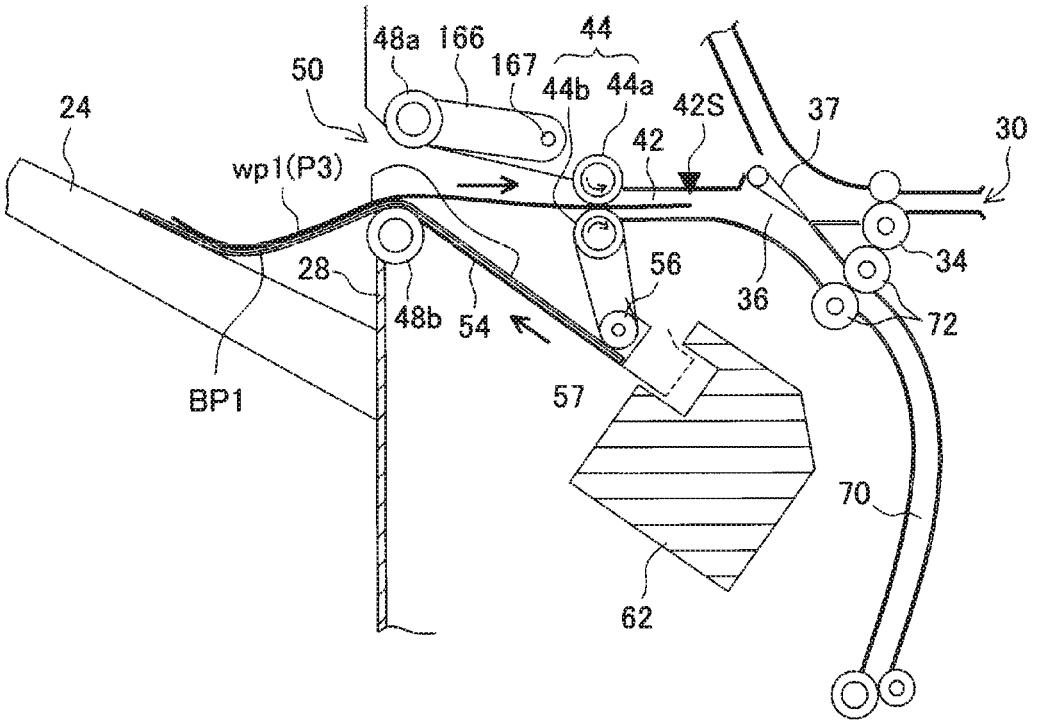

FIGS. 15A and 15B are explanatory diagrams of the advance bundle discharge subsequent to FIGS. 14A and 14B. FIG. 15A is a diagram in which the second sheet is carried in to the placing tray 54 and aligned and shifted. Since the sheet processing here includes only changing the position of a sheet bundle to be discharged to the first stacking tray 24 on the first stacking tray 24, the sheet processing is performed in a shorter processing time than when the binding process is.

[Pushing Up 1 of Bundle During Switchback Conveyance]

Next, as shown in FIG. 15B, the leading edge of a third sheet P3 (first standby sheet wp1) is continuously conveyed beyond the discharge rollers 48 by the conveyance rollers 44. Since the subsequent sheet P3 is to be switchback-conveyed, the switch gate 37 located in the branch position between the conveyance path 42 and the branch path 70 moves to the shown position for guiding the sheet to the branch path 70. If the switchback conveyance of the sheet is started, a reference surface moving motor 64M is activated to push out the sheet bundle BP1 to the discharge tray outlet 50 by the reference surface 57. The pushing timing may be such that the sheet bundle BP1 immediately starts being pushed when the alignment plates 58 finish aligning the sheet bundle BP1 on the placing tray 54 to one side. As in the present invention, the sheet bundle BP1 may start being pushed after the switchback conveyance of the subsequent sheet P3 is started, in which case the sheet bundle BP1 is pulled backward by the subsequent sheet P3 for improved alignment. Here, the setting value of the switchback conveyance speed of the subsequent sheet is 750 mm/sec. The setting value of the pushing speed of the reference surface 57 is 600 mm/sec.

[Execution of Advance Bundle Discharge]

Figure 16A:
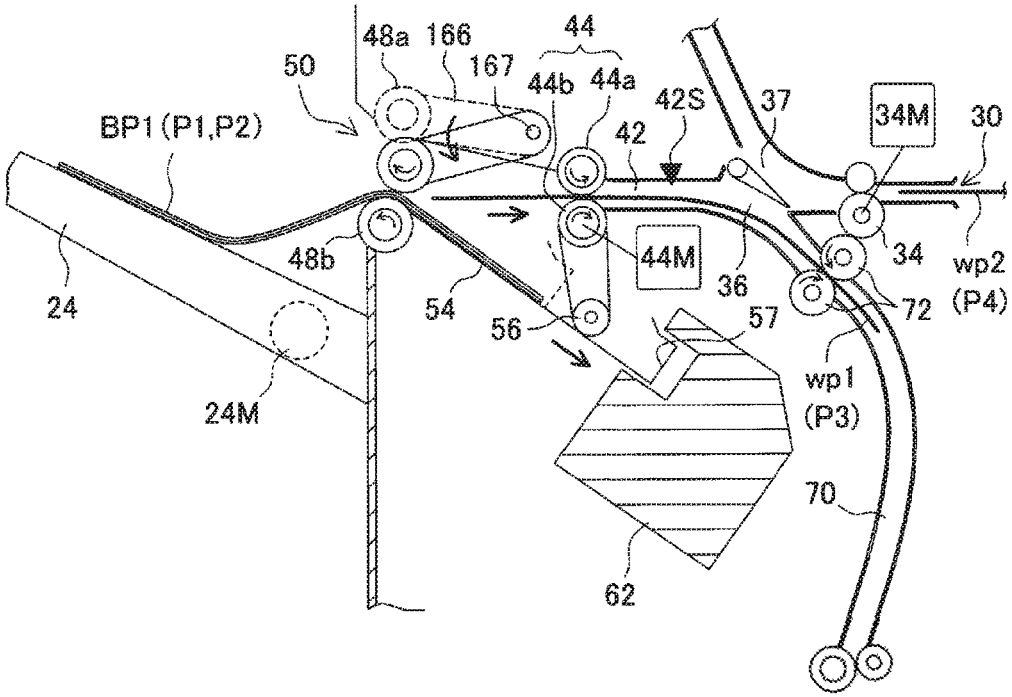
FIGS. 16A and 16B are explanatory diagrams of the advance bundle discharge subsequent to FIGS. 15A and 15B.
Figure 16B:
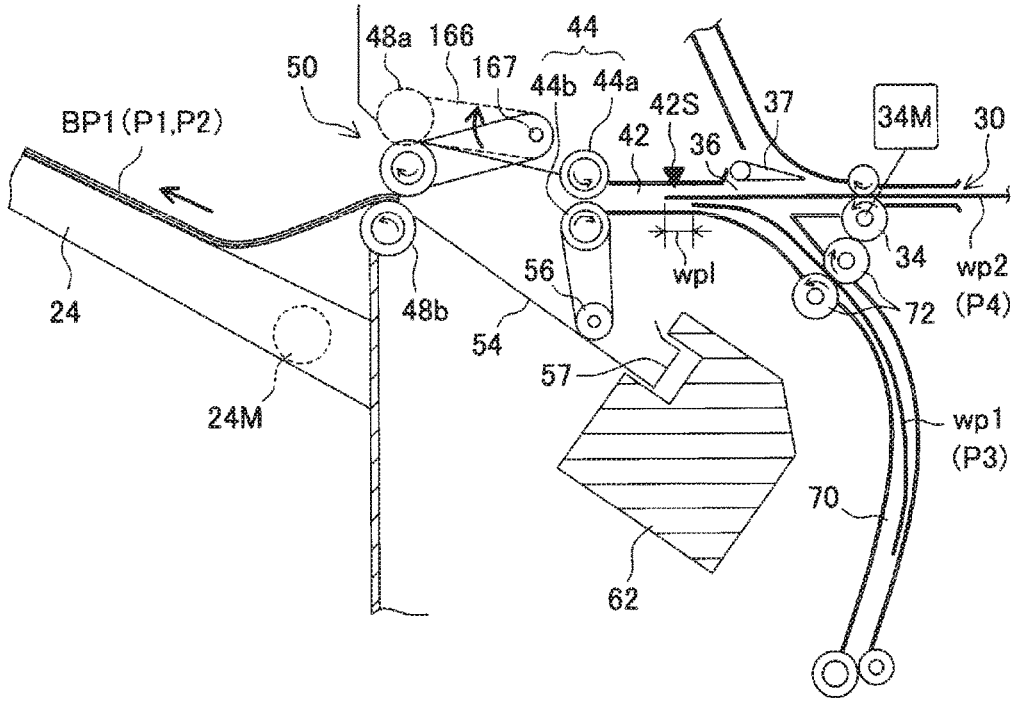

FIGS. 16A and 16B are explanatory diagrams of the advance bundle discharge subsequent to FIGS. 15A and 15B. FIG. 16A is a diagram in which when the subsequent sheet P3 is switchback-conveyed by the conveyance rollers 44 and returned to the upstream side of the discharge rollers 48, the discharge upper roller 48*a* of the discharge rollers 48 is lowered to nip the sheet bundle BP1 on the placing tray 54 and start bundle discharge in advance. The subsequent sheet P3 is forwarded to the branch path 70 by the switch gate 37, and further forwarded to the downstream side of the branch path 70 by the branch rollers 72. The trailing edge of the subsequent sheet P3 is thereby located upstream of the discharge rollers 48 and switchback-conveyed without interfering with the discharge of the sheet bundle BP1. As described above, the discharge rollers 48 can thus discharge the sheet bundle BP on the placing tray 54 to the first stacking tray 24 immediately after the subsequent sheet P3 passes to the upstream side. Here, the reference surface 57 having pushed out the sheet bundle BP1 to the side of the placing tray outlet 50 returns from the broken-lined position in FIG. 16A to the original solid-lined position. In FIG. 27, such a state is shown as switchback and return S24 of the standby (subsequent) sheet to the upstream of the discharge rollers 48. This stage of switchback is shown as bundle discharge step S25 for discharging the sheet bundle on the placing tray 54 as described above.

[Completion of Advance Bundle Discharge]

FIG. 16B is a diagram in which the discharge rollers 48 continue discharging the sheet bundle BP1 from the placing tray 54 to the first stacking tray 24. The sheet bundle discharge speed here is reduced from 600 mm/sec to 350 mm/sec to avoid deterioration of alignment. Immediately after the state of FIG. 16B, the sheet bundle BP1 is discharged to the first tacking tray 24, whereby the advance bundle discharge is completed. Meanwhile, a second subsequent sheet P4 is conveyed toward the conveyance rollers 44 by the carry-in rollers 34. If the subsequent sheet P4 is detected by the sheet sensor 42S, the standby sheet wp1 (first subsequent sheet P3) kept on standby in the branch path 70 in advance and the subsequent sheet P4 are both conveyed toward the conveyance rollers 44 with a difference of wp1 therebetween. Here, the conveyance speed of the subsequent sheets is 650 mm/sec.

[Conveyance of Subsequent Sheets (Discharge Roller Up)]

Figure 17A:
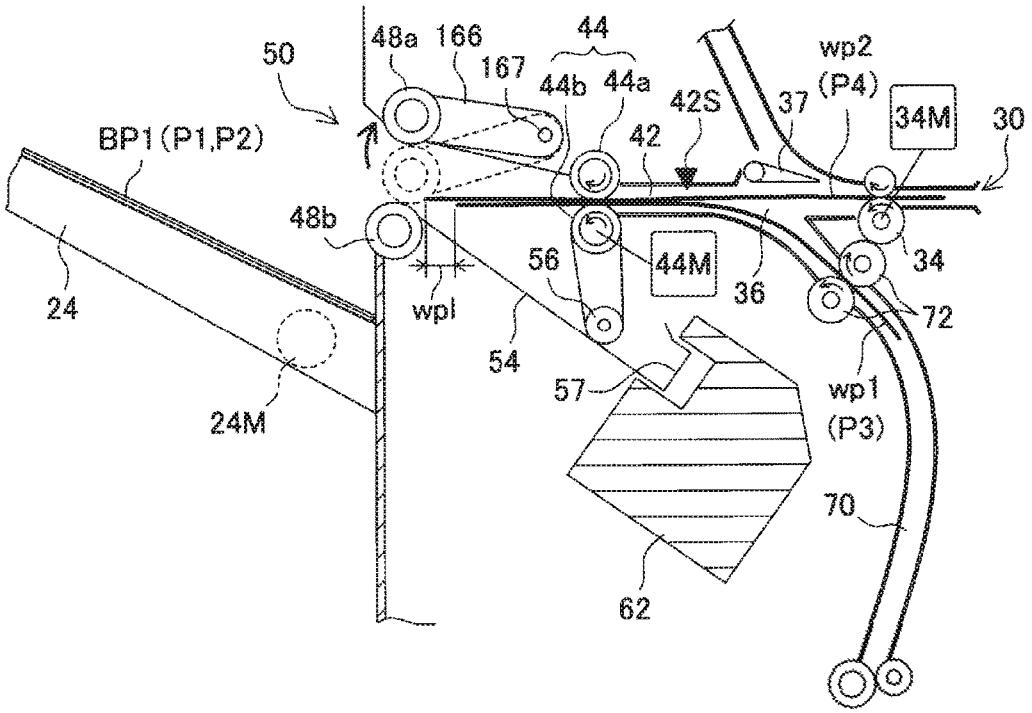
FIGS. 17A and 17B are explanatory diagrams of the advance bundle discharge subsequent to FIGS. 16A and 16B.

After the discharge of the sheet bundle BP1 in FIG. 16B, the subsequent sheets P3 and P4 are conveyed by the conveyance rollers 44 to approach the discharge rollers 48 as shown in FIG. 17A. Here, the discharge upper roller 48*a* is retracted from the pressure contact position shown by the broken lines in FIG. 17A to the separated position shown by the solid lines. The subsequent sheets P3 and P4 pass the position of the discharge rollers 48. If the subsequent sheets are three or more in number, the movement of the discharge upper roller 48*a* to the lifted separated position as shown in FIG. 17A facilitates the passage of the sheets through the position of the discharge rollers 48. A description thereof will be given later.

[Switchback of Subsequent Sheets (Carry-in to Placing Tray)]

Figure 17B:
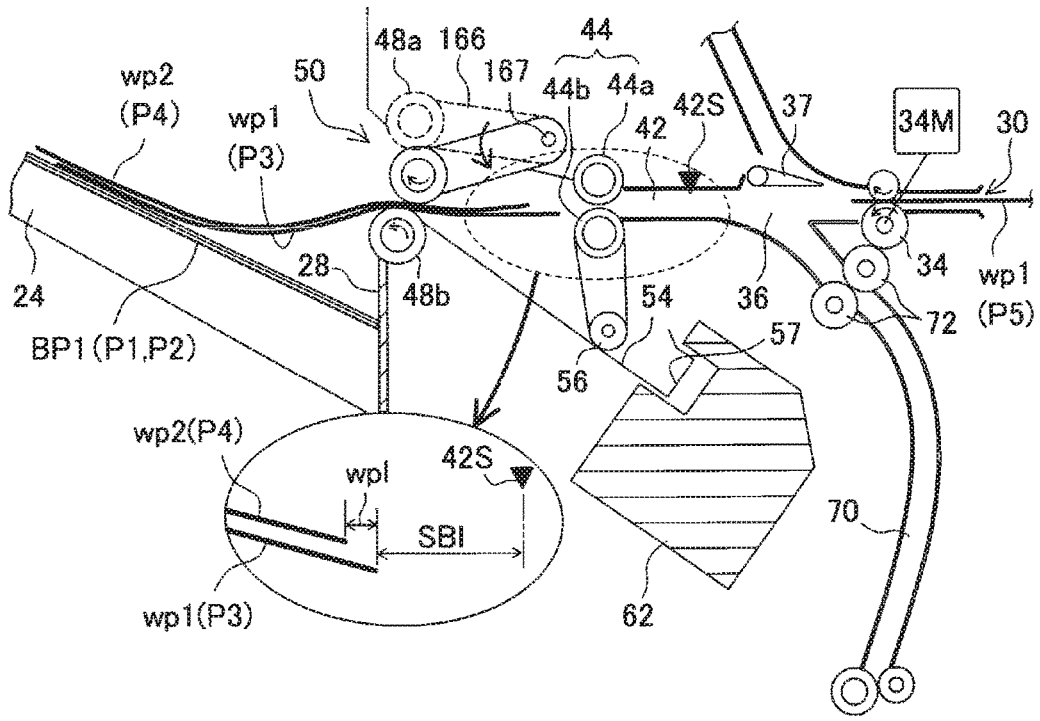

If the subsequent sheets P3 and P4 in the state of FIG. 17A pass the position of the discharge rollers 48, the subsequent sheets P3 and P4 are nipped by the discharge rollers 48 again and transported to the side of the first stacking tray 24 as shown in FIG. 17B. Then, the discharge rollers 48 once stop rotating. In such a state, as shown in the ellipse in FIG. 17B, the subsequent sheets P3 and P4 have a difference as much as a distance of wp1. A distance between the subsequent sheet P3 and the sheet sensor 42S is set to be SB1. The discharge rollers 48 then start to rotate backward (rotate in directions reverse to the directions of the arrows in FIG. 17B). In FIG. 27, such a state is shown as carry-in step S26 for switching back only the standby sheets to the placing tray 54. The switchback conveyance speed is reduced from 600 mm/sec to 300 mm/sec when the sheets are released to the placing tray 54. The discharge rollers 48 are then stopped. The sheets are carried in to the placing tray 54 at a setting value of 600 mm/sec.

Figure 18A:
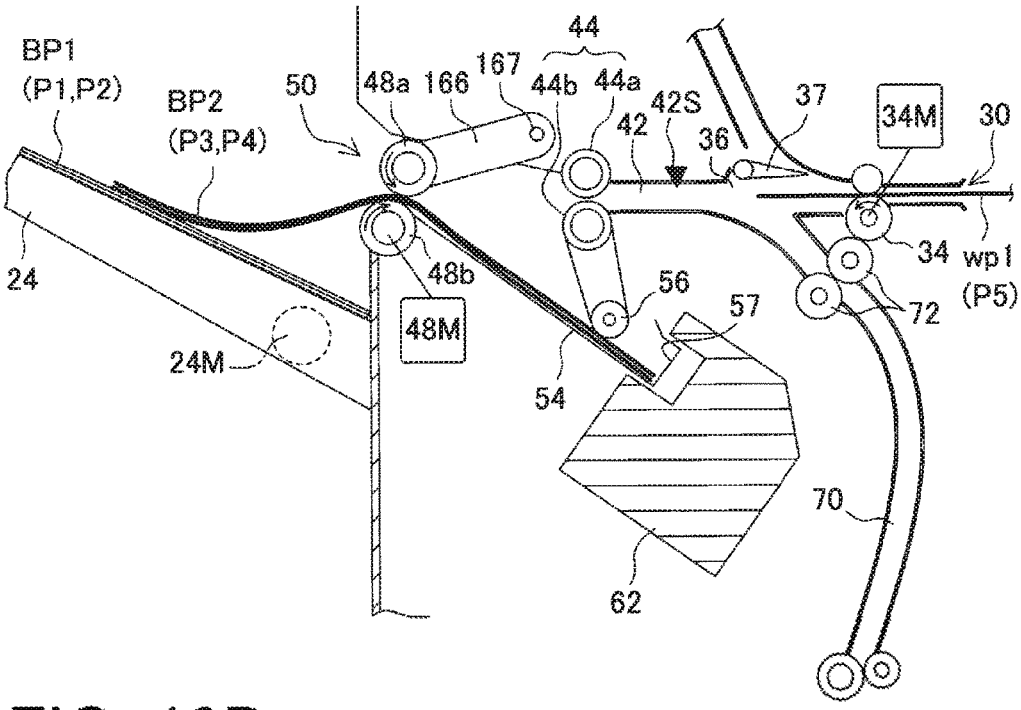
FIGS. 18A and 18B are explanatory diagrams of the advance bundle discharge subsequent to FIGS. 17A and 17B.

By the reverse rotation of the discharge rollers 48, the subsequent sheets P3 and P4 enter the state shown in FIG. 18A as a second sheet bundle BP2 on the placing tray 54. In FIG. 18A, the two subsequent sheets P3 and P4 are carried in as the sheet bundle BP2 to the placing tray 54. After the carry-in, the discharge upper roller 48*a* is once moved to the separated position. In the meantime, the alignment plates 58 shift the sheets to one side. The carry-in rollers 34 start to convey the next subsequent sheet P5.

[Pushing Up 2 During Switchback Conveyance]

Figure 18B:
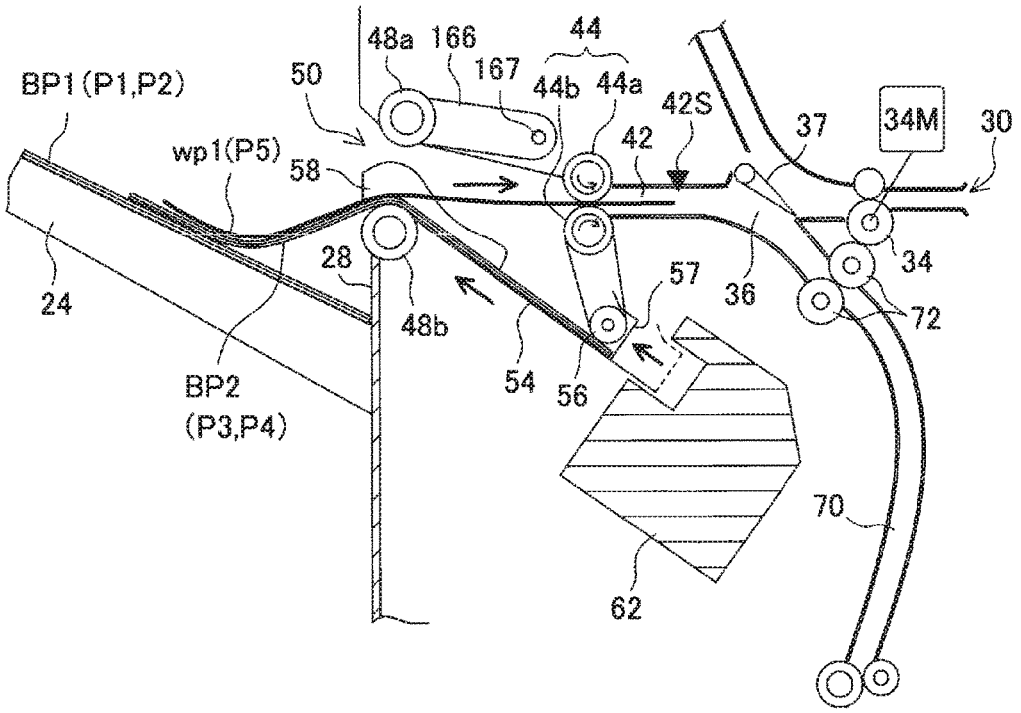

FIG. 18B is a diagram showing a state in which the subsequent sheet P5 which is a standby sheet wp1 passes the conveyance rollers 48 and starts being switchback-conveyed, and the reference plane 57 starts to push the sheet bundle BP2 on the placing tray 54. Such a state is substantially the same as that of FIG. 15B described for the advance bundle discharge. A description thereof is thus omitted here. The reference surface moving motor 64M is activated during the switchback conveyance of the subsequent sheet P5, so that the reference surface 57 pushes out the sheet bundle BP2 to the placing tray outlet 50. Here, the setting value of the switchback conveyance speed of the subsequent sheet is 750 mm/sec. The setting value of the pushing speed by the reference surface 57 is 600 mm/sec.

As described above, if there is a next sheet bundle to be processed, the processing returns to FIG. 15A and is repeated until a specified number of sheet bundles are formed. If there is no next sheet, no subsequent sheet is carried in in the state of FIG. 19A, and only the sheet bundle on the placing tray 54 is discharged to complete the processing. In FIG. 27, whether to complete the processing is shown as step S27. In step S27, if there is a next sheet bundle to be processed (subsequent sheet to be carried in), the processing returns to FIG. 15A to continue the advance bundle discharge until a specified number of sheet bundles are formed. If there is no subsequent sheet and the processing is to be ended, then in FIG. 18A, the sheet bundle on the placing tray 54 is shifted to one side without a subsequent sheet. The sheet bundle is discharged to the first stacking tray 24, and the processing for shifting sheets to one side without binding processing is completed.

The execution procedure of the advance bundle discharge during switchback of a subsequent sheet has been described above. Since the sheet bundle on the placing tray 54 is discharged without a subsequent sheet being stacked thereon, the sheets stored on the first stacking tray 24 are less pushed or drawn by subsequent sheets. This reduces deterioration of the alignment of the sheets stored on the first stacking tray 24. Since the sheet bundle on the placing tray 54 is discharged in advance during the standby operation of a subsequent sheet, the processing can be performed without much reducing the processing speed.

As described above, the present invention includes the discharge mode "simultaneous bundle discharge" in which the sheet bundle on the placing tray is discharged with subsequent sheets as described with reference to the sheet conveyance diagrams of FIGS. 9A to 13B and the left part of the flowchart of FIG. 27, and the discharge mode "advance bundle discharge" in which the sheet bundle on the placing tray 54 is discharged in advance during switchback of a subsequent sheet as described with reference to the sheet conveyance diagrams of FIGS. 14A to 18B and the right part of the flowchart of FIG. 27. Depending on whether the binding processing (first processing) or the sort (jog) processing (second second processing) using the alignment plates 58 is performed, the discharge modes are changed as described above to avoid deterioration of the alignment of the sheet bundles and a drop in the processing speed of the apparatus during the sort processing in particular.

[Modification of Advance Bundle Discharge (Stepwise Advance Bundle Discharge)]

Next, a modification of FIGS. 15A to 18B will be described with reference to FIGS. 19A to 26B. This modification is suitably applicable to the case described in FIG. 10C, in which a ten-sheet bundle is placed on the placing tray 54 and discharged to the first stacking tray 24. A difference from the operation of FIGS. 15A to 18B is that there are three or more subsequent sheets, and the sheet bundle on the placing tray 54 is discharged to the first stacking tray 24 stepwise (stepwise advance bundle discharge) while subsequent sheets to be standby sheets wp are switchback-conveyed.

[Start of Bundle Discharge During Switchback of Subsequent Sheets]

Figure 19A:
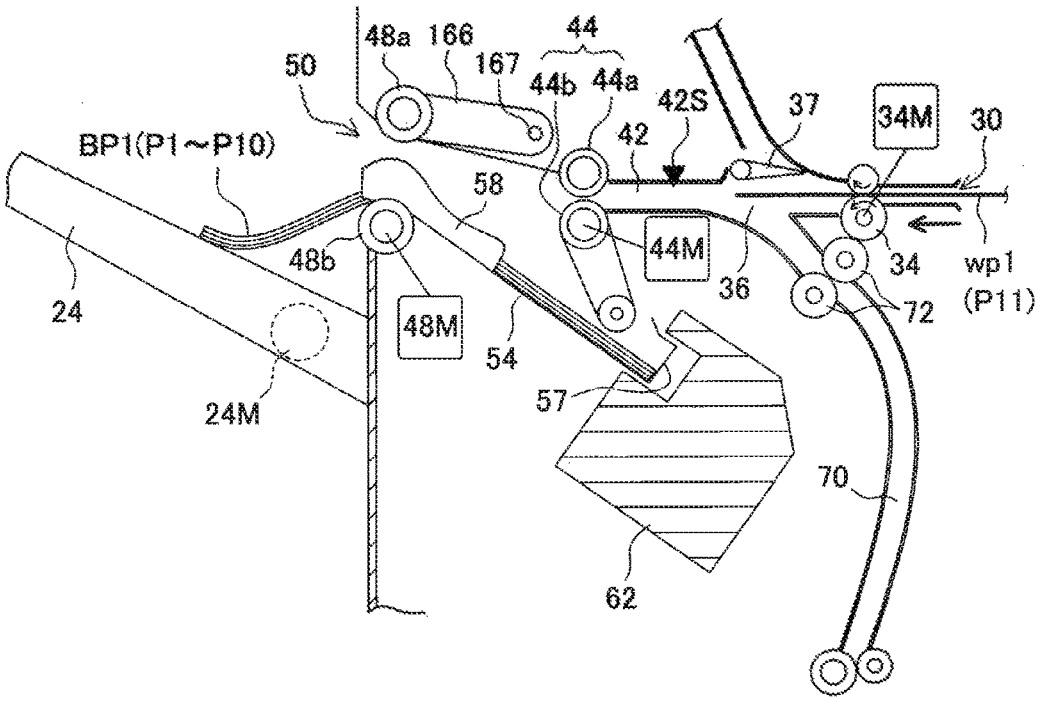
FIGS. 19A and 19B are explanatory diagrams of stepwise advance bundle discharge, a modification of FIG. 15A to FIG. 18B, in which a sheet bundle on the placing tray is discharged to the stacking tray stepwise while subsequent sheets are switchback-conveyed.

FIG. 19A shows a state of sheets subsequent to FIGS. 14A and 14B. In the state of FIG. 19A, a ten-sheet bundle BP1 is placed on the placing tray 54, and the placed sheets finish being aligned and shifted to one side. A subsequent sheet P11 (standby sheet wp1) has started to be carried in by the carry-in rollers 34. Next, in FIG. 19B, the subsequent sheet P11 starts being switched back as a standby sheet wp by the conveyance rollers 44. According to the start of the switchback, the reference surface 57 starts to push the sheet bundle BP1. Again, since the sheet bundle BP1 on the placing tray 54 starts being pushed during the switchback of a subsequent sheet, the sheet bundle is less disturbed even though not bound.

Figure 19B:
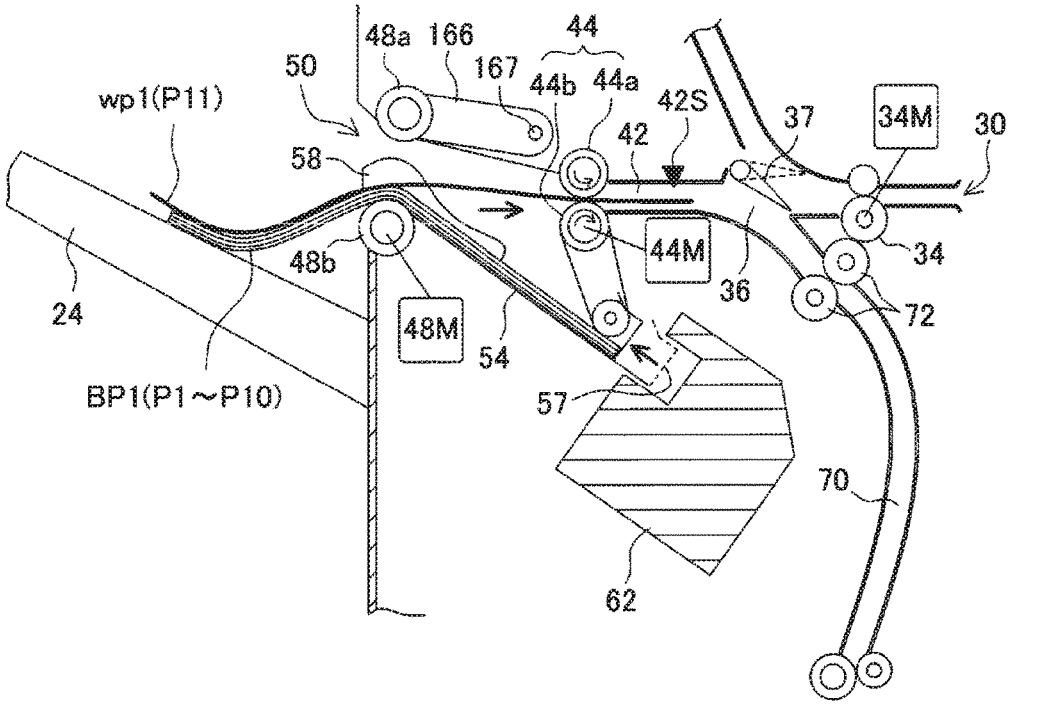
Figure 20A:
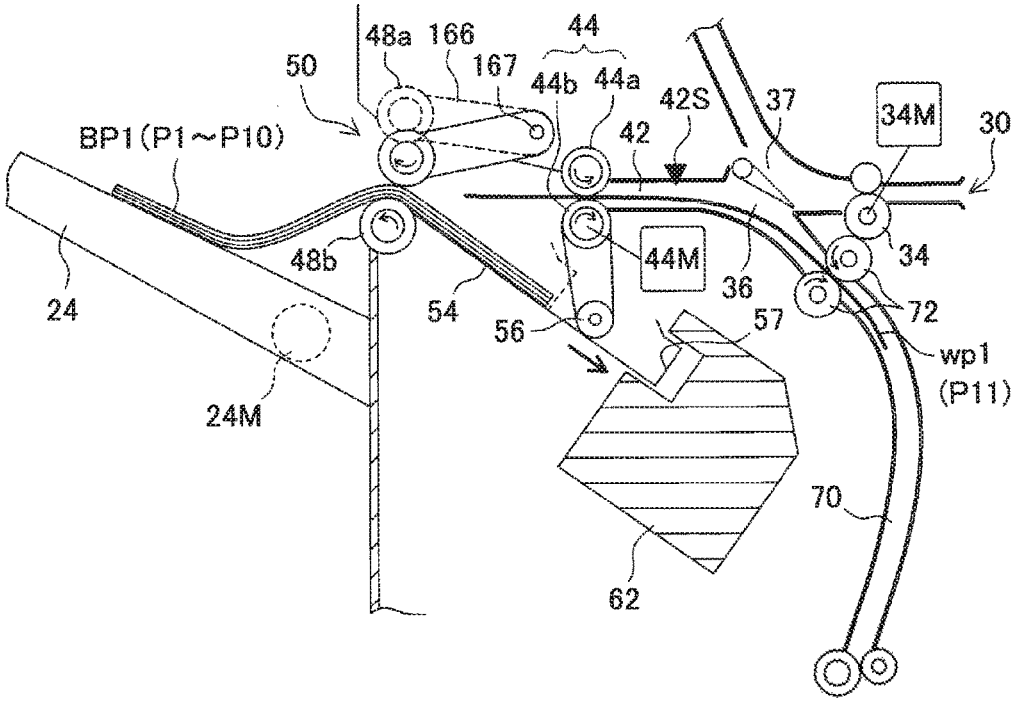
FIGS. 20A and 20B are explanatory diagrams of the stepwise advance bundle discharge subsequent to FIGS. 19A and 19B.
Figure 20B:
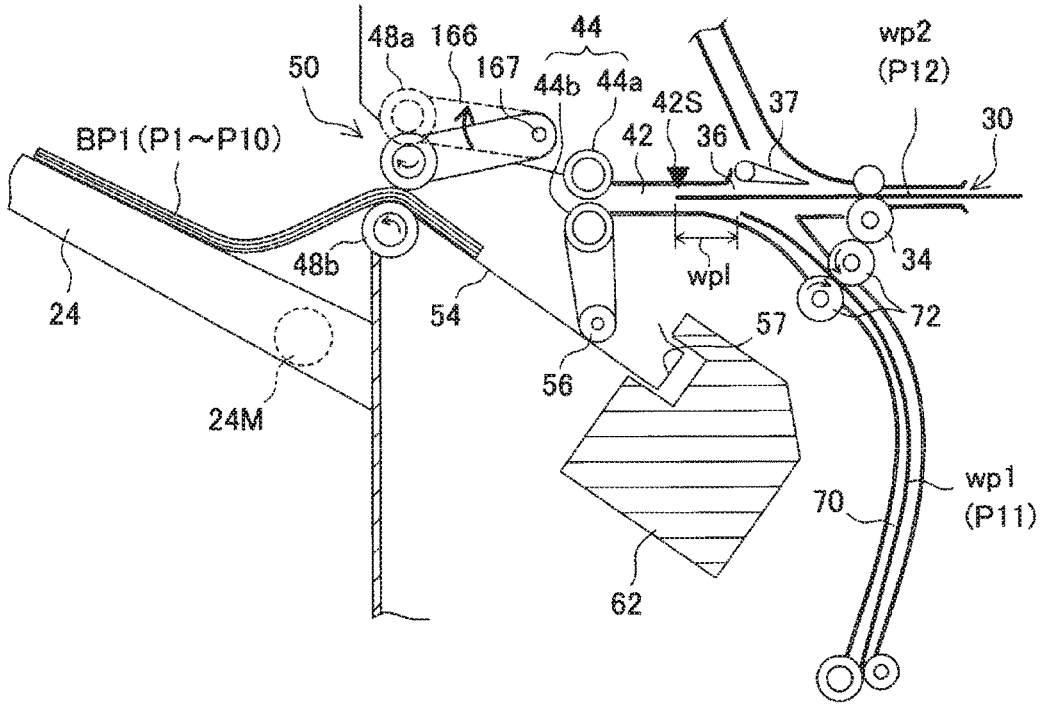

FIGS. 20A and 20B are diagrams showing the stepwise advance bundle discharge subsequent to FIGS. 19A and 19B. FIG. 20A is a diagram in which when the subsequent sheet P11 is switched back and positioned on the upstream side of the discharge rollers 48, the discharge upper roller 48*a* is lowered to nip the sheet bundle BP1 on the placing tray 54 to discharge the bundle in advance. In such a state, the reference surface 57 having pushed the sheet bundle BP1 returns to its original position, and the subsequent sheet P11 is further switchback-conveyed to the branch path 70 by the branch rollers 72. The pushing speed of the reference surface 57 and the bundle discharge speed of the discharge rollers 48 to the first stacking tray 24 here are set to be slower than in the foregoing FIGS. 15A to 16B since the sheet bundle BP1 includes a greater number of sheets.

[Suspension of Advance Bundle Discharge]

Next, in FIG. 20B, a second subsequent sheet P12 is carried in. The nipping and discharge of the sheet bundle by the discharge rollers 48 is suspended, and the discharge upper roller 48*a* is lifted up to the separated position. In such a state, the sheet bundle BP1 discharged in advance is temporarily stopped near the outlet of the placing tray 54. Since the sheet bundle is somewhat curved in shape, the sheet bundle will not collapse. A not-shown auxiliary tray for supporting the sheet bundle BP1 near the discharge lower roller 48*b* or a member for pressing the sheet bundle BP1 may be provided.

Figure 21A:
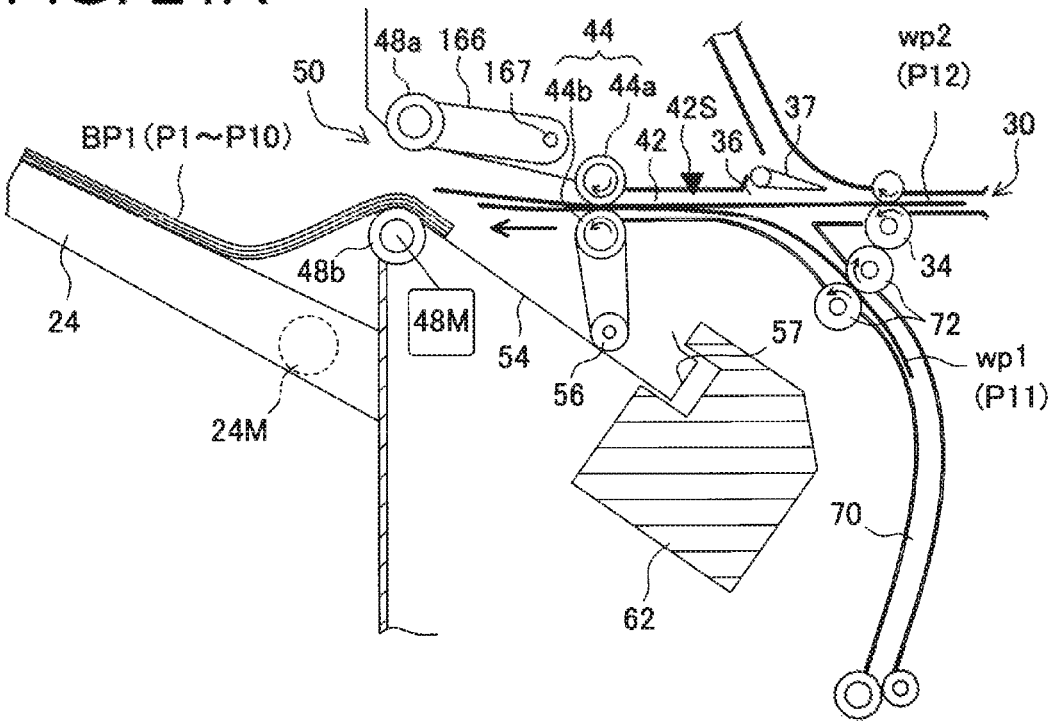
FIGS. 21A and 21B are explanatory diagrams of the stepwise advance bundle discharge subsequent to FIGS. 20A and 20B.
Figure 21B:
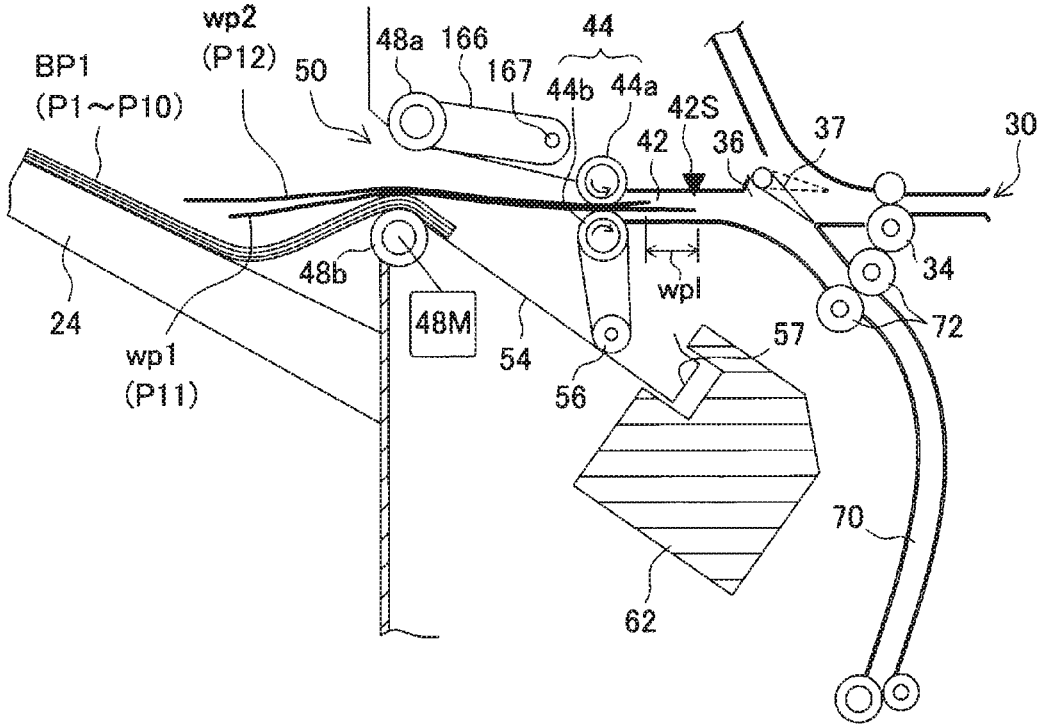

FIGS. 21A and 21B are state diagrams subsequent to FIGS. 20A and 20B. FIG. 21A is a diagram in which the nipping and discharge of the sheet bundle by the discharge rollers 48 is suspended. The subsequent sheet P11 kept on standby as the standby sheet wp1 in the branch path 70 and the subsequent sheet P12 carried in by the carry-in rollers 34 pass between the discharge upper roller 48*a* and the discharge lower roller 48*b* as a bundle. Even in such a case, the sheet bundle BP1 discharged in advance remains temporarily stopped near the outlet of the placing tray 54.

[Execution of Stepwise Discharge of Preceding Sheet Bundle]

Figure 22A:
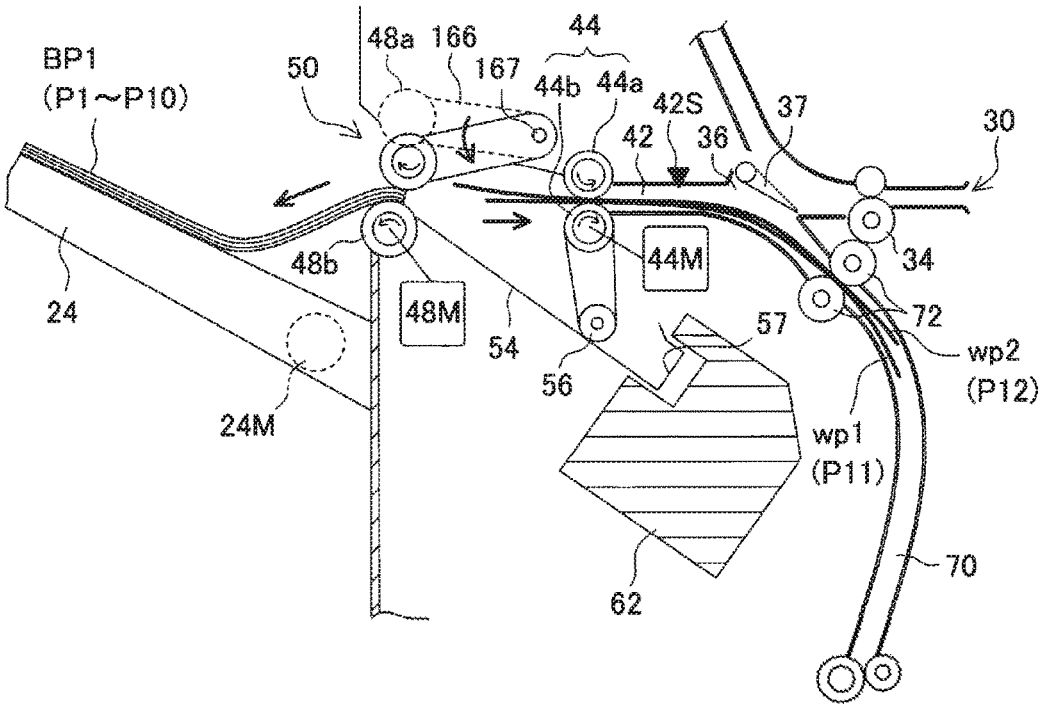
FIGS. 22A and 22B are explanatory diagrams of the stepwise advance bundle discharge subsequent to FIGS. 21A and 21B.
Figure 22B:
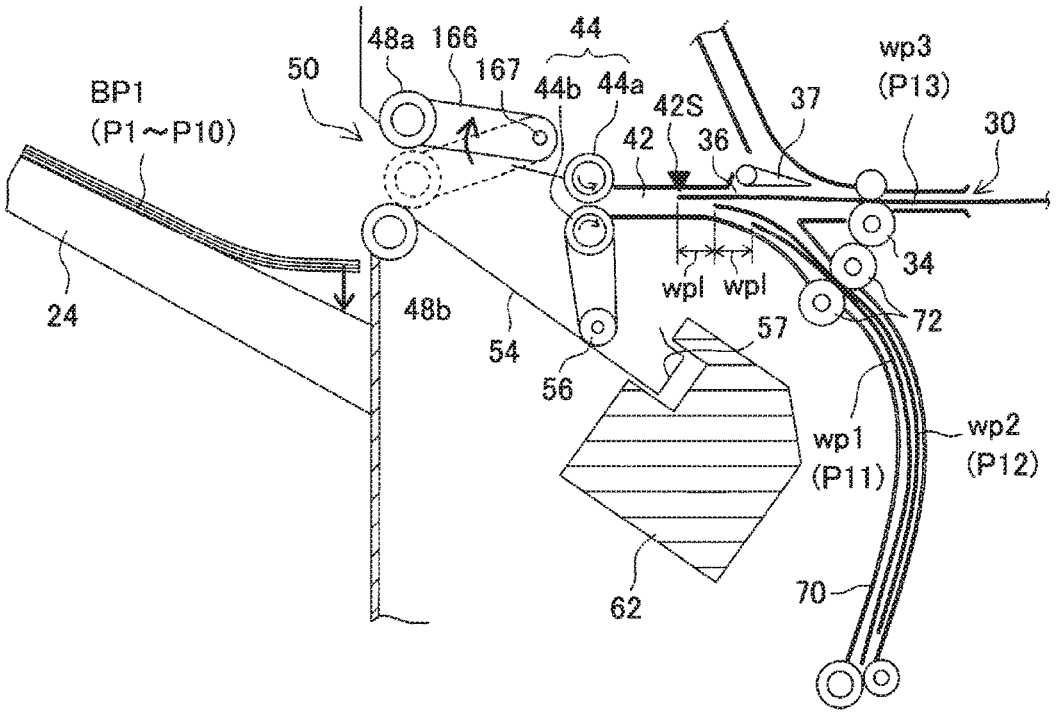

FIGS. 22A and 22B are state diagrams subsequent to FIGS. 21A and 21B. In FIGS. 22A and 22B, stepwise discharge of the preceding sheet bundle is executed. In FIG. 22A, when the two subsequent sheets P11 and P12 are switched back to the upstream side of the discharge rollers 48, the discharge upper roller 48*a* is lowered again. By the lowering, the sheet bundle BP1 on the placing tray 54 in the process of being discharged by the discharge rollers 48 is nipped again, and the discharge rollers 48 are rotated for the next stage of discharge. Next, in FIG. 22B, the sheet bundle BP1 is discharged to the first stacking tray 24 by the discharge rollers 48. In preparation for the carry-in of the next subsequent sheet, the discharge upper roller 48*a* then moves from the pressure contact position shown by the broken lines in FIG. 22B to the separated position shown by the solid lines. Meanwhile, two standby sheets wp1 and wp2 (subsequent sheets P11 and P12) in the branch path 70 serving as the standby path and a subsequent sheet P13 are set on the upstream side of the conveyance rollers 44 with their leading edges apart from each other.

Figure 23A:
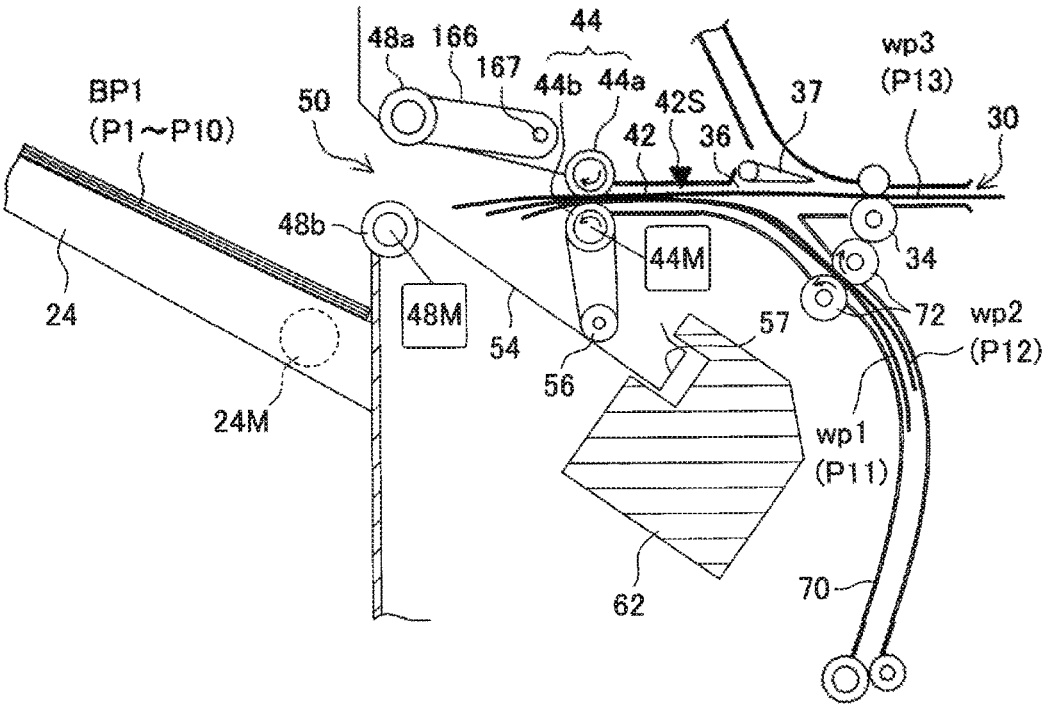
FIGS. 23A and 23B are explanatory diagrams of the stepwise advance bundle discharge subsequent to FIGS. 22A and 22B.
Figure 23B:
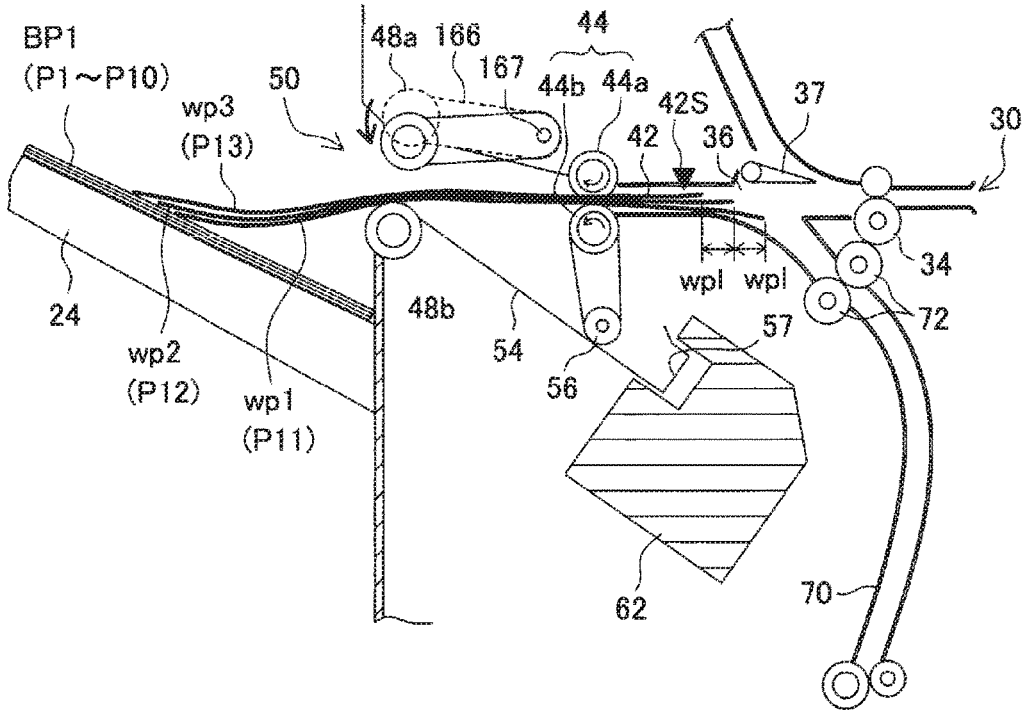

FIGS. 23A and 23B are diagrams of the stepwise advance bundle discharge subsequent to FIGS. 22A and 22B. FIG. 23A shows a state in which the three subsequent sheets P11, P12, and P13 are conveyed to the side of the conveyance tray 54 by the conveyance rollers 44. Two of the three subsequent sheets are the standby sheets wp1 and wp2 kept on standby in the branch path 70 serving as the standby path. In such a state, the discharge upper roller 48*a* is located in the separated position to wait for the leading edges of the subsequent sheets to pass. FIG. 23B illustrates the leading edges of the three subsequent sheets P11, P12, and P13 positioned past the discharge rollers 48. In this state explanatory diagram, the discharge upper roller 48*a* starts to move from the separated position shown by the broken lines in FIG. 23B to the lowered position shown by the solid lines in preparation for the discharge of the trailing edge of the sheet bundle of the three subsequent sheets from the conveyance rollers 44.

Figure 24A:
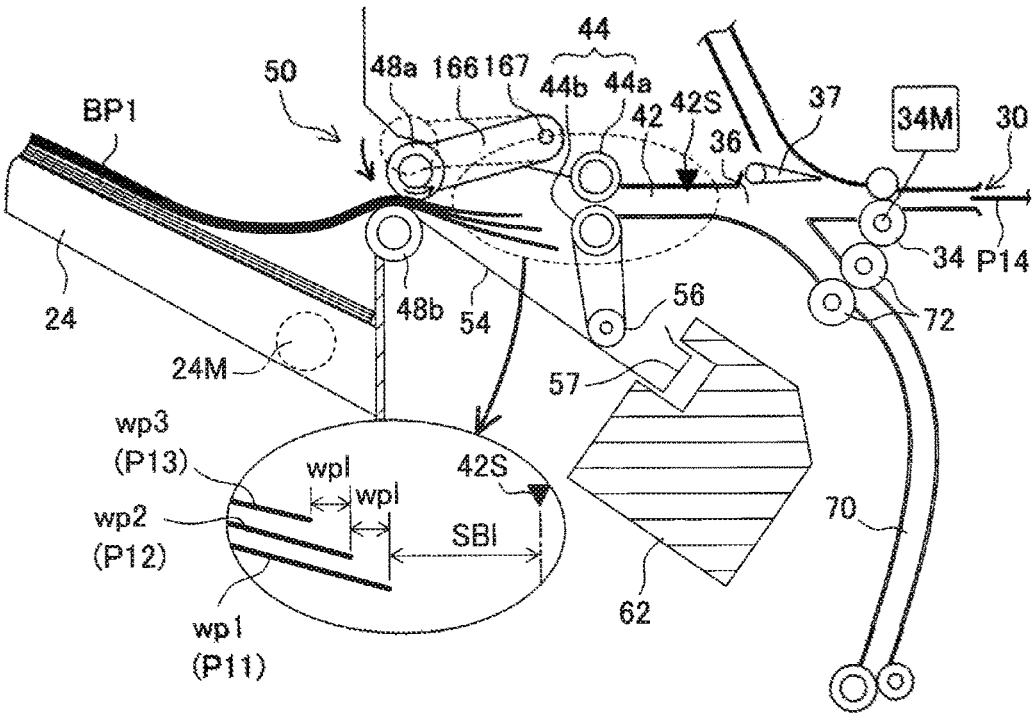
FIGS. 24A and 24B are explanatory diagrams of the stepwise advance bundle discharge subsequent to FIGS. 23A and 23B.
Figure 24B:
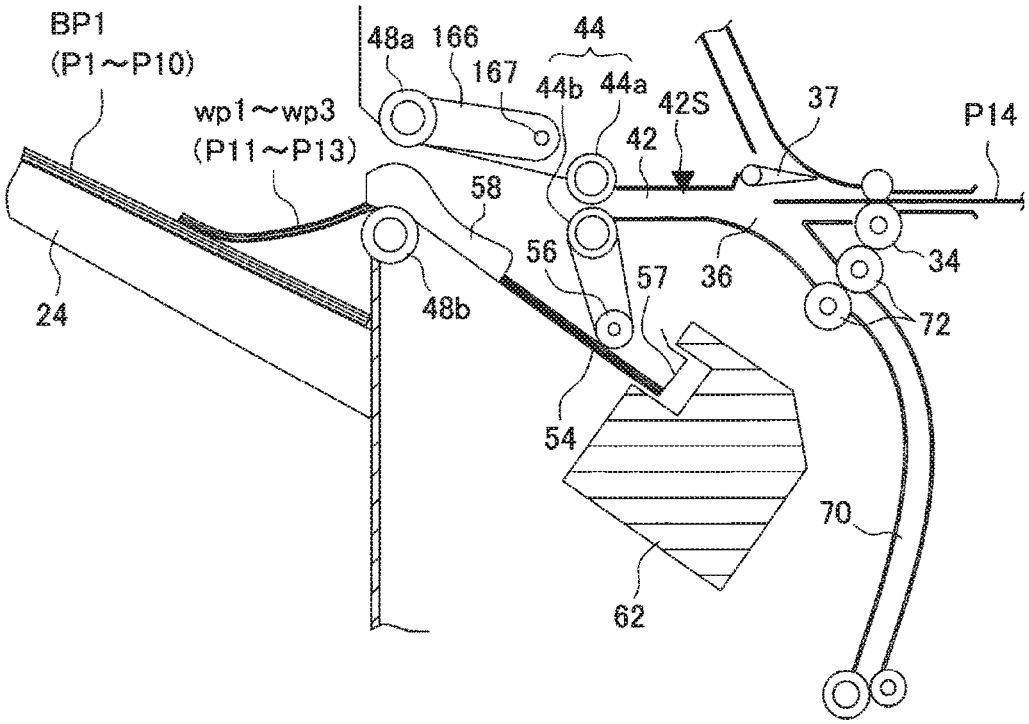

FIGS. 24A and 24B are diagrams subsequent to FIGS. 23A and 23B. In FIG. 24A, the discharge upper roller 48*a* moves in the direction of coming into pressure contact with the discharge lower roller 48*b*, and rotates counterclockwise to switchback-convey the leading edges of the three subsequent sheets P11, P12, and P13 toward the placing tray 54. In such a case, as shown in the ellipse in FIG. 24A, the subsequent sheets P11, P12, and P13 have a difference as much as a distance of wp1 from each other. A distance between the subsequent sheet P11 which is the standby sheet wp1 and the sheet sensor 42S is designed to be SB1.

The reason for the provision of such differences is that when the subsequent sheets are abutted against and aligned by the reference surface 57 of the placing tray 54, the topmost sheet is conveyed by the raking roller 56 and the belt with projections 146. Without such differences or with the differences in reverse order, the topmost sheet would come into contact with the reference plane 57 first and the lower sheets would fail to come into contact. The discharge rollers 48 start to rotate backward (in the direction of the arrow in FIG. 24A) in such a state. The speed is reduced from 600 mm/sec to 300 mm/sec when the subsequent sheets are released to the placing tray 54. Then, the discharge rollers 48 are once stopped. The subsequent sheets are carried in to the placing tray 56 by conveyance at a setting value of 600 mm/sec.

Next, in FIG. 24B, the three subsequent sheets P11, P12, and P13 are stored into the placing tray 54. At the same time, the discharge upper roller 48*a* is lifted up and separated to the separated position. The three subsequent sheets P11, P12, and P13 are aligned and shifted to a position different from that of the previous sheet bundle BP1. The processing then returns to the state of FIG. 19A and is repeated until ten sheets are placed on the placing tray 54. If there is a next sheet to be processed, the processing up to FIGS. 24A and 24B is repeated. If not, the ten sheets placed on the placing tray 54 are discharged to the first stacking tray 24 to complete the processing. Here, the bundle is sorted and shifted to a position different from that of the previous bundle.

The execution procedure of the advance bundle discharge for discharging a sheet bundle stepwise during the switchback of standby sheets wp among three subsequent sheets has been described above. Even in such a case, the sheet bundle on the placing tray 54 is discharged without the subsequent sheets being stacked thereon. The sheets placed on the first stacking tray 24 are therefore less pushed or drawn by the subsequent sheets. This reduces deterioration of the alignment of the sheets stored on the first stacking tray 24. Since the sheet bundle on the placing tray 54 is discharged in advance during the standby operation of the subsequent sheets, the processing can be performed without much reducing the processing speed. Since the sheet bundle can be pushed out and discharged from the placing tray 54 at relatively low speed, the sheet bundle is less likely to collapse.

[Conveyance of Two Subsequent Sheets with Discharge Rollers Closed (Modification of FIGS. 17A and 17B)]

Figure 25A:
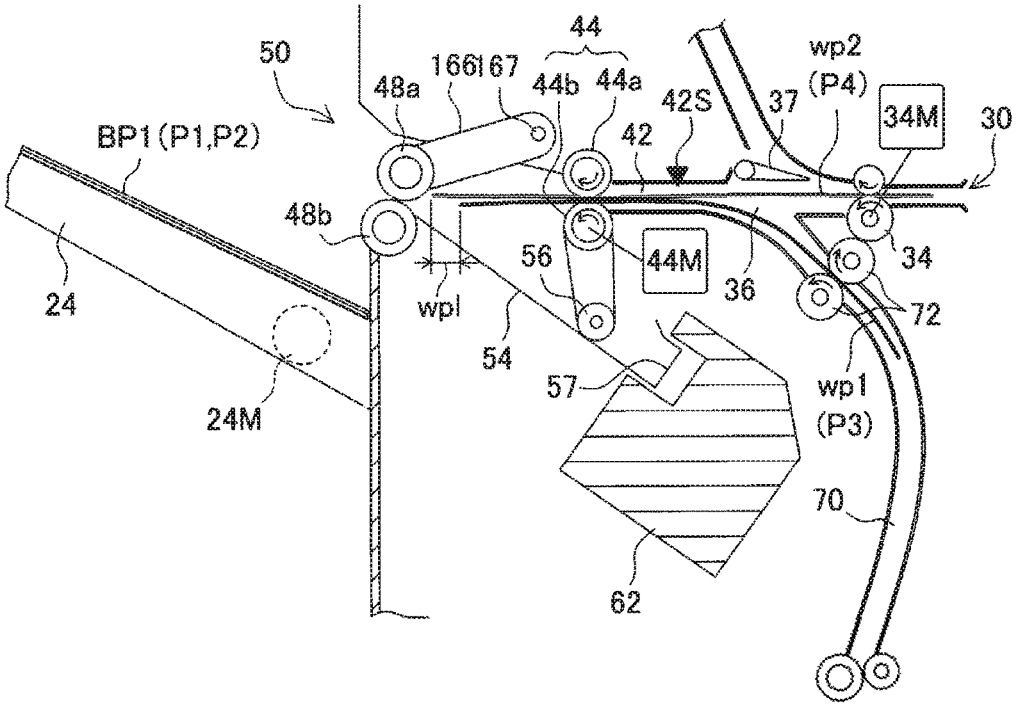
FIGS. 25A and 25B show modifications of FIGS. 16B and 17A.
Figure 25B:
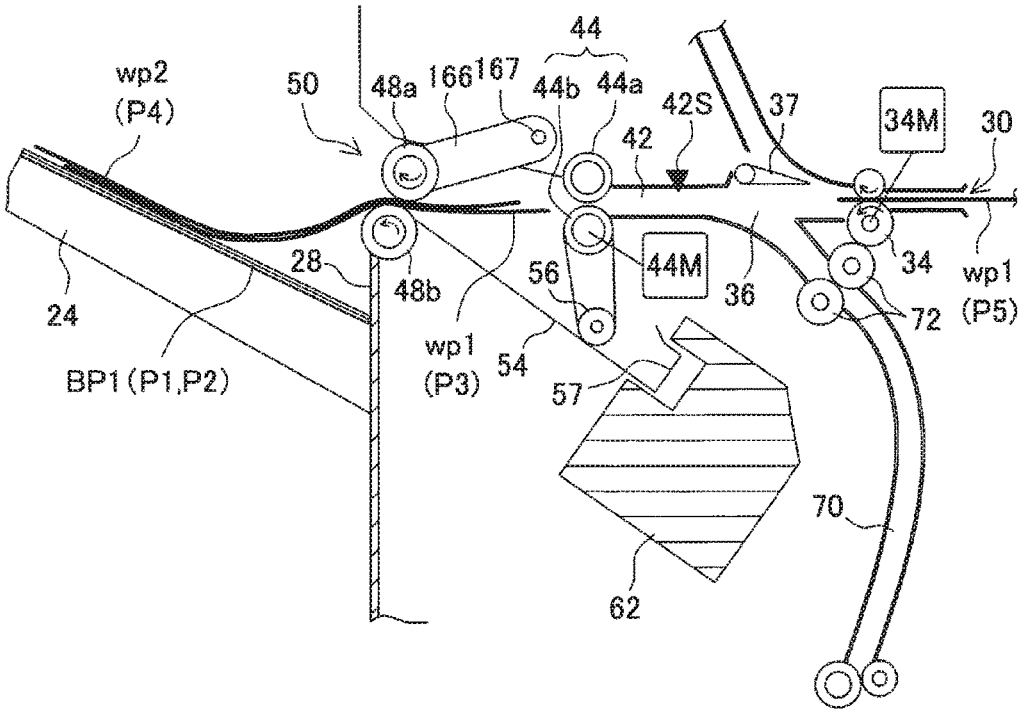

Next, a second modification of the present invention will be described with reference to FIGS. 25A and 25B. FIGS. 25A and 25B show modified states of FIGS. 16B and 17A among the state diagrams described above for advance bundle discharge in FIGS. 14A to 18B. In FIG. 16B, the sheet bundle BP1 is discharged. Then, as shown in FIG. 17A, the subsequent sheets P3 and P4 are continuously conveyed by the conveyance rollers 44 to approach the discharge rollers 48. Here, the discharge upper roller 48*a* is retracted from the pressure contact position shown by the broken lines in FIG. 17A to the separated position shown by the solid lines. The subsequent sheets P3 and P4 pass the position of the discharge rollers 48. After the passage, the discharge upper roller 48*a* is moved to the pressure contact position again.

If the subsequent sheets are two in number, the number of standby sheets wp is one. There is not much room in distance between the sheets, and the discharge upper roller 48*a* needs to be quickly opened and closed. Such an operation needs a discharge roller moving arm motor 160M of relatively large size (see FIG. 4). As has been described as the test confirmation with reference to FIGS. 30A and 30B, if the number of subsequent sheets is two, the subsequent sheets can be conveyed without a problem even with the discharge upper roller 48*a* in the pressure contact state, not opened from the pressure contact position to the separated position.

FIGS. 25A and 25B show a state in which the two subsequent sheets pass the discharge rollers 48 and are then switched back and carried in to the placing tray 54. FIG. 25A is an explanatory diagram showing a state in which when the two subsequent sheets P3 and P4 pass the position of the discharge rollers, the subsequent sheets are conveyed in a nip state without the discharge upper roller 48*a* being lifted up to the separated position. As shown in FIG. 25B, the two subsequent sheets P3 and P4 are then carried in to the placing tray 54 by the reverse rotation of the discharge rollers 48 in the nip state.

As a result, the discharge upper roller 48*a* does not need to be opened and closed if there is not a time margin sufficient for the carry-in to the placing tray 54 between the preceding sheets and the subsequent sheets (in conveying two subsequent sheets including one standby sheet). The discharge roller moving arm motor 160M therefore does not need to be increased in size. The apparatus can thus be reduced in size and weight.

[Conveyance of Three Subsequent Sheets with Discharge Rollers Opened and Closed (Like FIGS. 17A and 17B)]

If the number of subsequent sheets is three or more, as has been described in FIG. 30B, the lowermost sheet np1 of the subsequent sheets guided downward by the guide GA between the conveyance rollers HR and the discharge rollers ER curls up to the side of the placing tray Tr even if somewhat stiffened by the conveyance rollers HR. All the subsequent sheets curl accordingly to cause a jam.

Figure 26A:
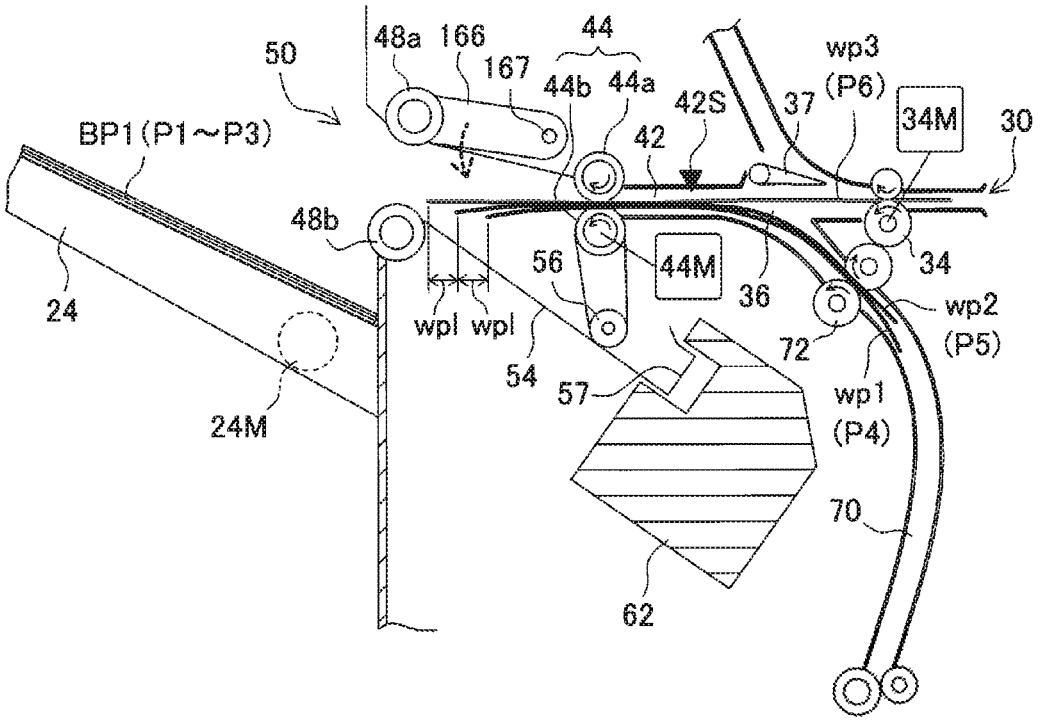
FIGS. 26A and 26B are explanatory diagrams of a state similar to that of FIGS. 17A and 17B.
Figure 26B:
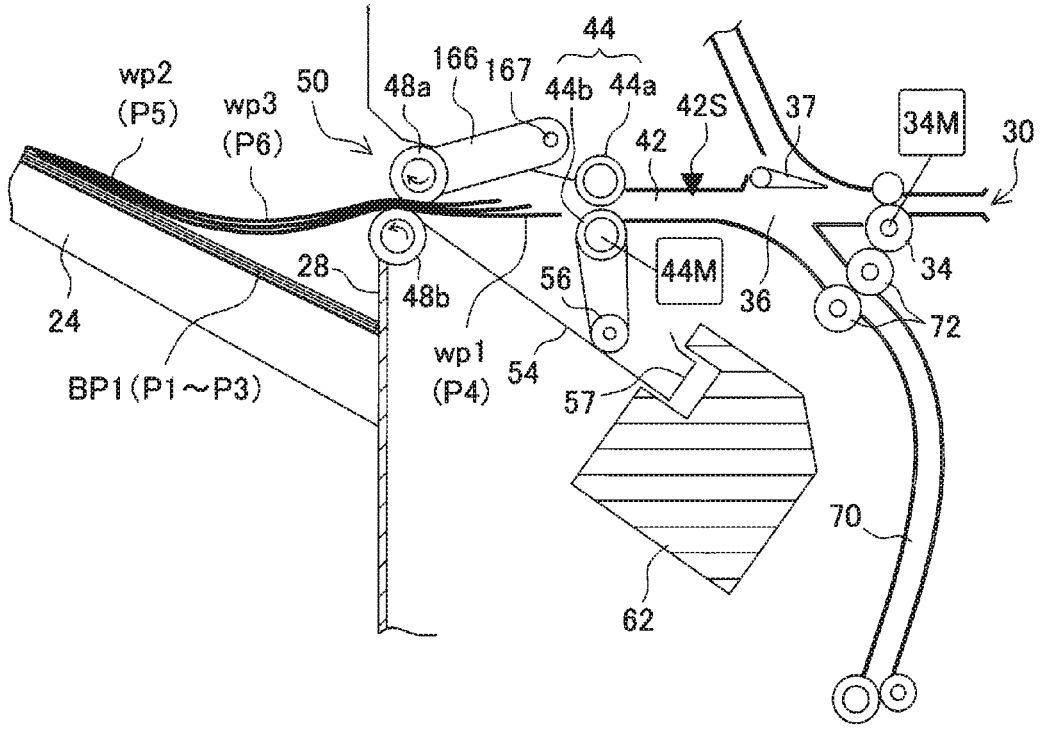

As shown in FIGS. 26A and 26B (a similar state to that of FIGS. 17A and 17B), the subsequent sheets are then accepted with the discharge upper roller 48*a* located in the separated position. FIG. 26A shows such a state in which the discharge upper roller 48*a* is lifted up to the separated position in preparation for the passage of the three subsequent sheets through the position of the discharge rollers. The state then transitions to FIG. 26B, in which if the leading edges of the subsequent sheets pass the discharge upper roller 48*a*, the discharge upper roller 48*a* is lowered. If the trailing edges of the three subsequent sheets nipped by the discharge rollers 48 pass the conveyance rollers 44, switchback is started to carry in the subsequent sheets to the placing tray 54.

In such a case, the discharge roller moving arm motor 160M for moving the discharge upper roller 48*a* up and down does not need to be increased in size. The reason is that if the subsequent sheets are three or more in number, the number of standby sheets wp is two or more and there is a time margin between sheets to be carried in to the placing tray 54. The subsequent sheets can thus be moved relatively slowly without increasing the discharge roller moving arm motor 160M in size.

As described above, the number of subsequent sheets to be carried in to the placing tray 54 is determined in the determination step. If the number of subsequent sheets is two, a nip acceptance step of conveying the subsequent sheets with the discharge upper roller 48*a* kept closed in the pressure contact position is performed. The subsequent sheets are switchback-conveyed and carried in to the placing tray 54. On the other hand, if the number of subsequent sheets is three or more, the processing proceeds to an open acceptance step in which the discharge upper roller 48*a* is once lifted up to the separated position. The processing then proceeds to a nipping step of lowering the discharge upper roller 48*a* to nip the subsequent sheets after the leading edges of the subsequent sheets pass the discharge upper roller 48*a*, and the subsequent sheets are carried in to the placing tray 54. Since the discharge upper roller 48*a* is thus opened and closed depending on the number of subsequent sheets, the sheets can be switchback-conveyed to the placing tray 54 without increasing the driving source in size.

In the present embodiment, a discharge step of nipping the sheet bundle on the placing tray 54 by the discharge rollers 48 and discharging the sheet bundle from the placing tray 54 to the first stacking tray 24 is performed at a stage when the subsequent sheets are returned to the upstream side, before the foregoing nip acceptance step or open acceptance step.

[Description of Control Configuration]

A system control configuration of the foregoing image forming apparatus will be described with reference to the block diagram of FIG. 28. The system of the image forming apparatus shown in FIG. 1 includes the image formation control unit 200 of the image forming apparatus A and the sheet processing control unit 204 (control CPU) of the sheet processing apparatus B. The image formation control unit 200 includes a sheet feed control unit 202 and the input unit 203. As has been described, a "print mode" and a "sheet processing mode" can be set on the control panel 18 arranged on the input unit 203.

The sheet processing control unit 204 is a control CPU for operating the sheet processing apparatus B according to the sheet processing mode specified as described above. The sheet processing control unit 204 includes a ROM 206 which stores an operation program, and a RAM 207 which stores control data. Signals from various sensor input units, including a carry-in sensor 30S for detecting a sheet in the carry-in path 32, the sheet sensor 42S for detecting a sheet in the conveyance path 42, the branch sensor 70S for detecting a sheet in the branch path 70, and the sheet surface sensor 24S for detecting a sheet surface on the first stacking tray 24, are input to the sheet processing control unit 204.

The sheet processing control unit 204 includes a sheet conveyance control unit 210. The sheet conveyance control unit 210 controls a carry-in roller motor 34M on the carry-in path 32 of a sheet, the conveyance roller motor 44M on the conveyance path 42 and the branch path, the discharge roller motor 48M at the outlet of the placing tray 54, and the discharge roller moving arm motor 160M for lifting the discharge upper roller 48*a* up and down. The sheet processing control unit 204 further includes a punch driving control unit 211 and a placing tray (processing tray) control unit 212. The punch driving control unit 211 controls a punch motor 31M for performing punching processing on sheets in the punch unit 31. The placing tray control unit 212 controls the alignment plates 58 and the like for performing a sheet stacking operation on the placing tray 54. The sheet processing control unit 204 further includes an end binding control unit 213 and a first stacking tray lifting control unit 214. The end binding control unit 213 controls the end binding motor 62M of the end binding unit 62 which performs the end binding on the sheet bundle on the placing tray 54. The first stacking tray lifting control unit 214 controls the lifting motor 24M which lifts up and down according to end-bound sheet bundles and sheet switchback on the first stacking tray 24.

The sheet processing control unit 204 further includes a stacker control unit 216 and a saddle stitch control unit 217. The stacker control unit 216 controls the saddle stitch alignment plates 81 of sheets stacked in the stacker 84 which is the second processing tray for saddle stitch processing, and the stopper 85 for regulating the leading edges of the sheets. The saddle stitch control unit 217 controls the saddle stitching unit 82 which binds the sheet bundle in the center in the conveyance direction.

The sheet processing control unit 204 further includes a folding and discharge control unit 218. The folding and discharge control unit 218 controls a folding processing unit and bundle discharge rollers 98 which fold the saddle-stitched sheet bundle in two and discharge the sheet bundle to the second stacking tray 26. Such control units, the sensors for detecting conveyed sheets, and the driving motors are connected as described above in the description of each operation mode.

[Description of Sheet Processing Mode]

The sheet processing control unit 204 according to the present embodiment configured as described above makes the sheet processing apparatus B perform, for example, a "print out mode", "end binding mode (first processing)", "sort (jog) mode", and "saddle stitching mode". Such processing modes will be described below.

(1) "Print Out Mode"

Receive image-formed sheets from the main body discharge port 3 of the image forming apparatus A. Store the sheets into the first stacking tray 24 by using the conveyance rollers 44 and the discharge rollers 48.

(2) "End Binding Mode (First Processing)"

Receive image-formed sheets from the main body discharge port 3 by the placing tray 54. Align the sheets into a bundle, perform the binding processing by the end binding unit 62, and store the resultant into the first stacking tray 24. In this end binding processing, "standby conveyance" for switchback-conveying and temporarily keeping a preceding sheet or sheets in the branch path 70 on standby as a standby sheet or sheets wp is performed to prevent the discharging of subsequent sheets from the main body discharge port 3 from being interrupted.

(3) "Sort (Jog) Mode (Second Processing)"

Receive image-formed sheets from the main body discharge port 3 by the placing tray 54. Shift the sheets one by one to either the front side or the rear side for one-side alignment, and store the resultant into the first stacking tray 24 without binding. By using the one-side shift members, sheets can be sorted (jogged) on the first stacking tray 24 as described in FIGS. 8A to 8C. Even with the sorting (jog), the "standby conveyance" for switchback-conveying and temporarily keeping a preceding sheet or sheets in the branch path 70 on standby as a standby sheet or sheets wp is performed to prevent the discharging of subsequent sheets from the main body discharge port 3 from being interrupted.

(4) "Saddle Stitching Mode"

Receive image-formed sheets from the main body discharge port 3 of the image forming apparatus A by the stacker 84. Align the sheets into a bundle. Bind the sheets substantially in the center of the accepting conveyance direction by the saddle stitching unit 82. Fold the bound sheets into a booklet shape and store the resultant into the second stacking tray 26. In the saddle stitch processing, the "second tray conveyance" for once discharging sheets from the main body discharge port 3 onto the first stacking tray 24, switchback-conveying the sheets to the branch path 70, and conveying the sheets to the stacker 84 is performed.

As described above, according to the foregoing embodiment, an apparatus that prevents deterioration of sheet alignment on the first stacking tray 24 due to subsequent sheets and thus reduces the occurrence of sheet jams can be provided. An apparatus in which the driving source for moving the discharge upper roller 48*a* to open and close is not increased in size can also be provided.

The present invention is not limited to the foregoing exemplary embodiment. Various modifications may be made without departing from the invention. The present invention is directed to all technical matters included in the technical concept set forth in the claims. While the foregoing exemplary embodiment is a suitable example, it is possible for those skilled in the art to make various alternatives, corrections, modifications, and improvements from the contents disclosed in this specification. Such alternatives, corrections, modification, and improvements are within the technical scope set forth in the accompanying claims.

This application claims the priority of Japanese Patent Application No. 2016-182626 filed on Sep. 20, 2016, Japanese Patent Application No. 2016-182627 filed on the same date, and Japanese Patent Application No. 2016-182628 filed on the same date, which are incorporated herein by reference.

What is claimed is:

1. A sheet processing apparatus comprising:

a placing tray on which sheets are placed as a sheet bundle;

a sheet processing unit that processes the sheet bundle on the placing tray;

a discharge roller that is movable between a nip position in which the sheet bundle processed by the sheet processing unit is nipped and discharged in a discharge direction and a release position in which nipping of the sheet bundle is released;

a stacking tray on which the sheet bundle discharged by the discharge roller is stacked;

a conveyance roller that is arranged on an upstream side of the discharge roller in the discharge direction, and conveys a sheet in a conveyance direction toward the placing tray and in a direction opposite to the conveyance direction;

a standby path that keeps the sheet conveyed in the direction opposite to the conveyance direction on standby; and a control unit that controls the discharge roller and the conveyance roller, wherein a leading edge of a subsequent sheet conveyed by the conveyance roller after the sheet bundle is stacked on the placing tray, is reached to a downstream side of the discharge roller in the conveyance direction where the discharge roller is located at the release position, and then the subsequent sheet is conveyed in the direction opposite to the conveyance direction until the leading edge of the subsequent sheet is reached to the upstream side of the discharge roller not to be nipped by the discharge roller, and thereafter, the sheet bundle processed by the sheet processing unit is nipped and discharged from the placing tray to the stacking tray by the discharge roller.

2. The sheet processing apparatus according to claim 1, wherein when the conveyance roller discharges the subsequent sheet from the standby path to the placing tray, the discharge roller is capable of nipping the subsequent sheet and rotating backward in a direction reverse to the discharge direction to the stacking tray to move the subsequent sheet to a reference side of the placing tray.

3. The sheet processing apparatus according to claim 1, wherein the placing tray includes a moving member that moves the processed sheets on the placing tray toward the stacking tray, and the control unit makes the moving member push the processed sheets placed on the placing tray toward the stacking tray in advance according to movement of the subsequent sheet.

4. The sheet processing apparatus according to claim 3, wherein the control unit makes the moving member push the processed sheets on the placing tray after the subsequent sheet starts being switchback-conveyed by the conveyance roller.

5. The sheet processing apparatus according to claim 4, wherein the sheet processing unit is a shift member that changes a placing position of the sheets placed on the placing tray to sort sheets on the stacking tray.

6. The sheet processing apparatus according to claim 5, wherein the shift member includes an alignment plate that aligns the sheets placed on the placing tray, the alignment plate being arranged to be capable of shifting between a contact position in which to come into contact with a side edge of the sheets and a separated position separate from the contact position.

7. The sheet processing apparatus according to claim 6, wherein an end binding unit that binds the sheets on the placing tray, the sheets being aligned by the alignment plate, is arranged on a reference side of the placing tray to be movable in a sheet width direction.

8. The sheet processing apparatus according to claim 7, wherein a stacker and a saddle stitching unit are arranged on the standby path for keeping the sheet switchback-conveyed by the conveyance roller on standby, the stacker including a path curved beside the placing tray and stacking sheets on a downstream side of the curved path, the saddle stitching unit binding a midsection of the sheets stacked in the stacker.

9. The sheet processing apparatus according to claim 1, wherein if there is a plurality of subsequent sheets switchback-conveyed by the conveyance roller and kept on standby in the standby path, the control unit nips the processed sheets by the discharge roller and sequentially moves and discharges the processed sheets from the placing tray toward the stacking tray in a divided manner each time each of the subsequent sheets returns to the upstream side of the discharge roller.

10. The sheet processing apparatus according to claim 9, wherein the placing tray includes a moving member that moves the sheets on the placing tray toward the stacking tray, and the moving member pushes the processed sheets placed on the placing tray toward the stacking tray in advance after the control unit starts switchback conveyance of a first one of the subsequent sheets.

11. An image forming apparatus comprising:

an image forming unit that forms an image on a sheet; and a sheet processing apparatus that performs processing on a sheet conveyed from the image forming apparatus, the sheet processing apparatus being the sheet processing apparatus according to claim 1.

12. The sheet processing apparatus according to claim 1, wherein the conveyance roller conveys the sheet in the conveyance direction such that a part of the sheet is stacked on the sheet bundle processed by the sheet processing unit, the placing tray includes a moving member that is arranged at a side opposite to the stacking tray and moves on the placing tray toward the stacking tray, and the control unit controls the moving member such that the moving member pushes a rear edge of the sheet bundle on the placing tray after the sheet starts being conveyed in the direction opposite to the conveyance direction, and the sheet bundle is pulled toward the moving member by the part of the sheet to improve alignment of the sheet bundle.

13. The sheet processing apparatus according to claim 12, wherein the control unit controls the discharge roller such that the sheet bundle is nipped and discharged from the placing tray to the stacking tray after the part of the sheet is separated from the sheet bundle.

* * * * *